US011482205B2

(12) United States Patent
Fridman et al.

(10) Patent No.: US 11,482,205 B2
(45) Date of Patent: Oct. 25, 2022

(54) APPARATUS, SYSTEM AND METHOD OF ACTIVE ACOUSTIC CONTROL (AAC) AT AN OPEN ACOUSTIC HEADPHONE

(71) Applicant: SILENTIUM LTD., Nes Ziona (IL)

(72) Inventors: Tzvi Fridman, Nes Tziona (IL); Sivan Grotas Mussan, Rishon Lezion (IL); Yael Ronen, Ness Tziona (IL); Nikolaos Zafeiropoulos, Athens (GR)

(73) Assignee: SILENTIUM LTD., Nes Ziona (IL)

( * ) Notice: Subject to any disclaimer, the term of this patent is extended or adjusted under 35 U.S.C. 154(b) by 0 days.

(21) Appl. No.: 17/670,547

(22) Filed: Feb. 14, 2022

(65) Prior Publication Data

US 2022/0270583 A1 Aug. 25, 2022

Related U.S. Application Data

(60) Provisional application No. 63/308,708, filed on Feb. 10, 2022, provisional application No. 63/149,341, filed on Feb. 14, 2021.

(51) Int. Cl.
*G10K 11/178* (2006.01)
*G10K 11/34* (2006.01)

(52) U.S. Cl.
CPC .. *G10K 11/17854* (2018.01); *G10K 11/17817* (2018.01); *G10K 11/17823* (2018.01); *G10K 11/17881* (2018.01); *G10K 11/34* (2013.01)

(58) Field of Classification Search
None
See application file for complete search history.

(56) References Cited

U.S. PATENT DOCUMENTS

| | | | | |
|---|---|---|---|---|
| 10,757,503 | B2 * | 8/2020 | Colich | H04R 1/2807 |
| 2014/0169579 | A1 * | 6/2014 | Azmi | H04R 1/1083 381/71.6 |
| 2016/0300562 | A1 * | 10/2016 | Goldstein | G10K 11/17879 |
| 2020/0342082 | A1 * | 10/2020 | Sapozhnykov | G06K 9/6268 |
| 2020/0380948 | A1 | 12/2020 | Honda et al. | |

OTHER PUBLICATIONS

Muhammad Tahir Akhtar et al., "On Active Noise Control Systems With Online Acoustic Feedback Path Modeling", IEEE Transactions on Audio, Speech, and Language Processing, vol. 15, No. 2, Feb. 2007, pp. 593-600.

International Search Report and the Written Opinion for International Application No. PCT/IB2022/051268, dated Jun. 29, 2022, 9 pages.

* cited by examiner

*Primary Examiner* — Kenny H Truong
(74) *Attorney, Agent, or Firm* — Shichrur & Co.

(57) ABSTRACT

For example, an apparatus for Active Acoustic Control (AAC) of an open acoustic headphone may include an input to receive input information including a residual-noise input including residual-noise information corresponding to a residual noise sensor of the open acoustic headphone, and a noise input including noise information corresponding to a noise sensor of the open acoustic headphone; a controller configured to determine a sound control pattern configured for AAC of the open acoustic headphone, the controller configured to identify a mounting-based parameter of the open acoustic headphone based on the input information, and to determine the sound control pattern based on the mounting-based parameter, the residual-noise input, and the noise input; and an output to output the sound control pattern to an acoustic transducer of the open acoustic headphone.

24 Claims, 19 Drawing Sheets

1400

APPARATUS, SYSTEM AND METHOD OF ACTIVE ACOUSTIC CONTROL (AAC) AT AN OPEN ACOUSTIC HEADPHONE

CROSS-REFERENCE

This application claims the benefit of and priority from U.S. Provisional Patent Application No. 63/149,341, entitled "APPARATUS, SYSTEM AND METHOD OF ACTIVE ACOUSTIC CONTROL (AAC) AT AN OPEN ACOUSTIC HEADPHONE", filed Feb. 14, 2021, and from U.S. Provisional Patent Application No. 63/308,708, entitled "APPARATUS, SYSTEM, AND METHOD OF ACOUSTIC FEEDBACK (AFB) MITIGATION", filed Feb. 10, 2022, the entire disclosures of which are incorporated herein by reference.

TECHNICAL FIELD

Aspects described herein generally relate to Active Acoustic Control (AAC) at an open acoustic headphone.

BACKGROUND

A headphone device may include an Active Noise Control (ANC) system to improve sound performance and sound experience of a user of the headphone device.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

Figure 1:
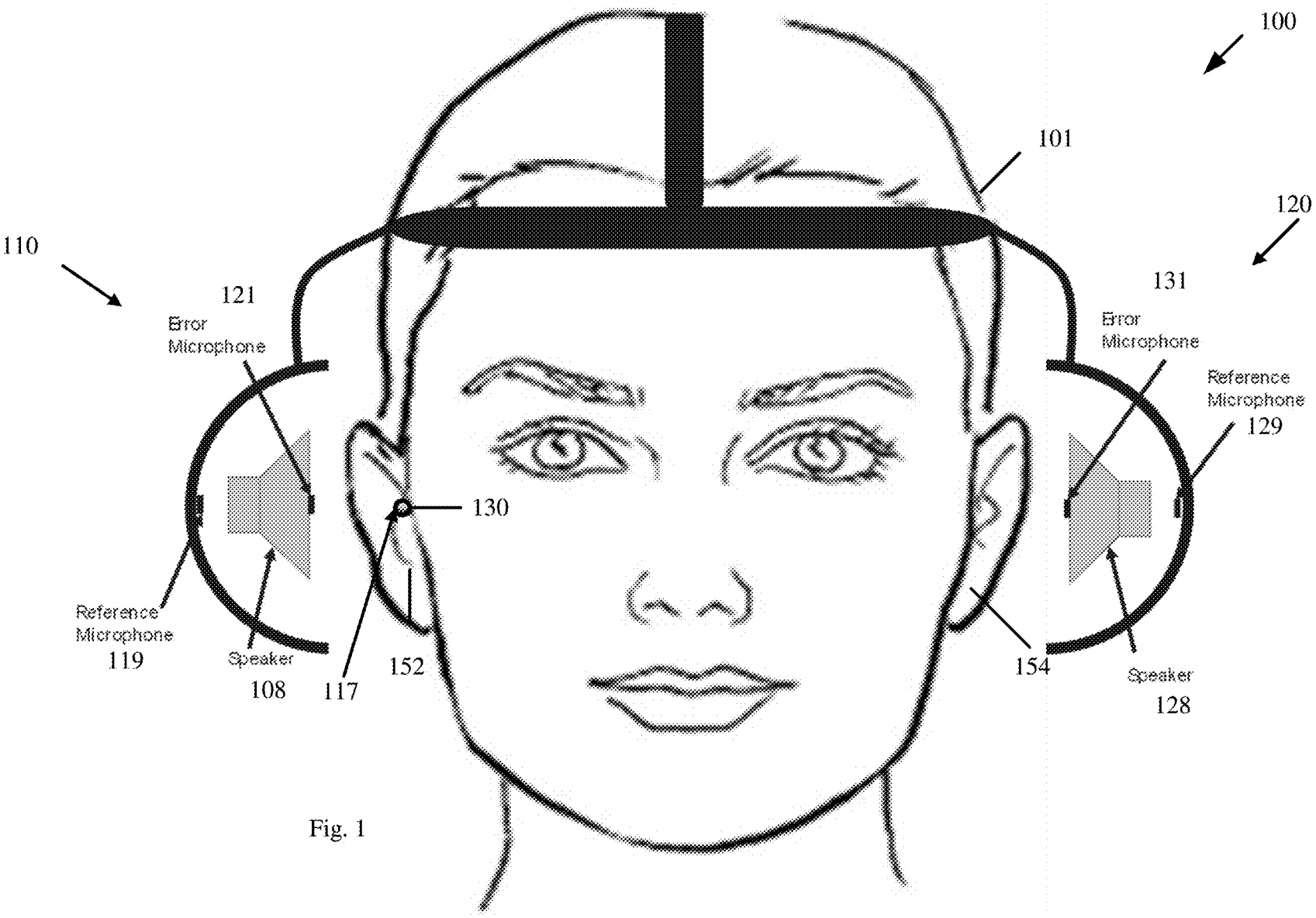
FIG. 1 is a schematic block diagram illustration of an open acoustic headphone device with Active Acoustic Control (AAC), in accordance with some demonstrative aspects.

In the following detailed description, numerous specific details are set forth in order to provide a thorough understanding of some aspects. However, it will be understood by persons of ordinary skill in the art that some aspects may be practiced without these specific details. In other instances, well-known methods, procedures, components, units and/or circuits have not been described in detail so as not to obscure the discussion.

Discussions herein utilizing terms such as, for example, "processing", "computing", "calculating", "determining", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "plurality" and "a plurality" as used herein include, for example, "multiple" or "two or more". For example, "a plurality of items" includes two or more items.

Some portions of the following detailed description are presented in terms of algorithms and symbolic representations of operations on data bits or binary digital signals within a computer memory. These algorithmic descriptions and representations may be the techniques used by those skilled in the data processing arts to convey the substance of their work to others skilled in the art.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

As used herein, the term "circuitry" may refer to, be part of, or include, an Application Specific Integrated Circuit (ASIC), an integrated circuit, an electronic circuit, a processor (shared, dedicated, or group), and/or memory (shared, dedicated, or group), that execute one or more software or firmware programs, a combinational logic circuit, and/or other suitable hardware components that provide the described functionality. In some aspects, the circuitry may be implemented in, or functions associated with the circuitry may be implemented by, one or more software or firmware modules. In some aspects, circuitry may include logic, at least partially operable in hardware.

The term "logic" may refer, for example, to computing logic embedded in circuitry of a computing apparatus and/or computing logic stored in a memory of a computing apparatus. For example, the logic may be accessible by a processor of the computing apparatus to execute the computing logic to perform computing functions and/or operations. In one example, logic may be embedded in various types of memory and/or firmware, e.g., silicon blocks of various chips and/or processors. Logic may be included in, and/or implemented as part of, various circuitry, e.g., radio circuitry, receiver circuitry, control circuitry, transmitter circuitry, transceiver circuitry, processor circuitry, and/or the like. In one example, logic may be embedded in volatile memory and/or non-volatile memory, including random access memory, read only memory, programmable memory, magnetic memory, flash memory, persistent memory, and/or the like. Logic may be executed by one or more processors using memory, e.g., registers, buffers, stacks, and the like, coupled to the one or more processors, e.g., as necessary to execute the logic.

Some demonstrative aspects include systems and methods, which may be efficiently implemented for controlling noise, for example, reducing or eliminating undesirable noise, for example, noise in one or more frequency ranges, e.g., generally low, mid and/or high frequencies, as described below.

Some demonstrative aspects may include methods and/or systems of Active Acoustic Control (AAC) configured to control acoustic energy and/or wave amplitude of one or more acoustic patterns produced by one or more acoustic sources, which may include known and/or unknown acoustic sources, e.g., as described below.

In some demonstrative aspects, an AAC system may be configured as, and/or may perform one or more functionalities of, an Active Noise Control (ANC) system, and/or an Active Sound Control (ASC) system, which may be configured to control, reduce and/or eliminate the noise energy and/or wave amplitude of one or more acoustic patterns ("primary patterns") produced by one or more noise sources, which may include known and/or unknown noise sources, e.g., as described below.

In some demonstrative aspects, an AAC system may be configured to produce an acoustic control pattern (also referred to as "sound control pattern" or "secondary pattern"), e.g., including a destructive noise pattern and/or any other sound control pattern, e.g., as described below.

In some demonstrative aspects, the AAC system may be configured to generate the acoustic control pattern, for example, based on one or more of the primary patterns, for example, such that a controlled sound zone, for example, a reduced noise zone, e.g., a quiet zone, may be created by a combination of the secondary and primary patterns, e.g., as described below.

In some demonstrative aspects, the AAC system may be configured to control, reduce and/or eliminate noise within a predefined location, area or zone ("the acoustic control zone", "the noise-control zone", also referred to as the "quiet zone", or "Quiet Bubble™"), without, for example, regardless of, and/or without using a-priori information regarding the primary patterns and/or the one or more noise sources, e.g., as described below.

For example, the AAC system may be configured to control, reduce and/or eliminate noise within the acoustic control zone, e.g., independent of, regardless of and/or without knowing in advance one or more attributes of one or more of the noise sources and/or one or more of the primary patterns, for example, the number, type, location and/or other attributes of one or more of the primary patterns and/or one or more of the noise sources, e.g., as described below.

Some demonstrative aspects are described herein with respect to AAC systems and/or methods configured to reduce and/or eliminate the noise energy and/or wave amplitude of one or more acoustic patterns within a quiet zone, e.g., as described below.

However, in other aspects, any other AAC and/or sound control systems and/or methods may be configured to control in any other manner any other acoustic energy and/or wave amplitude of one or more acoustic patterns within an acoustic control zone (sound control zone), for example, to affect, alter and/or modify the sound energy and/or wave amplitude of one or more acoustic patterns within a predefined zone, e.g., as described below.

In one example, the AAC systems and/or methods may be configured to selectively reduce and/or eliminate the acoustic energy and/or wave amplitude of one or more types of acoustic patterns within the acoustic control zone and/or to selectively increase and/or amplify the acoustic energy and/or wave amplitude of one or more other types of acoustic patterns within the acoustic control zone; and/or to selectively maintain and/or preserve the acoustic energy and/or wave amplitude of one or more other types of acoustic patterns within the acoustic control zone, e.g., as described below.

In some demonstrative aspects, an AAC system may be configured as, and/or may perform or more functionalities of, a sound control system, for example, a personal sound control system (also referred to as a "Personal Sound Bubble (PSB)™ system"), which may be configured to produce a sound control pattern, which may be based on at least one audio input, for example, such that at least one personal sound zone, may be created based on the audio input, e.g., as described below.

In some demonstrative aspects, the AAC system may be configured to control sound within at least one predefined location, area or zone, e.g., at least one PSB, for example, based on audio to be heard by a user. In one example, the PSB may be configured to include an area around a head and/or ears of the user, e.g., as described below.

In some demonstrative aspects, the AAC system may be configured to control a sound contrast between one or more first sound patterns and one or more second sound patterns in the PSB, e.g., as described below.

In some demonstrative aspects, for example, the AAC system may be configured to control a sound contrast between one or more first sound patterns of audio to be heard by the user, and one or more second sound patterns, e.g., as described below.

In some demonstrative aspects, for example, the AAC system may be configured to selectively increase and/or amplify the sound energy and/or wave amplitude of one or more types of acoustic patterns within the PSB, e.g., based on the audio to be heard in the PSB; to selectively reduce and/or eliminate the sound energy and/or wave amplitude of one or more types of acoustic patterns within the PSB, e.g., based on acoustic signals which are to be reduced and/eliminated; and/or to selectively and/or to selectively maintain and/or preserve the sound energy and/or wave amplitude of one or more other types of acoustic patterns within the PSB, e.g., as described below.

In some demonstrative aspects, the AAC system may be configured to control the sound within the PSB based on any other additional or alternative input or criterion.

In some demonstrative aspects, the AAC system may be configured to control, reduce, and/or eliminate the acoustic energy and/or wave amplitude of one or more of the primary patterns within the acoustic control zone.

In some demonstrative aspects, the AAC system may be configured to control, reduce, and/or eliminate noise within the acoustic control zone in a selective and/or configurable manner, e.g., based on one or more predefined noise pattern attributes, such that, for example, the noise energy, wave amplitude, phase, frequency, direction and/or statistical properties of one or more first primary patterns may be affected by the secondary pattern, while the secondary pattern may have a reduced effect or even no effect on the noise energy, wave amplitude, phase, frequency, direction and/or statistical properties of one or more second primary patterns, e.g., as described below.

In some demonstrative aspects, the AAC system may be configured to control, reduce and/or eliminate the acoustic energy and/or wave amplitude of the primary patterns on a predefined envelope or enclosure surrounding and/or enclosing the acoustic control zone and/or at one or more predefined locations within the acoustic control zone.

In one example, the acoustic control zone may include a two-dimensional zone, e.g., defining an area in which the acoustic energy and/or wave amplitude of one or more of the primary patterns is to be controlled, reduced and/or eliminated.

According to this example, the AAC system may be configured to control, reduce and/or eliminate the acoustic energy and/or wave amplitude of the primary patterns along a perimeter surrounding the acoustic control zone and/or at one or more predefined locations within the acoustic control zone.

In one example, the acoustic control zone may include a three-dimensional zone, e.g., defining a volume in which the acoustic energy and/or wave amplitude of one or more of the primary patterns is to be controlled, reduced and/or eliminated. According to this example, the AAC system may be configured to control, reduce and/or eliminate the acoustic energy and/or wave amplitude of the primary patterns on a surface enclosing the three-dimensional volume.

In one example, the acoustic control zone may include a spherical volume and the AAC system may be configured to control, reduce and/or eliminate the acoustic energy and/or wave amplitude of the primary patterns on a surface of the spherical volume.

In another example, the acoustic control zone may include a cubical volume and the AAC system may be configured to control, reduce and/or eliminate the acoustic energy and/or wave amplitude of the primary patterns on a surface of the cubical volume.

In other aspects, the acoustic control zone may include any other suitable volume, which may be defined, for example, based on one or more attributes of a location at which the acoustic control zone is to be maintained.

Reference is now made to FIG. 1, which schematically illustrates an open acoustic headphone device 100, in accordance with some demonstrative aspects.

Figure 2:
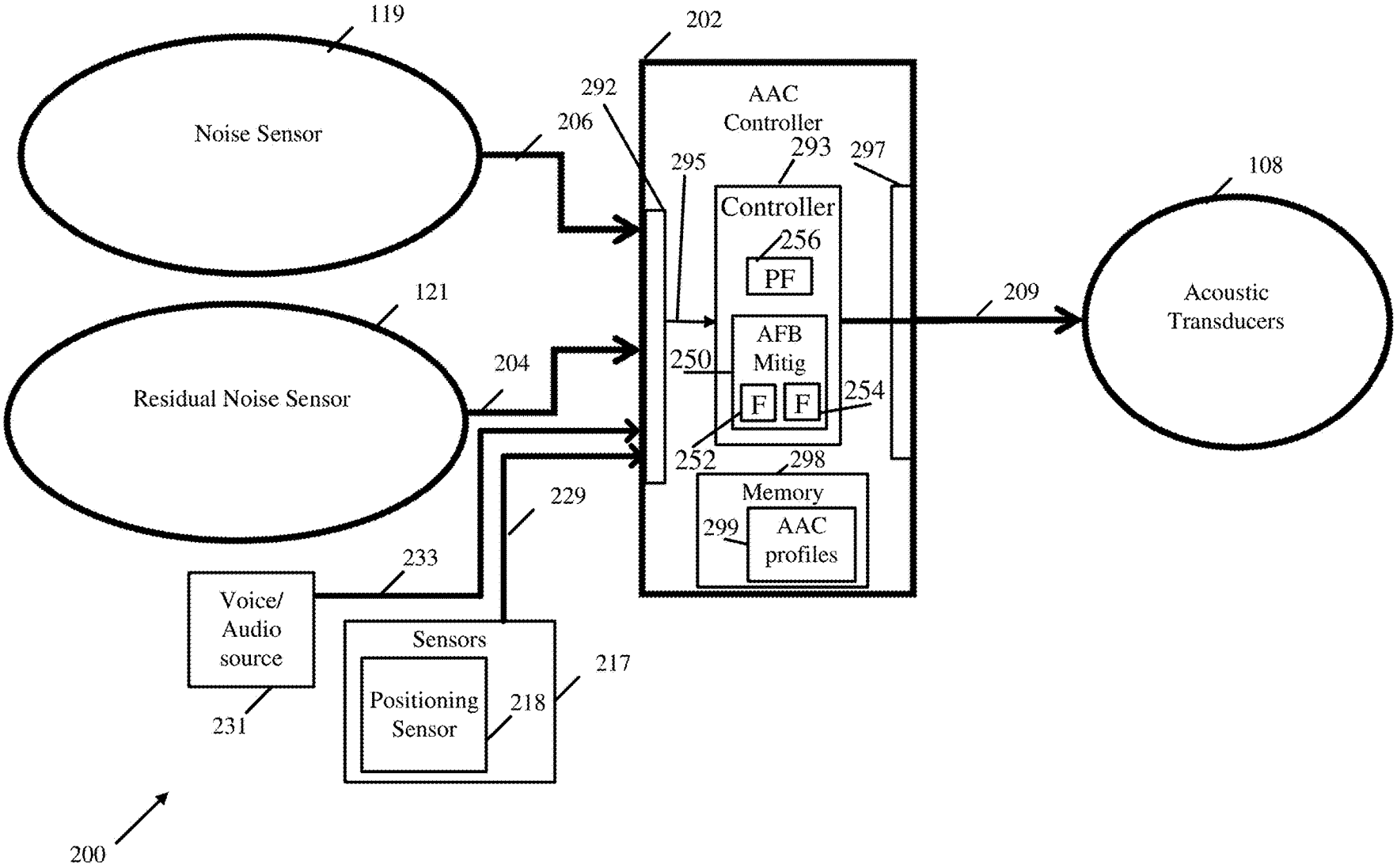
FIG. 2 is a schematic illustration of an AAC system, which may be implemented at the open acoustic headphone device of FIG. 1, in accordance with some demonstrative aspects.

Reference is also made to FIG. 2, which schematically illustrates an AAC system 200, which may be implemented at an open acoustic headphone device, in accordance with some demonstrative aspects. For example, AAC system 200 may be configured for AAC at open acoustic headphone device 100.

In some demonstrative aspects, open acoustic headphone device 100 may include one or more open acoustic headphones, e.g., as described below.

In some demonstrative aspects, open acoustic headphone device 100 may include a first open acoustic headphone 110 and/or a second open acoustic headphone 120.

In some demonstrative aspects, the term "headphone" as used herein may include any suitable apparatus including one or more acoustic transducers, e.g., speakers, which may be placed and/or worn on, around, near, and/or over a user's head and/or ear.

In one example, a headphone may be configured to be worn on the head of the user, for example, such that the acoustic transducers are maintained near the ear of the user.

In one example, a headphone may be implemented in the form of a circumaural headphone (also referred to as "full size headphone", or "over-ear headphone"), which may include pads that surround the outer ear.

In one example, a headphone may be implemented in the form of a supra-aural (on-ear) headphone, which may include a pad that presses against the ear.

In one example, a headphone may be implemented in the form of an ear-fitting headphone, to be worn on an ear of the user.

In one example, a headphone may be implemented in the form of an earphone, which may be placed in or on the outer ear.

In some demonstrative aspects, open acoustic headphone device 100 may include a mounting mechanism configured to mount the open acoustic headphone device 100 on a head and/or an ear of a user, e.g., as described below.

For example, open acoustic headphone device 100 may include frame 101 and/or any other structure configured to mount the open acoustic headphone device 100 on the head of the user, for example, such that the open acoustic headphone 110 and/or the open acoustic headphone 120 are positioned relative to ears of the user.

In one example, open acoustic headphone device 100 may be configured to maintain first open acoustic headphone 110 at a position relative to a first ear 152 of the user, and/or to maintain second open acoustic headphone 120 at a position relative to a second ear 154 of the user, e.g., as described below.

In other aspects (snot shown in FIG. 1), the open acoustic headphone device 100 may include a structure or mechanism configured to maintain the open acoustic headphone on the ear of the user.

In some demonstrative aspects, open acoustic headphone device 100 may include a single open acoustic headphone, e.g., an open acoustic headphone device including the first open acoustic headphone 110 or the second open acoustic headphone 120. For example, open acoustic headphone device 100 may include the single open acoustic headphone on only one side of open acoustic headphone device 100.

In some demonstrative aspects, open acoustic headphone device 100 may include an open acoustic headphone and a closed acoustic headphone. For example, open acoustic headphone device 100 may include an open acoustic headphone, e.g., open acoustic headphone 110, on one side, and a closed acoustic headphone on another side.

In one example, the closed acoustic headphone may be configured to cover the ear of the user, e.g., to completely cover the ear of the user, for example, to acoustically separate the ear of the user from the environment.

In some demonstrative aspects, open acoustic headphone device 100 may include, operate as, and/or perform one or more functionalities of, an AAC system.

In some demonstrative aspects, open acoustic headphone 110 may include at least one acoustic transducer (speaker) 108, at least one noise sensor (reference microphone) 119, and at least one residual-noise sensor (error microphone) 121, e.g., as described below.

In other aspects, open acoustic headphone 110 may include any other additional or attentive elements and/or components.

In some demonstrative aspects, open acoustic headphone 120 may include at least one acoustic transducer 128 (speaker), at least one noise sensor (error microphone) 129, and at least one residual-noise sensor (error microphone) 131, e.g., as described below.

In other aspects, open acoustic headphone 120 may include any other additional or attentive elements and/or components.

In some demonstrative aspects, acoustic transducer 108 and/or acoustic transducer 128 may include a speaker, e.g., as described below. In other aspects, acoustic transducer 108 and/or acoustic transducer 128 may include any other type of acoustic transducer or acoustic actuator, which may be configured to generate an acoustic signal.

In some demonstrative aspects, acoustic sensor 119, acoustic sensor 121, acoustic sensor 129 and/or acoustic sensor 131 may include a microphone, e.g., as described below. In other aspects, acoustic sensor 119, acoustic sensor 121, acoustic sensor 129 and/or acoustic sensor 131 may include any other type of acoustic sensor, which may be configured to sense an acoustic signal.

In some demonstrative aspects, open acoustic headphone device 100 may include a controller 202, which may be configured for AAC at open acoustic headphone 110 and/or open acoustic headphone 120, e.g., as described below.

In some demonstrative aspects, open acoustic headphone device 100 may include a controller 202, which may be configured for commonly performing AAC at both open acoustic headphone 110 and open acoustic headphone 120, e.g., as described below.

In other aspects, open acoustic headphone 110 may include a first controller 202 for AAC at open acoustic headphone 110, and/or open acoustic headphone 120 may include a second controller 202 for AAC at open acoustic headphone 120.

In some demonstrative aspects, open acoustic headphone device 100 may be configured to mount an open acoustic headphone, e.g., open acoustic headphone 110 and/or 120, on the head of the user in a way which may allow acoustic leakage between the environment and the ear of the user, e.g., as described below.

In some demonstrative aspects, open acoustic headphone device 100 may be configured to mount the open acoustic headphone 110 on the head of the user, for example, such that there may be an acoustic leakage (also referred to as an "external leakage") from the environment to the ear of the user. For example, open acoustic headphone device 100 may be configured to mount the open acoustic headphone 110 relative to the ear 152, for example, such that there may be leakage of one or more primary patterns from the environment to the ear 152, e.g., as described below.

In some demonstrative aspects, open acoustic headphone device 100 may be configured to mount the open acoustic headphone 110 on the head of the user, for example, such that there may be an acoustic leakage (also referred to as an "internal leakage") of sound patterns from a speaker, e.g., acoustic transducer 108, to an environment outside the open acoustic headphone. For example, open acoustic headphone device 100 may be configured to mount the open acoustic headphone 110 relative to the ear 152, for example, such that there may be leakage of one or more secondary patterns from the acoustic transducer 108 to the environment, e.g., as described below.

In some demonstrative aspects, open acoustic headphone device 100 may be configured to mount the open acoustic headphone 110 on the head of the user, for example, such that an attenuation of the external leakage into the ear 152 may be equal to or less than a predefined attenuation threshold, e.g., as described below.

In one example, the attenuation level of the external noise may be equal to or less than 10 decibel (dB).

In another example, the attenuation level of the external noise may be equal to or less 5 dB.

In another example, the attenuation level of the external noise may be equal to or less than 3 dB.

In other aspects, any other attenuation threshold may be implemented.

In some demonstrative aspects, open acoustic headphone device 100 may be configured to mount the open acoustic headphone on the head of the user, for example, such that the open acoustic headphone may not fully cover and/or seal the ear of the user. For example, open acoustic headphone device 100 may be configured to maintain open acoustic headphone 110 at a position, which may not fully cover and/or seal the ear 152, and/or to maintain open acoustic headphone 120 at a position, which may not fully cover and/or seal the ear 154.

In one example, open acoustic headphone device 100 may be configured to mount the open acoustic headphone on the head of the user, for example, in a way which may maintain one or more spaces and/or separations between the ears of the user and the open acoustic headphone, e.g., as described below.

In some demonstrative aspects, the open acoustic headphone 110 may include a fully-open acoustic headphone, e.g., as describe below.

In some demonstrative aspects, the fully-open acoustic headphone may include a contactless, and/or a non-blocking, open acoustic headphone. For example, open acoustic headphone device 100 may be configured to mount the fully-open acoustic headphone on the head of the user, for example, such that the fully-open acoustic headphone may not be in contact with the ear of the user, e.g., as describe below.

In some demonstrative aspects, open acoustic headphone device 100 may be configured to mount the fully-open acoustic headphone 110 on the head of the user, for example, such that an entire external surface of the open acoustic headphone may not be in contact with the ear 152, e.g., as describe below.

In some demonstrative aspects, open acoustic headphone device 100 may be configured to mount the open acoustic headphone 110 on the head of the user, for example, in a manner which may maintain a range of at least 3 millimeter (mm) between the ear 152 and a speaker of the open acoustic headphone 110, e.g., acoustic transducer 108, e.g., as described below.

In some demonstrative aspects, open acoustic headphone device 100 may be configured to mount the open acoustic headphone 110 on the head of the user, for example, in a manner which may maintain a range of at least 4 mm between the ear 152 and a speaker of the open acoustic headphone 110, e.g., acoustic transducer 108, e.g., as described below.

In some demonstrative aspects, open acoustic headphone device 100 may be configured to mount the open acoustic headphone 110 on the head of the user, for example, in a manner which may maintain a range of at least 5 mm between the ear 152 and a speaker of the open acoustic headphone 110, e.g., acoustic transducer 108, e.g., as described below.

In some demonstrative aspects, open acoustic headphone device 100 may be configured to mount the open acoustic headphone 110 on the head of the user, for example, in a manner which may maintain a range of at least 7 mm between the ear 152 and a speaker of the open acoustic headphone 110, e.g., acoustic transducer 108, e.g., as described below.

In some demonstrative aspects, open acoustic headphone device 100 may be configured to mount the open acoustic headphone 110 on the head of the user, for example, in a manner which may maintain a range more than 7 mm, or any other range, between the ear 152 and a speaker of the open acoustic headphone 110, e.g., acoustic transducer 108, e.g., as described below.

In some demonstrative aspects, the open acoustic headphone 110 may include a semi-open acoustic headphone (also referred to as a "partially-open acoustic headphone"), e.g., as described below.

In some demonstrative aspects, open acoustic headphone device 100 may be configured to mount the semi-open acoustic headphone 110 on the head of the user, for example, such that the semi-open acoustic headphone may partially cover and/or seal the ear of the user, e.g., as described below.

In other aspects, the semi-open acoustic headphone may be configured to provide any other level of partial coverage of the ear.

In other aspects, open acoustic headphone 110 may include a plurality of acoustic transducers 108, e.g., as described below.

In one example, open acoustic headphone 110 may include a speaker array, e.g., as described below.

Figure 3:
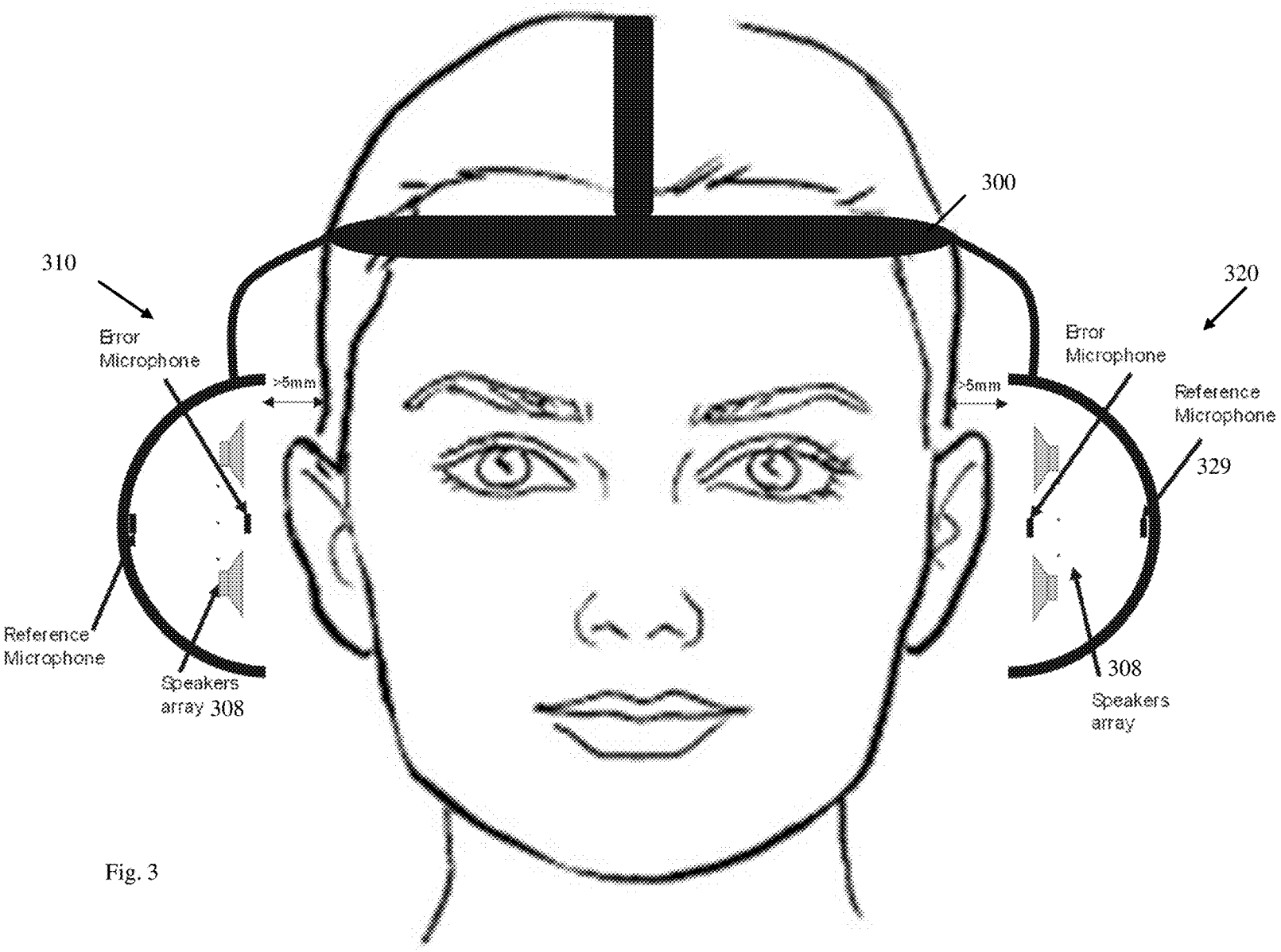
FIG. 3 is a schematic block diagram illustration of an open acoustic headphone device with AAC, in accordance with some demonstrative aspects.

Reference is made to FIG. 3, which schematically illustrate an open acoustic headphone device 300, in accordance with some demonstrative aspects.

In some demonstrative aspects, as shown in FIG. 3, open acoustic headphone device 300 may include a first fully-open acoustic headphone 310 and a second fully-open acoustic headphone 320.

In some demonstrative aspects, as shown in FIG. 3, fully-open acoustic headphone 310 and/or fully-open acoustic headphone 320 may include a speaker array 308.

In one example, as shown in FIG. 3, open acoustic headphone device 300 may be configured to maintain a distance of at least 5 mm, or any other suitable distance, between speaker array 308 of the fully-open acoustic headphones 310 and a first ear of the user, and/or to maintain a distance of at least 5 mm, or any other suitable distance, between speaker array 308 of the fully-open acoustic headphones 320 and a second ear of the user.

Figure 4:
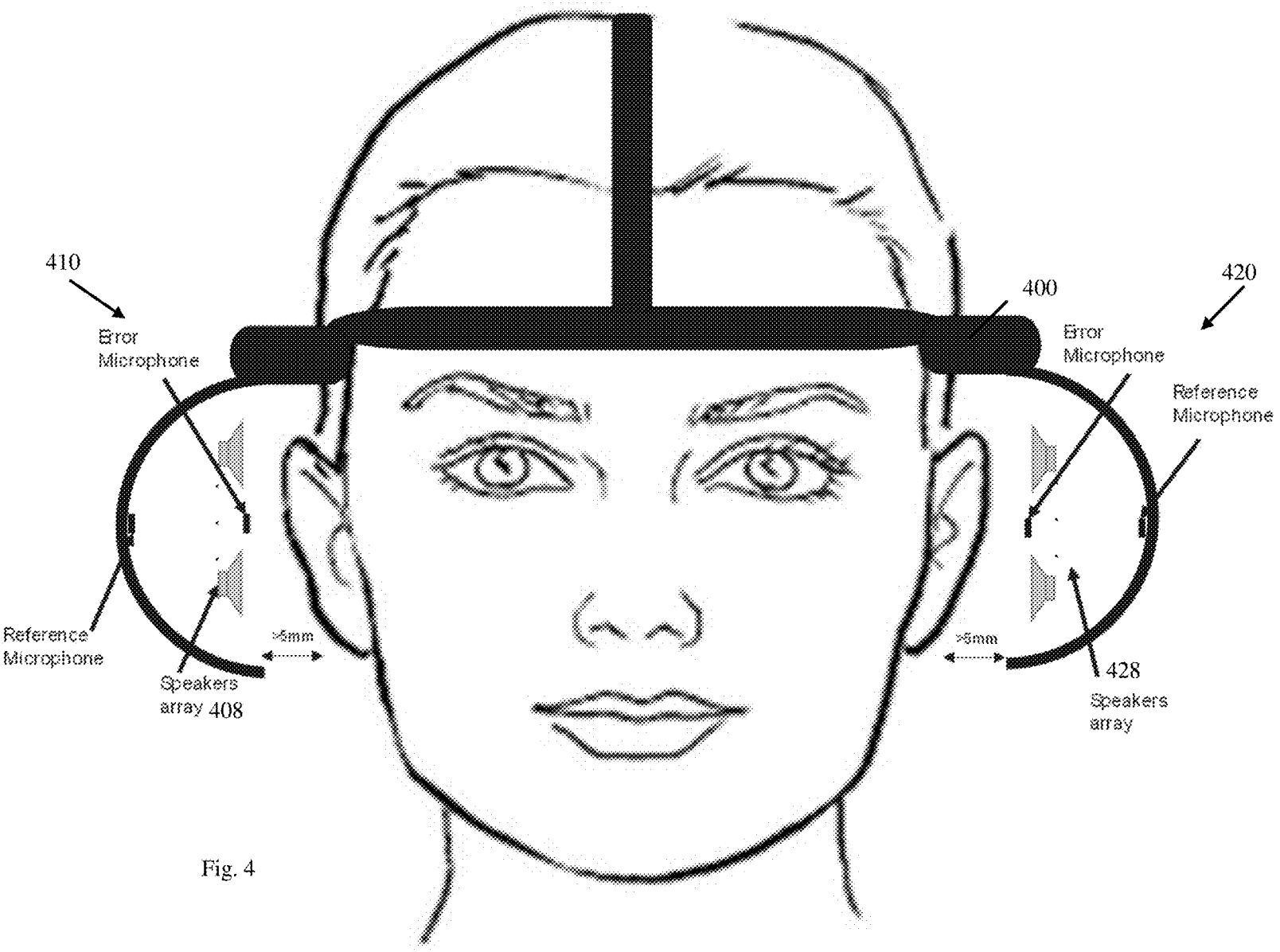
FIG. 4 is a schematic block diagram illustration of an open acoustic headphone device with AAC, in accordance with some demonstrative aspects.

Reference is made to FIG. 4, which schematically illustrate an open acoustic headphone device 400, in accordance with some demonstrative aspects.

In some demonstrative aspects, as shown in FIG. 4, open acoustic headphone device 400 may include a first semi-open acoustic headphone 410, and a second semi-open acoustic headphone 420.

In some demonstrative aspects, as shown in FIG. 4, semi-open acoustic headphone 410 and/or second semi-open acoustic headphone 420 may include a speaker array 408.

In one example, as shown in FIG. 4, open acoustic headphone device 400 may be configured such that semi-open acoustic headphone 410 and/or 420 partially cover the ears of the user.

For example, as shown in FIG. 4, open acoustic headphone device 400 may be configured to maintain a distance of at least 5 mm, or any other suitable distance, between speaker array 408 of the semi-open acoustic headphones 410 and a first ear of the user, and/or to maintain a distance of at least 5 mm, or any other suitable distance, between speaker array 408 of the semi-open acoustic headphones 420 and a second ear of the user.

For example, as shown in FIG. 4, open acoustic headphone device 400 may be configured, such that the semi-open acoustic headphones 410 partially covers the first ear of the user, for example, while maintaining at least one portion, e.g., at the bottom of the first ear, uncovered.

In one example, open acoustic headphone device 400 may be configured to mount the semi-open acoustic headphone 410 on the head of the user such that no more than 90% of the entire external surface of the semi-open acoustic headphone 410 may be in contact with the ear.

In one example, open acoustic headphone device 400 may be configured to mount the semi-open acoustic headphone 410 on the head of the user such that no more than 80% of the entire external surface of the semi-open acoustic headphone 410 may be in contact with the ear.

In one example, open acoustic headphone device 400 may be configured to mount the semi-open acoustic headphone 410 on the head of the user such that no more than 60% of the entire external surface of the semi-open acoustic headphone 410 may be in contact with the ear.

In one example, open acoustic headphone device 400 may be configured to mount the semi-open acoustic headphone 410 on the head of the user such that no more than 50% of the entire external surface of the semi-open acoustic headphone 410 may be in contact with the ear.

For example, as shown in FIG. 4, open acoustic headphone device 400 may be configured, such that the semi-open acoustic headphones 420 partially covers the second ear of the user, for example, while maintaining at least one portion, e.g., at the bottom of the second ear, uncovered.

In one example, open acoustic headphone device 400 may be configured to mount the semi-open acoustic headphone 420 on the head of the user such that no more than 90% of the entire external surface of the semi-open acoustic headphone 420 may be in contact with the ear.

In one example, open acoustic headphone device 400 may be configured to mount the semi-open acoustic headphone 420 on the head of the user such that no more than 80% of the entire external surface of the semi-open acoustic headphone 420 may be in contact with the ear.

In one example, open acoustic headphone device 400 may be configured to mount the semi-open acoustic headphone 420 on the head of the user such that no more than 60% of the entire external surface of the semi-open acoustic headphone 420 may be in contact with the ear.

In one example, open acoustic headphone device 400 may be configured to mount the semi-open acoustic headphone 420 on the head of the user such that no more than 50% of the entire external surface of the semi-open acoustic headphone 420 may be in contact with the ear.

Referring back to FIG. 1, in some demonstrative aspects, the open acoustic headphone device 100 may be configured to enable the user to hear an internal sound from the speaker, e.g., acoustic transducer 108, and to hear an external sound, e.g., from the environment, for example, while reducing external unwanted noise, which may originate from the environment.

In one example, the open acoustic headphone device 100 may be configured to allow a heavy machinery operator to hear inter-communication, e.g., from colleagues, as well as an outer communication, e.g., from colleagues, managers and the like, while reducing noise from the heavy machinery.

In another example, the open acoustic headphone device 100 may be configured to allow warehouse workers, which may work in a noisy warehouse and may collaborate with robots, to hear sounds of the robots, e.g., when driving or talking, and to hear colleagues speaking with them, for example, while reducing a broadband noise level of unwanted sound in the warehouse.

In another example, the open acoustic headphone device 100 may be configured to allow call-center workers, which usually work with a one-ear headset having one ear open, to use a two-ear headphone device, for example, to better understand calls with customers, while being aware to people or sounds around them, e.g., alerts from colleagues, managers, and/or the like.

In another example, the open acoustic headphone device 100 may be configured to allow players, e.g., gamers, casino players, and/or the like, to enjoy audio of a game, for example, and to hear help staff and/or intercom announcements, for example, while reducing environmental noises.

In another example, the open acoustic headphone device 100 may be configured to allow medical teams, e.g., first aid teams, ambulance professionals, doctors, and/or the like, to speak to each other and hear patients and surrounding sound, for example, while reducing noise from the environment.

In another example, the open acoustic headphone device 100 may be configured to support quick put-on and removal, for example, to allow medical teams to switch between the open acoustic headphone device 100 and a stethoscope.

In another example, the open acoustic headphone device 100 may be configured to allow professional drivers and/or professional teams, e.g., emergency drivers and/or teams, which wear a communication one-ear headset to communicate with a command center and/or the like, to be aware of their surroundings, for example, while hearing communication in both ears. For example, when not using both ears, e.g., when using a headset with one ear open, it may be hard to understand how the people or sounds around move. For example, when people around speak or alert, it may be hard to understand where the people are located, e.g., using only one ear.

In another example, the open acoustic headphone device 100 may be configured to support using a stereoscope, for example, for First-aid rescuers and/or teams, which may need to use stethoscopes to diagnose patients at accident sites, with a high level of background noise onsite. For example, the open acoustic headphone device 100 may be configured to allow simple use of the stethoscope for healthcare emergency responders. For example, the open acoustic headphone device 100 may allow accurate diagnosis of patients with the stereoscope, for example, even in a noisy environment, for example, compared to an electronic stethoscope, which is very costly and fragile, and may make it hard to communicate with people around.

In some demonstrative aspects, the open acoustic headphone device 100 may be configured as a "simple" headset, for example, even without any bottoms or switches, e.g., compared to a bulky headset including buttons and switches, which may need to be operated to hear people on the outside.

In some demonstrative aspects, the open acoustic headphone device 100 may be configured to support wireless communication, for example, between the open acoustic headphone devices 110 and/or 120, and one or more audio/communication devices.

In some demonstrative aspects, the open acoustic headphone device 100 may be configured to support a broadband AAC, e.g., as described below.

In one example, the open acoustic headphone device 100 may support AAC in a wide range of frequency bands, e.g., up to frequency of 1000 Hz, or any other frequency bands.

In some demonstrative aspects, the open acoustic headphone device 100 may be configured to support a reduced, e.g., minimal, footprint of electronics in an acoustic volume of the open acoustic headphone device 100. For example, the open acoustic headphone device 100 may be configured to implement broadband open-air AAC, for example, even on a single chip, which may be suitable for power efficient wearable applications.

In some demonstrative aspects, the open acoustic headphone device 100 may be configured to support one or more algorithms for AAC, voice enhancements, stethoscope enhancements, communications, and/or any other additional or alternative audio and/or sound processing algorithms.

In some demonstrative aspects, the open acoustic headphone device 100 may be configured to support intercommunication dialog enhancement, for example, between the user and one or more colleagues. For example, the open acoustic headphone device 100 may be configured to support wireless duplex low latency communications, for example, over Bluetooth links, Intercom links, and/or any other communication links.

In some demonstrative aspects, the open acoustic headphone device 100 may be configured to support open acoustic echo/spillage, for example, to improve the sound experience of the user of open acoustic headphone device 100. For example, the open acoustic headphone device 100 may be configured to support a plurality of acoustic drivers, for example, to manage spillage of an outload content.

In some demonstrative aspects, the open acoustic headphone device 100 may be configured to utilize the AAC for cancelation of unwanted sound, e.g., as described below.

In some demonstrative aspects, the open acoustic headphone device 100 may be configured to utilize one or more Artificial intelligence (AI) algorithms, for example, via a cloud connectivity, for example, for performing one or more AAC-related operations and/or calculations, e.g., as described below.

In some demonstrative aspects, the open acoustic headphone device 100 may be configured to support voice control, for example, even in a noisy environment. For example, the open acoustic headphone device 100 may utilize the one or more AI algorithms, for voice recognition in the noisy environments.

In some demonstrative aspects, the open acoustic headphone device 100 may be configured to support voice control, for example, for controlling one or more applications. For example, the open acoustic headphone device 100 may be compatible with one or more operating systems (OS) of mobile devices, e.g., Smartphones.

In some demonstrative aspects, the open acoustic headphone device 100 may be compatible for mounting on various helmets. For example, the open acoustic headphone device 100 may have a minimal spring pressure, and/or a minimal weight to support an all-day comfort experience of the user. For example, the open acoustic headphone device 100 may be configured to be robust for multiple mounting conditions.

In some demonstrative aspects, the open acoustic headphone device 100 may have a battery pack supporting an increased charge level, for example, to support prolonged operation.

In some demonstrative aspects, the open acoustic headphone device 100 may be configured to support one or more healthcare amalgamation standards.

Referring also to FIG. 2, in some demonstrative aspects, controller 202 may be configured to control an open acoustic headphone, e.g., open acoustic headphone 110 and/or open acoustic headphone 120, for example, in a way that may allow the user to hear the internal sound, e.g., from the speaker, and to hear at least part of the external sound, e.g., from the environment, for example, while reducing external unwanted noise, e.g., as described below.

Some demonstrative aspects are described below with respect to an AAC controller, e.g., AAC controller 202, which may be configured for AAC at open acoustic headphone 110, e.g., by controlling acoustic transducer 108 based on inputs from noise sensor 119 and residual noise sensor 121. In other aspects, AAC controller 202 may be additionally or alternatively configured for AAC at open acoustic headphone 120, e.g., by controlling acoustic transducer 128 based on inputs from noise sensor 129 and residual noise sensor 131.

In one example, controller 202 may include at least one memory 298, e.g., coupled to one or more processors, which may be configured, for example, to store, e.g., at least temporarily, at least some of the information processed by the one or more processors and/or circuitry, and/or which may be configured to store logic to be utilized by the processors and/or circuitry.

In one example, at least part of the functionality of controller 202 may be implemented by an integrated circuit, for example, a chip, e.g., a System on Chip (SoC), In some demonstrative aspects, controller 202 may include, or may be implemented, partially or entirely, by circuitry and/or logic, e.g., one or more processors including circuitry and/or logic, and/or memory circuitry and/or logic. Additionally or alternatively, one or more functionalities of radar controller 202 may be implemented by logic, which may be executed by a machine and/or one or more processors, e.g., as described below.

In other aspects, controller 202 may be implemented by any other logic and/or circuitry, and/or according to any other architecture.

In some demonstrative aspects, controller 202 may be configured to control sound within at least one sound-control zone 130, e.g., as described in detail below.

In some demonstrative aspects, sound control zone 130 may include a three-dimensional (3D) zone. For example, sound control zone 130 may include a spherical zone.

In another example, sound control zone 130 may include any other 3D zone.

In some demonstrative aspects, the predefined sound-control zone 130 may include a space within the ear 152, e.g., as described below.

In some demonstrative aspects, sound control zone 130 may include at least part of a canal of ear 152, for example, at an entry to the canal of the ear 152, e.g., as described below.

In other aspects, the enclosed space may include any other part or area of the ear 152.

In some demonstrative aspects, open acoustic headphone device 100 may be configured to control sound and/or noise within zone 130, for example, to provide an improved sound experience, for example, by controlling sound and/or noise within zone 130 in a way which provide an improved sound and/or audio experience, and/or the like.

In some demonstrative aspects, open acoustic headphone device 100 may be configured to reduce or even cancel an external unwanted noise, while allowing internal and external sounds, e.g., as described below.

In some demonstrative aspects, controller 202 may include, or may be implemented with, an input 292, which may be configured to receive input information 295, e.g., as described below.

In some demonstrative aspects, input 292 may be configured to receive the input information 295 via a wired link or connection, a wireless link or connection, and/or any other communication mechanism, connection, link, bus and/or interface.

In some demonstrative aspects, the input information 295 may include a noise input 206 including noise information corresponding to noise sensor 119 of the open acoustic headphone 110 (also referred to as "primary sensors", "noise sensors" or "reference sensors").

In one example, the noise information corresponding to noise sensor 119 may represent acoustic noise at a location of noise sensor 119, e.g., as described below.

In some demonstrative aspects, the input information 295 may include a residual-noise input 204 including residual-noise information corresponding to residual noise sensor 121 of the open acoustic headphone 110 (also referred to as "error sensors", or "secondary sensors"), e.g., as described below.

In one example, the residual-noise information corresponding to residual noise sensor 121 may represent acoustic noise at a residual-noise sensing location, for example, at a location of residual-noise sensor 121 and/or one or more other residual-noise sensing locations, e.g., as described below.

In some demonstrative aspects, AAC controller 202 may be configured to determine a sound control pattern 209, which may be configured for AAC at the open acoustic headphone 110, e.g., as described below.

In some demonstrative aspects, AAC controller 202 may be configured according to an AAC scheme utilizing one or more noise sensors, e.g., noise sensor 119 (FIG. 1); one or more residual noise sensors, e.g., residual-noise sensor 121

(FIG. 1); and/or one or more acoustic transducers, e.g., a speaker array, for example, speaker array 308 (FIG. 3), e.g., as described below.

In some demonstrative aspects, the AAC scheme may include one or more first acoustic sensors ("primary sensors") to sense the acoustic noise at one or more of a plurality of noise sensing locations.

In some demonstrative aspects, the AAC scheme may include one or more second acoustic sensors ("error sensors") to sense the acoustic residual-noise at one or more of a plurality of residual-noise sensing locations.

In some demonstrative aspects, one or more of the error sensors and/or one or more of the primary sensors may be implemented using one or more "virtual sensors" ("virtual microphones"). A virtual microphone corresponding to a particular microphone location may be implemented by any suitable algorithm and/or method capable of evaluating an acoustic pattern, which would have been sensed by an actual acoustic sensor located at the particular microphone location.

In some demonstrative aspects, AAC controller 202 may be configured to simulate and/or perform the functionality of the virtual microphone, e.g., by estimating and/or evaluating the acoustic noise pattern at the particular location of the virtual microphone.

In some demonstrative aspects, AAC controller 202 may include a controller 293 configured to determine the sound control pattern 209 to control sound at the sound control zone 130, e.g., as described below.

In some demonstrative aspects, AAC controller 202 may include an output 297 to output the sound control pattern 209 to at least one acoustic transducer of the open acoustic headphone 110, e.g., acoustic transducer 108. For example, output 297 may be configured to output the sound control pattern 209 to control acoustic transducer 108, e.g., as described below.

In some demonstrative aspects, controller 293 may be configured to control acoustic transducer 108 to generate an acoustic sound control pattern 209 configured to control the sound at sound control zone 130, e.g., as described in detail below.

In some demonstrative aspects, a mounting of the open acoustic headphone 110 relative to ear 152 may effect a sound experience of the user and/or an effectiveness of the AAC, e.g., as described below.

In one example, different users may place the open acoustic headphone 110 at a different positioning relative to the ear 152, e.g., according to an anatomy of the head and/or ear of the user, according to a convenience of the user, and/or for any other reason.

For example, one user may wear the open acoustic headphone device 100, for example, such that the open acoustic headphone 110 may be at a first distance from the ear 152, e.g., 4 mm, while another user may wear the open acoustic headphone device 100, for example, such that the open acoustic headphone 110 may be at a second distance from the ear 152, e.g., 5 mm.

In another example, one user may wear the open acoustic headphone device 100, for example, such that the speaker 108 of the open acoustic headphone 110 may be tilted at a first angle relative to the ear 152, e.g., 1 degree, while another user may wear the open acoustic headphone device 100, for example, such that the speaker 108 of the open acoustic headphone 110 may be tilted at a second angle relative to the ear 152, e.g., 10 degrees.

In another example, one user, e.g., with long hair, may wear the open acoustic headphone device 100, for example, such that there may be some hair between speaker 108 of the open acoustic headphone 110 and the ear 152, while another user, e.g., with short hair or no hair, may wear the open acoustic headphone device 100, for example, such that the may be little or no hair between the speaker 108 of the open acoustic headphone 110 and the ear 152.

In one example, the mounting of the open acoustic headphone 110 relative to ear 152 may affect a speaker transfer function between acoustic transducer 108 and the ear 152 of the user e.g., as described below.

Figure 5:
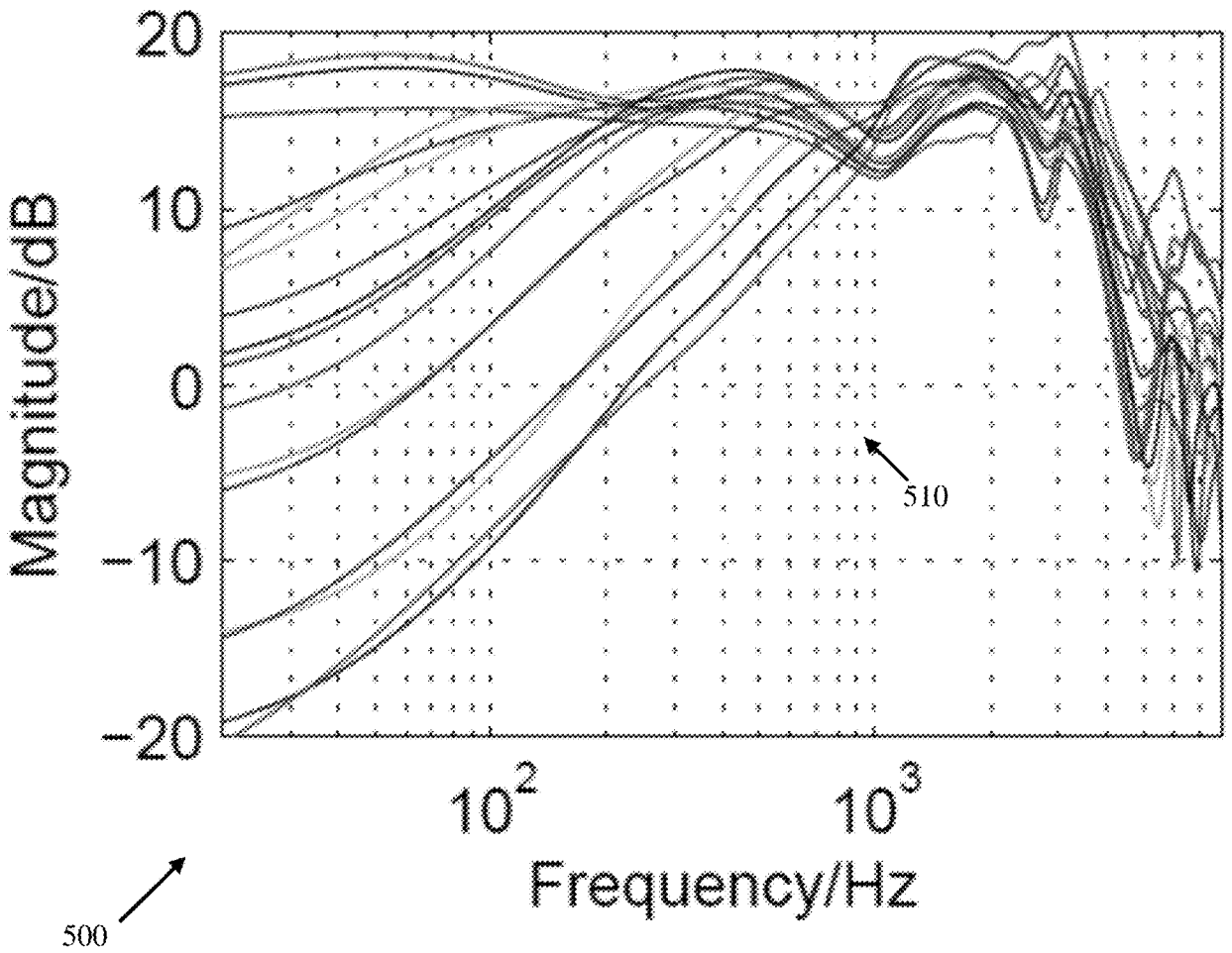
FIG. 5 is a schematic block diagram illustration of a graph depicting a plurality of speaker transfer functions corresponding to a receptive plurality of mounting configurations of a headphone, in accordance with some demonstrative aspects.

Reference is made to FIG. 5, which schematically illustrates a graph 500 depicting a plurality of speaker transfer functions 510 corresponding to a receptive plurality of mounting configurations of a headphone, in accordance with some demonstrative aspects.

In some demonstrative aspects, as shown in FIG. 5, the different mounting configurations may result in speaker transfer functions, which may be significantly different from one another, e.g., at least in a range of frequencies under 1000 Hz, which may be suitable for hearing sounds.

In some demonstrative aspects, as shown in FIG. 5, changes in the mounting configuration, e.g., by the user or by any other reason, may significantly effect an acoustic environment between the headphone and the ear of the user. As a result, the mounting configuration may have an effect, e.g., even a significant effect, on the sound experience of the user and/or an effectiveness of the AAC.

Referring back to FIG. 1 and FIG. 2, in some demonstrative aspects, controller 293 may be configured to determine the sound control pattern 209, for example, based on a mounting of the open acoustic headphone 110 relative to the ear 152 of the user, e.g., as described below.

In some demonstrative aspects, controller 293 may be configured to identify the mounting configuration of the open acoustic headphone 110, for example, based on the input information 295, e.g., as described below.

In some demonstrative aspects, controller 293 may be configured to identify a mounting-based parameter, which is based on the mounting configuration of the open acoustic headphone 110, for example, based on the input information 295, e.g., as described below.

In some demonstrative aspects, the mounting configuration of open acoustic headphone 110 may be based on a mounting of the open acoustic headphone 110 relative to ear 152 of the user, e.g., as described below.

In some demonstrative aspects, controller 293 may be configured to determine the sound control pattern 209, for example, based on the mounting configuration of open acoustic headphone 110, e.g., as described below.

In some demonstrative aspects, controller 293 may be configured to determine the sound control pattern 209, for example, based on the mounting-based parameter of open acoustic headphone 110, e.g., as described below.

In one example, controller 293 may be configured to determine a first sound control pattern based on a first mounting-based parameter, e.g., corresponding to a first mounting configuration representing a first mounting of the open acoustic headphone 110 relative to ear 152 of the user, e.g., as described below.

In some demonstrative aspects, controller 293 may be configured to determine a second sound control pattern, different from the first sound control pattern, based on a second mounting-based parameter, e.g., corresponding to a second mounting configuration representing a second mounting of the open acoustic headphone 110 relative to ear 152 of the user, which is different from the first mounting of the open acoustic headphone 110 relative to ear 152 of the user, e.g., as described below.

In some demonstrative aspects, controller 293 may be configured to dynamically update the sound control pattern 209, for example, based on a change in the mounting-based parameter representing a change in the mounting configuration of the open acoustic headphone 110 relative to ear 152 of the user, e.g., as described below.

For example, controller 293 may be configured to dynamically monitor the mounting-based parameter to detect, e.g., in real time, changes in the mounting configuration of open acoustic headphone 110.

For example, controller 293 may be configured to dynamically update the sound control pattern 209, e.g., in real time, for example, based on detected changes in the mounting-based parameter of open acoustic headphone 110.

In some demonstrative aspects, controller 293 may determine the sound control pattern 209, for example, based on the mounting configuration of open acoustic headphone 110, the residual-noise input 204, and the noise input 204, e.g., as described below.

In some demonstrative aspects, controller 293 may determine the sound control pattern 209, for example, based on the mounting-based parameter of open acoustic headphone 110, the residual-noise input 204, and the noise input 204, e.g., as described below.

In some demonstrative aspects, AAC controller 202 may be configured to generate the sound control pattern 209 based on voice and/or audio signals to be heard by the user of the open acoustic headphone 110, e.g., as described below.

In some demonstrative aspects, the input information 295 may include voice and/or audio signals 233 from a voice/audio source 231.

In one example, voice and/or audio signals 233 may include audio and/or voice signals to be heard by the user of the open acoustic headphone 110, e.g., music, a conversation, a phone call, or the like.

In some demonstrative aspects, controller 293 may be configured to generate the sound control pattern 209 based on the voice and/or audio signals 233, e.g., as described below.

In other aspects, AAC controller 202 may be configured to determine the sound control pattern based 209 on any other additional or alternative factors, criteria, attributes, and/or parameters.

In some demonstrative aspects, controller 293 may be configured to determine the sound control pattern 209, for example, based on the mounting configuration of open acoustic headphone 110, for example, such that the sound control pattern 209 may reduce or eliminate unwanted sound at sound control zone 130, e.g., as described below.

In some demonstrative aspects, controller 293 may be configured to determine the sound control pattern 209, for example, based on the mounting-based parameter, for example, such that the sound control pattern 209 may reduce or eliminate unwanted sound at sound control zone 130, e.g., as described below.

In some demonstrative aspects, controller 293 may be configured to determine the sound control pattern 209, for example, to reduce or eliminate unwanted sound according to at least one noise parameter, e.g., energy, amplitude, phase, frequency, direction, and/or statistical properties at sound control zone 130, e.g., as described in detail below.

In one example, controller 293 may be configured to determine the sound control pattern 209, for example, to selectively reduce one or more predefined first noise patterns at sound control zone 130, while not reducing one or more second noise patterns at sound control zone 130, e.g., as described below.

In some demonstrative aspects, the mounting-based parameter, e.g., corresponding to the mounting configuration of open acoustic headphone 110, may be based, for example, on a position of the open acoustic headphone 110 relative to the ear 152 of the user, e.g., as described below.

In some demonstrative aspects, the mounting-based parameter, e.g., corresponding to the mounting configuration of open acoustic headphone 110, may be based, for example, on a distance between the ear 152 of the user and the acoustic transducer 108, e.g., as described below.

In some demonstrative aspects, the mounting-based parameter, e.g., corresponding to the mounting configuration of open acoustic headphone 110, may be based, for example, on an orientation of the open acoustic headphone 110 relative to the ear 152 of the user, e.g., as described below.

In some demonstrative aspects, the mounting-based parameter, e.g., corresponding to the mounting configuration of open acoustic headphone 110, may be based, for example, on an acoustic environment between the open acoustic headphone 110 and the ear 152 of the user, e.g., as described below.

In other aspects, the mounting-based parameter, e.g., corresponding to the mounting configuration of open acoustic headphone 110, may be based, for example, on any other additional or alternative information, parameters, attributes and/or inputs, e.g., as described below.

In some demonstrative aspects, controller 293 may determine the mounting-based parameter, e.g., corresponding to the mounting configuration of open acoustic headphone 110, for example, based on the residual-noise information, for example, from residual noise sensor 121, e.g., as described below.

In one example, controller 293 may determine the mounting-based parameter, e.g., corresponding to the mounting configuration of open acoustic headphone 110, for example, by comparing a residual noise pattern in the residual noise information to one or more predefined residual noise patterns. For example, the predefined residual noise patterns may correspond to one or more respective predefined mounting configurations of open acoustic headphone 110, e.g., as described below.

In some demonstrative aspects, controller 293 may determine the mounting-based parameter, e.g., corresponding to the mounting configuration of open acoustic headphone 110, for example, based on a calibration acoustic signal, e.g., as described below.

In some demonstrative aspects, controller 293 may be configured to cause the acoustic transducer 108 to generate a calibration acoustic signal, e.g., as described below.

In one example, aspects, controller 293 may be configured to cause the acoustic transducer 108 to generate the calibration acoustic signal, for example, at a setup or calibration of the open acoustic headphone 110, for example, when the user wears the open acoustic headphone 110.

In another example, controller 293 may be configured to cause the acoustic transducer 108 to generate the calibration acoustic signal, for example, in real time, for example, while the user is using the open acoustic headphone 110 to listen to audio. For example, the calibration acoustic signal may be added to audio to be heard by the user, e.g., based on the signal 133.

In some demonstrative aspects, controller 293 may be configured to identify calibration information in the residual-noise information, e.g., in residual-noise input 204, e.g., as described below.

In some demonstrative aspects, the calibration information may be based on the calibration acoustic signal as sensed by the residual noise sensor 121, e.g., as described below.

In some demonstrative aspects, controller 293 may be configured to determine the mounting-based parameter, e.g., corresponding to the mounting configuration of open acoustic headphone 110, for example, based on the calibration information, e.g., as described below.

In some demonstrative aspects, controller 293 may be configured to determine an acoustic transfer function between the acoustic transducer 108 and a residual-noise sensing location, for example, based on the residual-noise information, e.g., as described below.

In some demonstrative aspects, controller 293 may be configured to determine an acoustic transfer function between the acoustic transducer 108 and a residual-noise sensing location of residual noise sensor 121, for example, based on the residual-noise information, e.g., as described below.

In some demonstrative aspects, controller 293 may be configured to determine an acoustic transfer function between the acoustic transducer 108 and a residual-noise sensing location 117 in the ear 152 of the user, e.g., at zone 130, for example, based on the residual-noise information, e.g., as described below.

In some demonstrative aspects, controller 293 may be configured to determine the mounting-based parameter, e.g., corresponding to the mounting configuration of open acoustic headphone 110, for example, based on the acoustic transfer function between the acoustic transducer 108 and the residual-noise sensing location, e.g., as described below.

In some demonstrative aspects, controller 293 may determine the mounting-based parameter, e.g., corresponding to the mounting configuration of open acoustic headphone 110, for example, based on the noise information, for example, from noise sensor 119, e.g., as described below.

In some demonstrative aspects, controller 293 may determine the mounting-based parameter, e.g., corresponding to the mounting configuration of open acoustic headphone 110, for example, based on sensor information, which may be received via a sensor input, e.g., from one or more sensors 217, e.g., as described below.

In some demonstrative aspects, input information 295 may include sensor information 229 from a positioning sensor 218, which may be received for example, via input 292, e.g., as described below.

In some demonstrative aspects, the sensor information 229 may include positioning information corresponding to a positioning of the open acoustic headphone 110 relative to the ear 152, e.g., as described below.

In one example, the positioning sensor 218 may include an electro-optic positioning sensor.

In another example, the positioning sensor 218 may include an acoustic positioning sensor, e.g., to generate the sensor information 229 based on transmission/detection of acoustic signals.

In other aspects, the positioning sensor 217 may include any other type of positioning sensor.

In some demonstrative aspects, controller 293 may determine the mounting-based parameter, e.g., corresponding to the mounting configuration of open acoustic headphone 110, for example, based on a mounting configuration of open acoustic headphone 120, e.g., as described below.

In one example, controller 293 may determine the mounting-based parameter, e.g., corresponding to the mounting configuration of open acoustic headphone 110, for example, based on a predefined a relationship between the position of the open acoustic headphone 120 and the position of the open acoustic headphone 110. For example, controller 293 may determine that the position of the open acoustic headphone 110 has moved in one direction, e.g., upwards, for example, based on a determination that the position of the open acoustic headphone 120 moved in another direction, e.g., downwards.

In other aspects, controller 293 may determine the mounting-based parameter, e.g., corresponding to the mounting configuration of open acoustic headphone 110, for example, based on any other additional or alternative information.

In some demonstrative aspects, controller 293 may be configured to determine the sound control pattern 209, for example, based on an acoustic transfer function between the acoustic transducer 108 and the residual-noise sensor 121, e.g., as described below.

In some demonstrative aspects, controller 293 may be configured to determine the acoustic transfer function between the acoustic transducer 108 and the residual-noise sensor 121, for example, based on the mounting-based parameter, e.g., corresponding to the mounting configuration of open acoustic headphone 110; and to determine the sound control pattern 209, for example, based on the acoustic transfer function between the acoustic transducer 108 and the residual-noise sensor 121, e.g., as described below.

In some demonstrative aspects, controller 293 may be configured to determine the sound control pattern 209, for example, based on an acoustic transfer function between the acoustic transducer 108 and the residual-noise sensing location 117 in the ear 152, e.g., as described below.

In some demonstrative aspects, controller 293 may be configured to determine the acoustic transfer function between the acoustic transducer 108 and the residual-noise sensing location 117 in the ear 152 of the user, for example, based on the mounting-based parameter, e.g., corresponding to the mounting configuration of open acoustic headphone 110; and to determine the sound control pattern 209, for example, based on the acoustic transfer function between the acoustic transducer 108 and the residual-noise sensing location 117 in the ear 152, e.g., as described below.

In some demonstrative aspects, controller 293 may be configured to determine the sound control pattern 209, for example, based on an acoustic field of the acoustic transducer 108, e.g., as described below.

In some demonstrative aspects, controller 293 may be configured to determine a configuration of an acoustic field of the acoustic transducer 108, for example, based on the mounting-based parameter, e.g., corresponding to the mounting configuration of open acoustic headphone 110, e.g., as described below.

In some demonstrative aspects, controller 293 may be configured to determine the sound control pattern 209, for example, based on the configuration of the acoustic field of the acoustic transducer 108, e.g., as described below.

In some demonstrative aspects, controller 293 may be configured to determine the sound control pattern 209, for example, based on virtual residual-noise information, e.g., as described below.

In some demonstrative aspects, the virtual residual-noise information may correspond to a virtual residual-noise sensor, e.g., a virtual microphone, in the ear of the user, for example, at residual-noise sensing location 117, e.g., as described below.

In some demonstrative aspects, controller 293 may be configured to determine the virtual residual-noise information, for example, based on the residual-noise input 204, for example, from residual-noise sensor 121, and the mounting-based parameter, e.g., corresponding to the mounting configuration of open acoustic headphone 110, e.g., as described below.

In some demonstrative aspects, controller 293 may be configured to determine the sound control pattern 209, for example, based on the virtual residual-noise information, e.g., as described below.

In some demonstrative aspects, a residual noise sensor may be implemented using one or more "virtual sensors" ("virtual microphones"). A virtual microphone corresponding to a particular microphone location may be implemented by any suitable algorithm and/or method capable of evaluating an acoustic pattern, which would have been sensed by an actual acoustic sensor located at the particular microphone location, for example, at residual-noise sensing location 117.

In some demonstrative aspects, controller 293 may be configured to simulate the functionality of the virtual microphone, e.g., by estimating and/or evaluating the acoustic noise pattern at the particular location of the virtual microphone.

In one example, the particular location of the virtual microphone may be configured to be in the ear 152, for example, at residual-noise sensing location 117, e.g., at the entrance to the ear canal of ear 152, or in the ear canal of ear 152.

Figure 6:
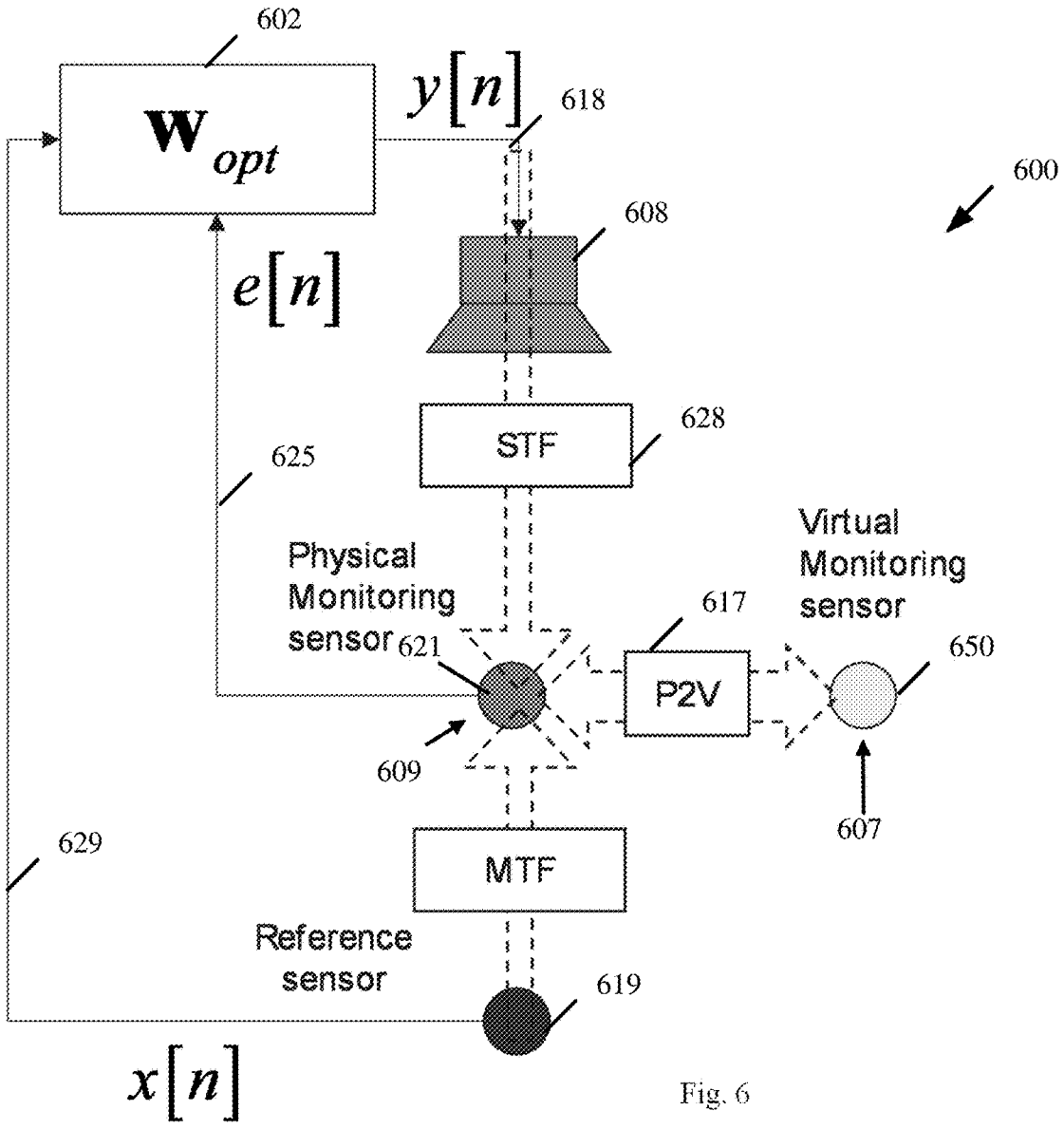
FIG. 6 is a schematic block diagram illustration of an AAC system utilizing a virtual acoustic sensor, in accordance with some demonstrative aspects.

Reference is made to FIG. 6, which schematically illustrates an AAC system 600, which may be configured for implementation at an open acoustic headphone, in accordance with some demonstrative aspects. For example, AAC system 200 (FIG. 2) may include one or more elements of AAC system 600, and/or may perform one or more operations of, and/or one or more functionalities of, AAC system 600.

In some demonstrative aspects, as shown in FIG. 6, AAC system 600 may include a controller 602, an acoustic transducer 608, e.g., a speaker, a noise sensor 619 ("reference sensor"), e.g., a first microphone, and a residual-noise sensor 621 ("Physical Monitoring sensor"), e.g., a second microphone. For example, controller 202 and/or controller 293 (FIG. 2) may include one or more elements of controller 602, and/or may perform one or more operations of, and/or one or more functionalities of, controller 602.

In some demonstrative aspects, controller 602 may be configured to determine virtual residual-noise information corresponding to a virtual residual-noise sensing location 607, for example, based on input from a residual-noise sensor 621.

In some demonstrative aspects, as shown in FIG. 6, AAC controller 602 may be configured to determine virtual residual-noise information representing residual noise, which would have been sensed by a virtual microphone 650 ("Virtual Monitoring sensor") at virtual residual-noise sensing location 607.

In some demonstrative aspects, controller 602 may be configured to determine virtual residual-noise information with respect to virtual residual-noise sensing location 607, for example, in an ear of a user. For example, controller 602 may be configured to determine virtual residual-noise information with respect to virtual microphone 660 located at location 117 (FIG. 1) in the ear 152 (FIG. 1) of the user.

In some demonstrative aspects, as shown in FIG. 6, residual-noise sensor 621 may be located at a location 609. For example, residual-noise sensor 621 may be located at the location of residual-noise sensor 121 (FIG. 1) of the open acoustic headphone 110 (FIG. 1).

In some demonstrative aspects, location 609 may be chosen as a practical location for actual implementation of the residual noise sensor 621, for example, as location 609 may be on or in the open acoustic headphone. However, an optimal location for sensing the actual residual noise to be heard by the user may be within the ear of the user. Accordingly, treating location 609 as the location of the residual noise may result in sub-optimal performance.

In some demonstrative aspects, an implementation of a residual noise acoustic sensor at location 607 may provide optimal performance, e.g., as location 607 is inside the ear of the user. However, in many use cases and products, it may not be practical to implement a residual noise acoustic sensor at location 607, as may be almost impossible to install or to locate a sensor inside the ear of the user, for example, for an open acoustic headphone.

In some demonstrative aspects, controller 602 may be configured to simulate residual noise which may be sensed by the virtual microphone 650 at location 607, e.g., by estimating and/or evaluating the acoustic noise pattern at the particular location 607 of the virtual microphone 650.

In some demonstrative aspects, controller 293 (FIG. 2) may be configured to determine virtual residual-noise information, for example, based on residual-noise information 625, e.g., from residual-noise sensor 621, and a transfer function, e.g., in the form of a Physical to Virtual (P2V) transfer function 617, between the residual-noise sensor 621 at location 609 and the virtual microphone 650 at location 607.

In one example, a sound signal at a "virtual" microphone position, which is projected to the ear, e.g., the sound signal at location 607, may be inferred from a signal of a physical microphone located on the open acoustic headphone, e.g., from signals 625 of residual-noise sensor 621.

In some demonstrative aspects, controller 293 (FIG. 2) may determine the P2V transfer function 617, for example, based on a mounting-based parameter, e.g., corresponding to a mounting configuration of the open acoustic headphone relative to the ear of the, e.g., the mounting-based parameter corresponding to the mounting configuration of open acoustic headphone 110 (FIG. 1).

In some demonstrative aspects, controller 602 may determine a sound control pattern 618 for AAC at the open acoustic headphone 110 (FIG. 1), for example, based on the virtual residual-noise information corresponding to the virtual acoustic sensor 650, reference information 629 from the noise sensor 619, and a Speaker Transfer Function (STF) 628 between speaker 608 and residual-noise sensor 621.

In some demonstrative aspects, controller 602 may output the sound control pattern 618 to speaker 608, for example, for AAC at the open acoustic headphone 110 (FIG. 1).

Referring back to FIGS. 1 and 2, in some demonstrative aspects, controller 293 may be configured to determine a setting of one or more sound control parameters, for example, based on the mounting-based parameter, e.g., corresponding to the mounting configuration of open acoustic headphone 110, e.g., as described below.

In some demonstrative aspects, controller 293 may be configured to determine the sound control pattern 209, for example, based on the setting of the one or more sound control parameters, e.g., as described below.

In some demonstrative aspects, controller 293 may be configured to determine an AAC profile based on the mounting-based parameter, e.g., corresponding to the mounting configuration of open acoustic headphone 110, e.g., as described below.

In some demonstrative aspects, controller 293 may be configured to determine the sound control pattern 209, for example, based on the AAC profile, e.g., as described below.

In some demonstrative aspects, the AAC profile may include a setting of one or more sound control parameters, e.g., as described below.

In one example, aspects, the setting of the one or more sound control parameters may be utilized, for example, in determining the sound control pattern 209.

In some demonstrative aspects, controller 293 may be configured to determine the sound control pattern 209, for example, based on the setting of one or more sound control parameters of the AAC profile, e.g., as described below.

In some demonstrative aspects, AAC controller 202 may include a memory 298 to store a plurality of AAC profiles 299, e.g., as described below.

In some demonstrative aspects, the plurality of AAC profiles 299 may correspond to a plurality of predefined mounting configurations, respectively, e.g., as described below.

In some demonstrative aspects, an AAC profile 299 corresponding to a predefined mounting configuration of the plurality of predefined mounting configurations may include, for example, a setting of one or more sound control parameters corresponding to the predefined mounting configuration, e.g., as described below.

In some demonstrative aspects, controller 293 may be configured to select from the plurality of AAC profiles 299 a selected AAC profile, for example, based on the mounting-based parameter, e.g., corresponding to the mounting configuration of the open acoustic headphone 110, e.g., as described below.

In some demonstrative aspects, controller 293 may be configured to determine the sound control pattern 209, for example, based on the selected AAC profile 299, e.g., as described below.

In one example, a first AAC profile 299 may correspond to a first mounting configuration, for example, a mounting of the open acoustic headphone 110 at a first position relative to the ear 152, e.g., at an upward offset of one or more millimeters from the ear 152. According to this example, the first AAC profile 299 corresponding to the first mounting configuration may include, for example, a first setting of one or more sound control parameters, e.g., which may be configured with respect to the first position relative to the ear.

In another example, a second AAC profile 299 may correspond to a second mounting configuration, for example, a mounting of the open acoustic headphone 110 at a second position relative to the ear 152, e.g., at a downward offset of one or more millimeters from the ear 152. According to this example, the first AAC profile 299 corresponding to the second mounting configuration may include, for example, a second setting of one or more sound control parameters, e.g., which may be configured with respect to the second position relative to the ear.

In some demonstrative aspects, the setting of the one or more sound control parameters may include a setting of one or more path transfer functions to be applied for determining the sound control pattern 209, e.g., as described below.

In some demonstrative aspects, the one or more path transfer functions may include a speaker transfer function corresponding to the acoustic transducer 108, e.g., as described below.

In other aspects, the one or more path transfer functions may include one or more additional ort alternative transfer functions corresponding to one or more other acoustic transducers and/or acoustic sensors of the open acoustic headphone device 100.

In some demonstrative aspects, the setting of the one or more sound control parameters may include a setting of one or more parameters of a prediction filter (PF) 256 to be applied for determining the sound control pattern 209, e.g., as described below.

In some demonstrative aspects, the one or more parameters of the prediction filter 256 may include a prediction filter weight vector of the prediction filter, e.g., as described below.

In some demonstrative aspects, the one or more parameters of the prediction filter 256 may include an update rate parameter for updating the prediction filter weight vector of the prediction filter, e.g., as described below.

In some demonstrative aspects, the prediction filter 256 may include a noise prediction filter to be applied to a prediction filter input, which may be based on the noise input 206, e.g., as described below.

In some demonstrative aspects, the prediction filter 256 may include a residual-noise prediction filter to be applied to a prediction filter input, which may be based on the residual-noise input 204, e.g., as described below.

In some demonstrative aspects, controller 293 may determine sound control signal 209, for example, by applying at least one estimation function and/or prediction function to one or more signals processed by controller 293, e.g., as described below.

In some demonstrative aspects, controller 293 may include the prediction filter 256 (also referred to as a "prediction unit" or an "estimator") configured to apply the estimation or prediction function to information based on noise input 206 and/or residual-noise input 204, e.g., as described below.

In some demonstrative aspects, controller 293 may be configured to configure the PF 256 to utilize one or more prediction parameters, e.g., for the estimation function, for example, based on the mounting-based parameter, e.g., corresponding to the mounting configuration of open acoustic headphone 110, e.g., as described below.

In one example, controller 293 may be configured to determine a first set of prediction parameters for a first mounting configuration of open acoustic headphone 110.

In another example, controller 293 may be configured to determine a second set of prediction parameters for a second mounting configuration of open acoustic headphone 110.

In some demonstrative aspects, controller 293 may be configured to update and/or change the sound control signal 209, for example, based on an identified change of the mounting-based parameter, e.g., corresponding to the mounting configuration of open acoustic headphone 110, e.g., as described below.

For example, controller 293 may be configured to update and/or change the sound control signal 209, for example, based on a detected change of the mounting-based parameter, e.g., corresponding to the mounting configuration of open acoustic headphone 110, for example, when the user changes a positioning of the open acoustic headphone 110 relative to the ear 152, and/or when the mounting configuration changes based on any external cause.

In some demonstrative aspects, controller 293 may determine one or more prediction parameters for a mounting configuration of open acoustic headphone 110, for example, based on a Look Up Table (LUT), e.g., as described below.

In some demonstrative aspects, the LUT may be stored, for example, in memory 298.

In some demonstrative aspects, the LUT may be configured to map a plurality of mounting configurations and a plurality of settings for the prediction parameters.

In one example, the LUT may be configured to match between first prediction parameters and a first mounting configuration, and/or the LUT may match between second prediction parameters, e.g., different from the first prediction parameters, and a second mounting configuration, e.g., different from the first mounting configuration.

In some demonstrative aspects, controller 293 may determine the one or more prediction parameters for the mounting configuration, for example, based on any other additional or alternative algorithm, method, function, and/or procedure.

In some demonstrative aspects, the prediction parameters may include weights, coefficients, functions, and/or any other additional or alternative parameter to be utilized for determining the sound control pattern 209, e.g., as described below.

In some demonstrative aspects, the prediction parameters may include one or more path transfer function parameters of the estimation and/or prediction function, e.g., as described below. In one example, the prediction parameters may include one or more STFs to be applied by controller 293 for determining the sound control pattern 209. For example, an STF may correspond to acoustic paths from acoustic transducer 108 to one or residual sensing locations, e.g., location 609 (FIG. 6), location 607 (FIG. 6) and/or any other location of any other physical and/or virtual acoustic sensor.

In some demonstrative aspects, the prediction parameters may include one or more update rate parameters corresponding to an updating rate of the weighs of the estimation or prediction function, e.g., as described below.

In other aspects, the prediction parameters may include any other additional or alternative parameters.

In some demonstrative aspects, controller 293 may be configured to determine, set, adapt and/or update one or more of the STFs based on changes in the identified mounting-based parameter, e.g., corresponding to the mounting configuration of open acoustic headphone 110, e.g., as described below.

In some demonstrative aspects, controller 293 may be configured to determine, set, adapt and/or update one or more of the prediction parameters based on changes in the identified mounting-based parameter, e.g., corresponding to the mounting configuration of open acoustic headphone 110, e.g., as described below.

In some demonstrative aspects, controller 293 may be configured to extract from the noise input 206 and/or the residual noise input 204 a plurality of disjoint reference acoustic patterns, which are statistically independent.

For example, controller 293 may include an extractor to extract the plurality of disjoint reference acoustic patterns.

The phrase "disjoint acoustic patterns" as used herein may refer to a plurality of acoustic patterns, which are independent with respect to at least one feature and/or attribute, e.g., energy, amplitude, phase, frequency, direction, one or more statistical signal properties, and the like.

In some demonstrative aspects, controller 293 may extract the plurality of disjoint reference acoustic patterns by applying a predefined extraction function to the noise input 206 and/or the residual noise input 204.

In some demonstrative aspects, the extraction of the disjoint acoustic patterns may be used, for example, to model the primary pattern of the noise input 206 and/or the residual noise input 204 as a combination of the predefined number of disjoint acoustic patterns, e.g., corresponding to a respective number of disjoint modeled acoustic sources.

In one example, it may be expected that one or more expected noise patterns, which are expected to affect sound control zone 130, may be generated by unwanted noise from the environment. Accordingly, controller 293 may be configured to select one or more reference acoustic patterns based on one or more attributes of the unwanted noise from the environment.

In some demonstrative aspects, AAC controller 202 may include an Acoustic Feedback (AFB) mitigator 250 (also referred to as "AFB controller", "AFB canceller", Feedback Canceller (FBC)", "Echo mitigator", or "Echo canceller"), which may be configured to mitigate AFB between acoustic transducer 108 and reference noise acoustic sensor 119 of AAC system 200, e.g., as described below.

In some demonstrative aspects, for example, in some use cases, scenarios, deployments, and/or implementations, there may be a need to provide a technical solution to mitigate AFB ("non-constant AFB), which may not be constant.

For example, an acoustic medium between an acoustic transducer of an AAC system, e.g., acoustic transducer 108, and an acoustic sensor of the AAC system, e.g., reference noise sensor 119, may not be fixed or constant.

For example, open headphones, e.g., the open headphones of open acoustic headphone device 100, may be subject to physical AFB. The open headphones may be sensitive to mounting installations, e.g., as described above, which may affect, e.g., in some cases significantly affect, the physical AFB. For example, the physical AFB of open acoustic headphone device 100 may change, e.g., even significantly, from mounting to mounting.

In one example, the acoustic medium between an acoustic transducer of an AAC system, e.g., acoustic transducer 108, and an acoustic sensor of the AAC system, e.g., reference noise sensor 119, may vary, for example, based on changes in an environment of the AAC system, e.g., temperature, humidity, or the like.

In another example, the acoustic medium between an acoustic transducer of an AAC system, e.g., acoustic transducer 108, and an acoustic sensor of the AAC system, e.g., reference noise sensor 119, may vary, for example, based on changes in physical locations of and/or distances between the acoustic transducer and/or the acoustic sensor.

In some demonstrative aspects, for example, in some use cases, scenarios, deployments, and/or implementations, there may be a need to provide a technical solution to implement an adaptive AFB mitigator, for example, to mitigate non-constant AFB. For example, an implementation using a fixed AFB mitigator may not be suitable to provide sufficient results.

In some demonstrative aspects, AFB mitigator 250 may be configured as an adaptive AFB mitigator, e.g., as described below.

In some demonstrative aspects, AFB mitigator 250 may be configured to adapt to changes in an acoustic medium between an acoustic transducer of AAC system 200, e.g., acoustic transducer 108, and an acoustic sensor of the AAC system 200, e.g., reference noise sensor 119, as descried below.

In some demonstrative aspects, AFB mitigator 250 may utilize at least one adaptive filter, which may be configured to adapt to changes in the acoustic medium, e.g., as described below.

In some demonstrative aspects, the adaptive filter may include a Finite Impulse Response (FIR) filter, e.g., as described below.

In one example, a FIR filter having a filter response, denoted h, e.g., h: $\{h_n\}_{n=1}^{N}$, may be applied to an input signal, denoted x, e.g., $x=[x_{n-N}, x_{n-(N-1)}, \ldots, x_n]$, to provide an output ("filtered signal"), denoted y, e.g., as follows:

$$y_n = (x * h)_n = \sum_{k=0}^{N} h_k x_{n-k} \tag{1a}$$

In some demonstrative aspects, the adaptive filter may include an Infinite Impulse Response (IIR) filter, e.g., as described below.

In one example, an IIR filter having a filter function, which is based on coefficients, denoted a and b, may be applied to an input signal, denoted x, e.g., $x=[x_{n-N}, x_{n-(N-1)}, \ldots, x_n]$, to provide an output ("filtered signal"), denoted y, e.g., as follows:

$$y_n=\Sigma_{k=0}^{N} b_k x_{n-k} - \Sigma_{r=1}^{M} a_k y_{n-r}. \tag{1b}$$

In other aspects, any other adaptive filter may be used.

In some demonstrative aspects, AFB mitigator 250 may utilize a Least Mean Squares (LMS) algorithm to adapt one or more parameters of AFB mitigator 250, e.g., as described below.

In some demonstrative aspects, AFB mitigator 250 may adapt one or more parameters of AFB mitigator 250 based on an LMS algorithm, and/or an LMS algorithm variant, e.g., Normalized LMS (NLMS), Leaky LMS, and/or any other LMS-variant.

In other aspects, any other additional or alternative algorithms may be utilized.

In some demonstrative aspects, AFB mitigator 250 may be configured to provide a technical solution to support implementation of an adaptive AFB mitigator utilizing an LMS algorithm and/or an LMS algorithm variant, e.g., NLMS, Leaky LMS, and/or any other LMS-variant, e.g., as described below.

For example, when implementing some LMS algorithms, there may be a requirement that a desired signal at an output of a filter and an input of the filter should be uncorrelated, for example, in order to achieve convergence.

In some demonstrative aspects, there may be a need for a technical solution to support implementation of an ANC system utilizing adaptive FBC, for example, even in case the loudspeaker output and the reference microphone are correlated, e.g., even highly correlated.

In some demonstrative aspects, AFB mitigator 250 may be configured to adapt to changes in an acoustic medium between an acoustic transducer of AAC system 200, e.g., acoustic transducer 108, and an acoustic sensor of the AAC system 200, e.g., reference noise sensor 119, for example, even if the output of acoustic transducer 108 and the input to the reference noise sensor 119 are correlated, e.g., as described below.

In some demonstrative aspects, AFB mitigator 250 may include a first filter 252 configured to generate a first filtered signal, for example, by filtering a first input signal, e.g., as described below.

In some demonstrative aspects, the first input signal may be based on a sound control pattern to be output by the acoustic transducer 108, e.g., as described below.

In some demonstrative aspects, the first filter 252 may be configured to generate the first filtered signal, for example, by filtering the first input signal according to a first filter function, e.g., as described below.

In some demonstrative aspects, AFB mitigator 250 may include a second filter 254 configured to generate a second filtered signal, for example, by filtering the first input signal, for example, according to a second filter function, e.g., as described below.

In some demonstrative aspects, the second filter 254 may include an adaptive filter, e.g., as described below.

In some demonstrative aspects, the second filter 254 may be adapted, for example, based on a difference between an AFB-mitigated signal and the second filtered signal, e.g., as described below.

In some demonstrative aspects, the AFB-mitigated signal may be based on a difference between a second input signal and the first filtered signal, e.g., as described below.

In some demonstrative aspects, the second input signal may be based on acoustic noise sensed by the acoustic sensor 119, e.g., as described below.

In some demonstrative aspects, the first filter 252 may be configured to generate the first filtered signal including a first estimation of the AFB, e.g., between acoustic transducer 108 and reference noise sensor 119, e.g., as described below.

In some demonstrative aspects, the second filter 254 may be configured to generate the second filtered signal including second estimation of the AFB, e.g., between acoustic transducer 108 and reference noise sensor 119, e.g., as described below.

In some demonstrative aspects, the second filter 254 may be configured to generate the second filtered signal based on a change in the AFB, e.g., between acoustic transducer 108 and reference noise sensor 119, e.g., as described below.

In some demonstrative aspects, PF 256 may be configured to generate a PF output, for example, based on a PF input and an acoustic configuration between the acoustic transducer 108 and the sound control zone 130, e.g., as described below.

In some demonstrative aspects, controller 293 may configure the PF 256 based on the mounting-based parameter, e.g., corresponding to the mounting configuration of the open acoustic headphone 110, e.g., as described above.

In some demonstrative aspects, the PF input of PF 256 may be based on the AFB-mitigated signal provided by AFB mitigator 250, e.g., as described below.

In some demonstrative aspects, the sound control pattern 109 may be based on the PF output of PF 256.

In some demonstrative aspects, the sound control pattern 109 may be based on a combination of the PF output of PF 256 and at least one of an audio signal and/or a voice signal, which are to be heard, for example, in the sound control zone 130.

For example, the sound control pattern 109 may be based on a combination of the PF output of PF 256 and the audio and/or voice signal 233.

In some aspects, the sound control pattern 109 may be based directly, or may include only, the PF output of PF 256.

In other aspects, the sound control pattern 109 may be based on any other combination of the PF output of PF 256 with any other audio and/or sound pattern or signal.

In some demonstrative aspects, the second filter 254 may be adapted based on an Least Mean Squares (LMS) algorithm and/or an LMS algorithm variant, e.g., NLMS, Leaky LMS, and/or any other LMS-variant, e.g., as described below.

In other aspects, the second filter 254 may be adapted based on any other additional or alternative algorithm.

In some demonstrative aspects, at least one of the first filter 252 and/or the second filter 254 may include a FIR filter, e.g., as described below.

In some demonstrative aspects, at least one of the first filter 252 and/or the second filter 254 may include an IIR filter, e.g., as described below.

In other aspects, any other type of filter may be utilized.

In some demonstrative aspects, the first filter 252 may include a fixed filter having a fixed filter function, e.g., as described below.

In some demonstrative aspects, the fixed filter function of filter 252 may be based on a predefined acoustic configuration of AAC system 200.

In some demonstrative aspects, the fixed filter function of filter 252 may be based on a predefined acoustic configuration between the acoustic transducer 108 and the acoustic sensor 119, e.g., as described below.

In some demonstrative aspects, AFB mitigator 250 may be configured to support a technical solution enabling the use of a filter, e.g., filter 252, which may be different from a filter, e.g., filter 254, which may be utilized by an adaptation block of the AFB mitigator 250, e.g., as described below.

In some demonstrative aspects, a filter length of filter 252 may be different from a filter length of filter 254.

In one example, the filter length of filter 252 may be longer than the filter length of filter 254.

In another example, the filter length of filter 252 may be shorter than the filter length of filter 254.

In other aspects, filters 252 and 254 may have a same filter length.

In some demonstrative aspects, a filter architecture of filter 252 may be different from a filter architecture of filter 254.

In other aspects, filter 252 and filter 254 may have a same filter architecture.

In some demonstrative aspects, implementing the filter 252 using a fixed filter may provide a technical solution, for example, in terms of reduced memory, processing, and/or complexity. For example, filter adaptation may consume more memory and/or processing resources, e.g., compared to fixed filtering processing.

In some demonstrative aspects, for example, in some implementations, and/or use cases, filter 252 may be configured to utilized a relatively longer fixed filter, e.g., compared to a length of filter 254, for example, to better represent a predefined filter. For example, the fixed filter may be "fine-tuned", for example, using filter 254 configured to have a lower filter order and/or different architecture. For example, this implementation may provide a technical solution to reduce processing and/or memory needs for the adaptation block. Accordingly, this implementation may provide a technical solution to yield improved total system processing and/or memory needs.

In some demonstrative aspects, for example, in some implementations, and/or use cases, filter 252 may be configured to utilized a relatively shirt fixed filter, e.g., compared to a length of filter 254. For example, implementation of a relatively short fixed filter 252 may be suitable for relatively narrow-band ANC systems, e.g., with a band of up to 300 hz, and/or any other suitable AAC implementations. For example, this implementation may provide a technical solution utilizing a relatively short, e.g., low-cost, fixed filter 252. For example, a higher-order or more complex/expensive filter architecture may be utilized for the filter 254 of the adaptation block. In one example, the filter 254 may include a higher order FIR, e.g., compared to short order IIRs and/or second order digital IIRs (biquads).

In some demonstrative aspects, AFB mitigator 250 may be configured to utilize the filters 252 and 254 to provide a technical solution to support estimation of the feedback canceller into two filter stages, e.g., as described below.

In some demonstrative aspects, filter 252 may be implemented using a fixed filter, which may be calibrated and/or pre tuned. e.g., during calibration process, for example, with respect to a predefined acoustic configuration between acoustic transducer 108 and acoustic sensor 119.

In one example, filter 252 may be implemented using an IIR, e.g., with a length in the order of (2-20).

In another example, filter 252 may be implemented using cascaded IIRs, e.g., 1-10 cascaded biquads.

In another example, filter 252 may be implemented using a FIR filter, e.g., with a length in the order of (10-1000).

In other aspects, filter 252 may be implemented using any other filter.

In some demonstrative aspects, filter 254 may be implemented using an adaptive filter configured to continually adapt to changes of the acoustic feedback, e.g., as described below.

In some demonstrative aspects, filter 254 may be implemented using a short adaptive filter, e.g., a short adaptive FIR filter, for example, with a length in the order of (10-100).

In one example, filter 254 may be adapted for a pre define period, e.g., 1-120 seconds or any other period, followed by a freeze of the adaptation.

In other aspects, filter 254 may be implemented using any other adaptive filter.

Figure 7:
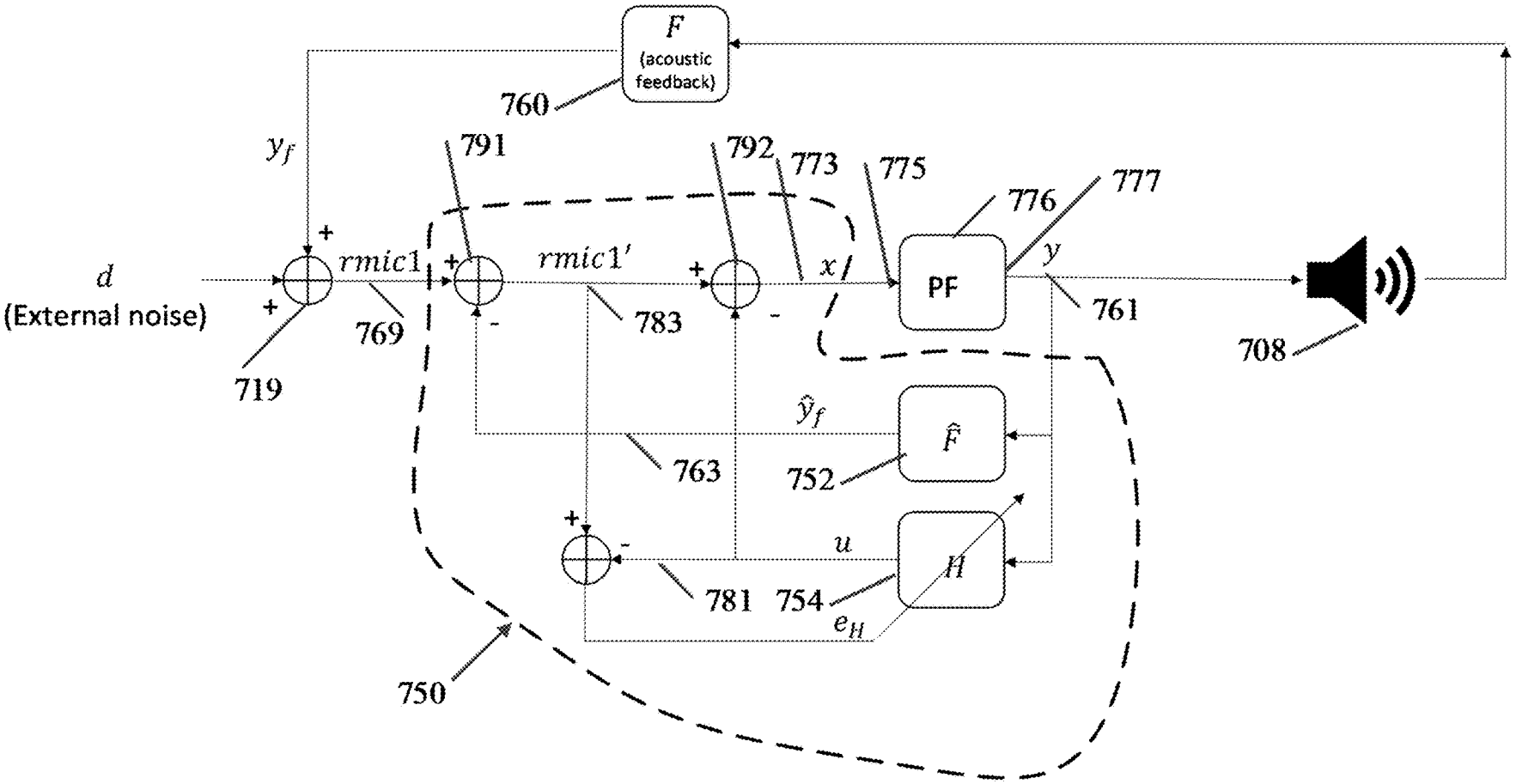
FIG. 7 is a schematic block diagram illustration of an adaptive Acoustic Feedback (AFB) mitigator implemented in an AAC system, in accordance with some demonstrative aspects.

Reference is made to FIG. 7, which schematically illustrates an adaptive AFB mitigator 750 implemented in an AAC system, in accordance with some demonstrative aspects. For example, AFB mitigator 250 (FIG. 1) may include one or more elements of, and/or perform one or more functionalities of, adaptive AFB mitigator 750.

In some demonstrative aspects, AFB mitigator 750 may be configured to mitigate acoustic feedback 760 between an acoustic transducer 708 and an acoustic sensor 719 in the AAC system, e.g., as described below.

In some demonstrative aspects, AFB mitigator 750 may include a first filter 752 configured to generate a first filtered signal 763 by filtering a first input signal 761 according to a first filter function, e.g., as described below.

In some demonstrative aspects, the first input signal 761 may be based on a sound control pattern to be output by the acoustic transducer 708.

In some demonstrative aspects, the AAC system may include a PF 776, which may be configured to generate a PF output 777 based on a PF input 775, and an acoustic configuration between the acoustic transducer 708 and an acoustic control zone of the AAC system, e.g., acoustic control zone 130 (FIG. 1).

In some demonstrative aspects, the sound control pattern to be output by the acoustic transducer 708 may be based on the PF output 777.

In some demonstrative aspects, the first input signal 761 may be based on the PF output 777.

In some demonstrative aspects, the first input signal 761 may include the PF output 777, e.g., as described below.

In other aspects, the first input signal 761 may be based on the PF output 777 and one or more audio and/or voice signals, the e.g., as described below.

In one example, the first input signal 761 may be based on a combination, e.g., a summation and/or any other combination, of the PF output 777 and one or more audio and/or voice signals 233 (FIG. 2).

In some demonstrative aspects, AFB mitigator 750 may include a second filter 754 configured to generate a second filtered signal 781, for example, by filtering the first input signal 761, for example, according to a second filter function, e.g., as described below.

In some demonstrative aspects, the second filter 754 may include an adaptive filter, e.g., as described below.

In some demonstrative aspects, the second filter 754 may be adapted, for example, based on a difference between an AFB-mitigated signal 783 and the second filtered signal 781, e.g., as described below.

In some demonstrative aspects, the AFB-mitigated signal 783 may be based on a difference between a second input signal 769 and the first filtered signal 763, e.g., as described below.

In some demonstrative aspects, the second input signal 769 may be based on acoustic noise sensed by the acoustic sensor 719, e.g., as described below.

In some demonstrative aspects, the first filter 752 may be configured to generate the first filtered signal 763 including a first estimation of the AFB 760, e.g., between acoustic transducer 708 and reference noise sensor 719, e.g., as described below.

In some demonstrative aspects, the second filter 754 may be configured to generate the second filtered signal 781 including a second estimation of the AFB 760, e.g., between acoustic transducer 708 and reference noise sensor 719, e.g., as described below.

In some demonstrative aspects, the second filter 754 may be configured to generate the second filtered signal 781 based on a change in the AFB 760, e.g., between acoustic transducer 708 and reference noise sensor 719, e.g., as described below.

In some demonstrative aspects, the first filter 752 may include a fixed filter having a fixed filter function, e.g., as described below.

In some demonstrative aspects, the first filter 752 may include a fixed IIR filter, e.g., as described below.

In other aspects, the first filter 752 may include a fixed FIR filter, or any other type of fixed filter.

In some demonstrative aspects, the fixed filter function of filter 752 may be based, for example, on a predefined acoustic configuration of an AAC system, e.g., AAC system 200 (FIG. 2), including the acoustic transducer 708 and the acoustic sensor 719.

In some demonstrative aspects, the fixed filter function of filter 752 may be based, for example, on a predefined acoustic configuration between the acoustic transducer 708 and the acoustic sensor 719.

In some demonstrative aspects, AFB mitigator 750 may include a first subtractor 791 to generate a first AFB-mitigated signal 783 by subtracting the first filtered signal 763 from the second input signal 769.

In some demonstrative aspects, AFB mitigator 750 may include a second subtractor 792 to generate a second AFB-mitigated signal 773 by subtracting the second filtered signal 781 from the first AFB-mitigated signal 783.

In some demonstrative aspects, the second filter 754 may be adapted based on a difference between the first AFB-mitigated signal 783 and the second filtered signal 781.

In some demonstrative aspects, the PF input 775 may be based on the second AFB-mitigated signal 773.

In some demonstrative aspects, the second filter 754 may be implemented by a short adaptive FIR filter, e.g., as described below.

In other aspects, the second filter 754 may include any other adaptive FIR filter, an adaptive IIR filter, and/or any other adaptive filter.

In some demonstrative aspects, a reference signal ("microphone data signal") picked up by the reference microphone 719, denoted rmic1, may be determined by:

$$rmic1[n]=d[n]+y_f[n] \tag{2}$$

wherein d denotes an external noise to be controlled by the AAC system, and wherein:

$$y_f[n]=F*y[n] \tag{3}$$

wherein $y_f[n]$ denotes a feedback component, which is fed-back from the acoustic transducer 708 to the reference microphone 719 via the feedback acoustic medium, denoted F, wherein y denotes the sound control pattern ("anti-noise signal" or "cancelling signal") output by the acoustic transducer 718, and denotes linear convolution.

In some demonstrative aspects, a response, e.g., a desired response, for the adaptive filter 754, denoted H, may be determined as:

$$rmic1'[n]=d[n]+y_f[n]-\hat{y}_f[n] \tag{4}$$

wherein $\hat{y}_f$ denotes an estimate of an "initial" feedback due to the signal y, as may be obtained through the fixed filter 752, denoted $\hat{F}$,
wherein:

$$\hat{y}_f[n]=\hat{F}^T y_{L_f}[n] \tag{5}$$

wherein $\hat{F}=[\hat{F}_0, \hat{F}_1, \ldots, \hat{F}_{L_f}]^T$ denotes an impulse response of the filter $\hat{F}$, $L_f$ denotes the length of the filter $\hat{F}$, and wherein $y_{L_f}[n]=[y[n-1], y[n-2], \ldots, y[n-L_f]]^T$ denotes an $L_f$-sample speaker output, which is the input signal vector to the filter $\hat{F}$ (input signal 761).

According to the above definitions and notations, a residual error signal, denoted $e_H[n]$, may be determined, e.g., as follows:

$$e_H[n]=d[n]+y_f[n]-\hat{y}_f[n]-u[n] \tag{6}$$

wherein $u[n]=H[n]^T y_{L_h}[n]$, wherein $H[n]=[H_0[n], H_1[n], \ldots, H_{L_h}[n]]^T$ denotes an impulse response of the filter H, $L_h$ denotes a length of the H, and $y_{L_h}[n]=[y[n-1], y[n-2], \ldots, y[n-L_h]]^T$ denotes an $L_h$-sample speaker output, which is the input signal vector to the filter H (input signal 761).

In some demonstrative aspects, coefficients of the adaptive filter H may be adapted according to an LMS algorithm and/or an LMS algorithm variant, e.g., NLMS, Leaky LMS, and/or any other LMS-variant, e.g., as described below. In other aspects, any other algorithm may be used.

In some demonstrative aspects, coefficients of the adaptive filter H may be adapted according to the LMS algorithm, e.g., as follows:

$$H[n+1]=H[n]+\mu_h e_H[n] y_{L_h}[n] \tag{7}$$

wherein $\mu_h$ is step size parameter for the adaptive filter H.

In some demonstrative aspects, the signal 773, denoted x, at the PF input 775 of PF 776 may be determined, e.g., as follows:

$$x[n]=d[n]+y_f[n]-\hat{y}_f[n]-u[n] \tag{8}$$

In some demonstrative aspects, when the adaptive filter H converges then, for example, $x[n]\approx d[n]$ and, accordingly, the signal x is substantially free of any acoustic feedback component of the canceling signal y.

Referring back to FIG. 2, in some demonstrative aspects, AFB mitigator 250 may be configured to support a technical solution implementing a signal (also referred to as a "virtual signal"), e.g., a predefined or preconfigured signal, which may be internally generated by the AAC system 200, e.g., as described below.

In some demonstrative aspects, AFB mitigator 250 may be configured to support a technical solution utilizing the virtual signal in the process of adaptation of the adaptive filter 254, e.g., as described below.

In some demonstrative aspects, there may be one or more technical issues and/or disadvantages in adding a white noise signal to a speaker output, and using the white noise signal to adapt the AFB mitigator. For example, there may be one or more technical issues and/or disadvantages in injecting white noise into the output of an ANC system, for example, since it may not be desirable to add noise to be heard by the user. This would be in contrast to a concept of emitting from the speakers of an AAC system an output that is based on anti-phase noise to reduce unwanted noises. For example, if noise is added to the output of the speaker in order to adapt the feedback canceller in real time, a user may typically hear that added noise performance of the AAC system may enhance noise at the ears of the user, e.g., instead of reducing the heard noise at the ear positions. This added noise may also result in reduced ANC performance, e.g., instead of enhancing the heard noise.

In some demonstrative aspects, AFB mitigator 250 may be configured to support a technical solution using an internally generated signal for enhancing performance of the AFB mitigator, for example, even without adding a white noise signal to the loudspeaker output which can be heard by the user, e.g., as described below.

In some demonstrative aspects, AFB mitigator 250 may be configured to support a technical solution using an internally generated signal for enhancing performance of the AFB mitigator, for example, while avoiding a technical problem associated with "playing" the white noise.

In some demonstrative aspects, AFB mitigator 250 may be adapted based on an internally generated virtual signal, e.g., as described below.

In some demonstrative aspects, the virtual signal may be used as an additional input to the adaptation block of AFB 250, e.g., as described below.

In some demonstrative aspects, an estimation of the convolution of the virtual signal with the AFB may be added to the signal from the reference microphone 119, e.g., as described below.

In some demonstrative aspects, the internally generated virtual signal may be configured as a noise signal, e.g., a white noise signal, or a pink noise signal. In one example, the internally generated virtual signal may be configured as noise signal with one or more predefined frequency ranges and spectrum, e.g., 100 hz and above, 200-1000 hz, and/or any other range to be used to further optimize the adaptation of the feedback canceller.

In other aspects, the internally generated virtual signal may be configured as any other predefined signal according to any other parameters and/or criteria.

In some demonstrative aspects, the first filter 252 may include an adaptive filter, e.g., as described below.

In some demonstrative aspects, the virtual signal may be utilized to adapt the first filter 252, e.g., as described below.

In some demonstrative aspects, coefficients of the filter 252 may be adapted based on with the predefined internally generated virtual signal, e.g., as described below.

In some demonstrative aspects, the virtual signal may be configured to provide a technical solution to support further optimizing of the AFB mitigator 250, for example, with one or more frequency bands, e.g., on top of the adaptation of the filter 254.

For example, the virtual signal may support further optimization of the AFB mitigator 250, for example, in case where the sound control pattern 109, e.g., the signal y, which is used as the input to the filter 252 and/or filter 254, does not have and/or cover all the frequency ranges and/or enough signal energy at those frequencies to reduce all the acoustic feedback heard by the microphones from the speaker/s.

Figure 8:
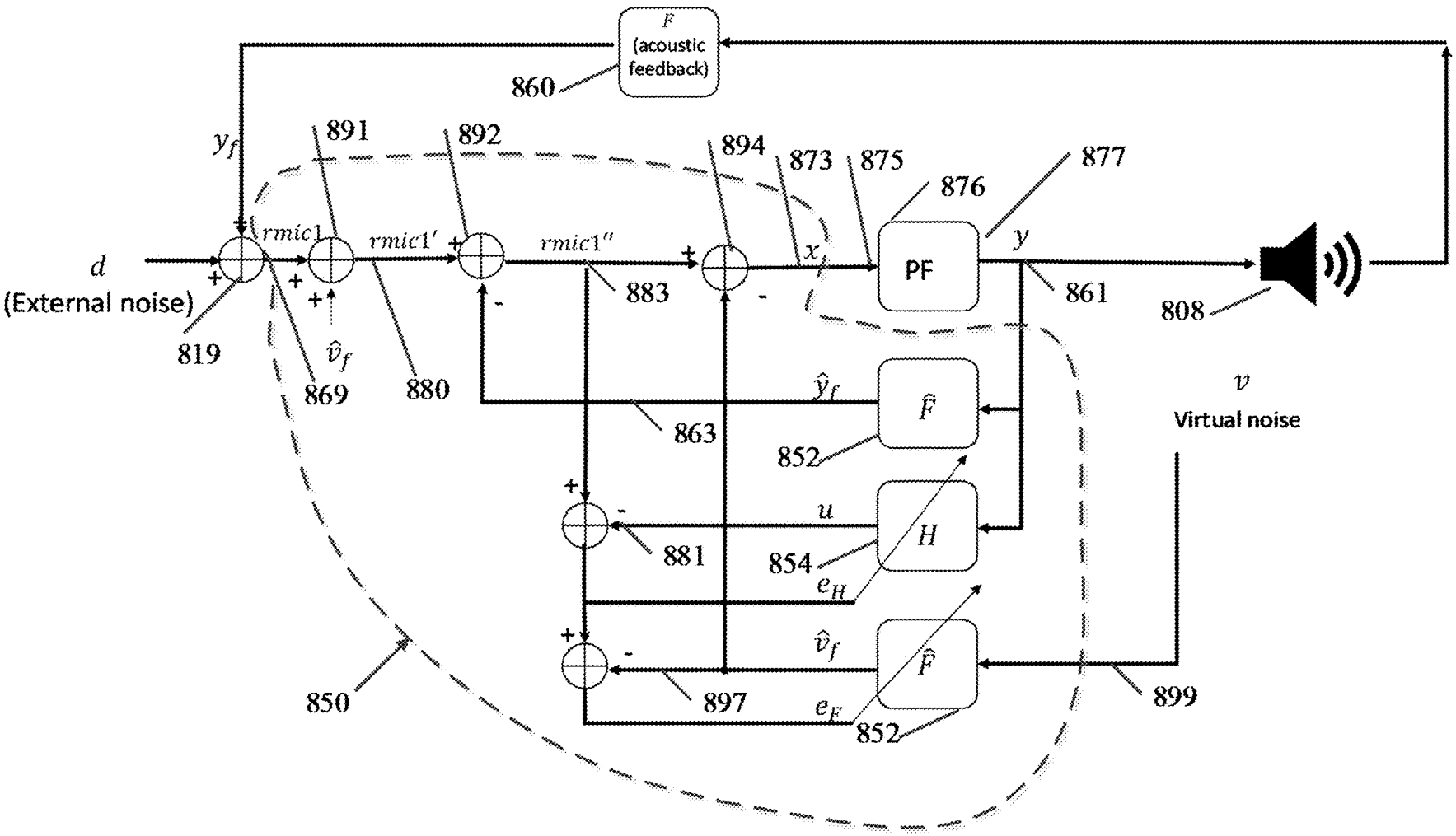
FIG. 8 is a schematic block diagram illustration of an adaptive AFB mitigator implemented in an AAC system, in accordance with some demonstrative aspects.

Reference is made to FIG. 8, which schematically illustrates an adaptive AFB mitigator 850 implemented in an AAC system, in accordance with some demonstrative aspects. For example, AFB mitigator 250 (FIG. 1) may include one or more elements of, and/or perform one or more functionalities of, adaptive AFB mitigator 850.

In some demonstrative aspects, AFB mitigator 850 may be configured to mitigate acoustic feedback 860 between an acoustic transducer 808 and an acoustic sensor 819 in the AAC system, e.g., as described below.

In some demonstrative aspects, AFB mitigator 850 may include a first filter 852 configured to generate a first filtered signal 863 by filtering a first input signal 861 according to a first filter function, e.g., as described below.

In some demonstrative aspects, the first input signal 861 may be based on a sound control pattern to be output by the acoustic transducer 808.

In some demonstrative aspects, the AAC system may include a PF 876, which may be configured to generate a PF output 877 based on a PF input 875, and an acoustic configuration between the acoustic transducer 808 and a sound controlled zone of the AAC system, e.g., sound controlled zone 130 (FIG. 1).

In some demonstrative aspects, the sound control pattern to be output by the acoustic transducer 808 may be based on the PF output 877.

In some demonstrative aspects, the first input signal 861 may be based on the PF output 877.

In some demonstrative aspects, the first input signal 861 may include the PF output 877, e.g., as described below.

In other aspects, the first input signal 861 may be based on the PF output 877 and one or more audio and/or voice signals, for example, audio and/or voice signals to be heard in the sound control zone of the AAC system.

In one example, the first input signal 861 may be based on a combination, e.g., a summation and/or any other combination, of the PF output 877 and one or more audio and/or voice signals 233 (FIG. 2).

In some demonstrative aspects, AFB mitigator 850 may include a second filter 854 configured to generate a second filtered signal 881, for example, by filtering the first input signal 861, for example, according to a second filter function, e.g., as described below.

In some demonstrative aspects, the second filter 854 may include an adaptive filter, e.g., as described below.

In some demonstrative aspects, the second filter 854 may be adapted, for example, based on a difference between an AFB-mitigated signal 883 and the second filtered signal 881, e.g., as described below.

In some demonstrative aspects, the AFB-mitigated signal 883 may be based on a difference between a second input signal 869 and the first filtered signal 863, e.g., as described below.

In some demonstrative aspects, the second input signal 869 may be based on acoustic noise sensed by the acoustic sensor 819, e.g., as described below.

In some demonstrative aspects, the first filter 852 may be configured to generate the first filtered signal 863 including a first estimation of the AFB 860, e.g., between acoustic transducer 808 and reference noise sensor 819, e.g., as described below.

In some demonstrative aspects, the second filter 854 may be configured to generate the second filtered signal 881 including a second estimation of the AFB 860, e.g., between acoustic transducer 808 and reference noise sensor 819, e.g., as described below.

In some demonstrative aspects, the second filter 854 may be configured to generate the second filtered signal 881 based on a change in the AFB 860, e.g., between acoustic transducer 808 and reference noise sensor 819, e.g., as described below.

In some demonstrative aspects, the first filter 852 may include an adaptive filter, which may be adapted based on a predefined (virtual) signal 899, e.g., as described below.

In some demonstrative aspects, the predefined signal 899 may include a virtual signal, which may be internally generated, e.g., by the AFB mitigator 850 and/or by any other element of the AAC system utilizing the AFB mitigator 850.

In some demonstrative aspects, the predefined signal 899 may include a virtual noise signal.

In some demonstrative aspects, the predefined signal 899 may include a virtual white noise signal.

In some demonstrative aspects, the predefined signal 899 may include a virtual pink noise signal.

In some demonstrative aspects, a frequency spectrum of the predefined signal 899 may be different from a frequency spectrum of the first input signal 861.

In other aspects, the predefined signal 899 may include any other type of predefined signal.

In some demonstrative aspects, the first filter 852 may be adapted, for example, based on a subtraction of a filtered predefined signal 897 from the difference between the AFB-mitigated signal 883 and the second filtered signal 881. For example, as shown in FIG. 8, the filtered predefined signal 897 may include the predefined signal 899 filtered by the first filter 852.

In some demonstrative aspects, AFB mitigator 850 may include an adder 891 to generate a modified sensor signal 880, for example, by adding the filtered predefined signal 897 to the second input signal 869.

In some demonstrative aspects, AFB mitigator 850 may include a first subtractor 892 to generate a first AFB-mitigated signal 883 by subtracting the first filtered signal 863 from the modified sensor signal 880. For example. As shown in FIG. 8, the second filter 854 may be adapted based on a difference between the first AFB-mitigated signal 883 and the second filtered signal 881.

In some demonstrative aspects, AFB mitigator 850 may include a second subtractor 894 to generate a second AFB-mitigated signal 873 by subtracting the filtered predefined signal 897 from the first AFB-mitigated signal 883.

In some demonstrative aspects, the PF input 875 may be based on the second AFB-mitigated signal 873.

In some demonstrative aspects, a reference signal ("microphone data signal") picked up by the reference microphone 819, denoted rmic1, may be determined by Equations 2 and 3.

In some demonstrative aspects, the adaptive filter 852, denoted F, may be configured to estimate the AFB 860 affecting the speaker output, denoted y (e.g., the anti-noise signal).

In some demonstrative aspects, the modified sensor signal 880, denoted rmic1'[n], may be determined, for example, by adding $\hat{v}_f[n]$ to rmic1[n], wherein $\hat{v}_f[n]=\hat{F}[n]^T v_{L_f}[n]$, $\hat{F}[n]=[\hat{F}_0[n], \hat{F}_1[n], \ldots, \hat{F}_{L_f}[n]]^T$ denotes the impulse response of the filter $\hat{F}[n]$, $L_f$ is length of the filter $\hat{F}$, and $v_{L_f}[n]=[v[n-1], v[n-2], \ldots, v[n-L_f]]^T$ is the $L_f$-sample predefined (e.g., white noise) signal vector 899, which is the input signal vector to the filter $\hat{F}$ (signal 899).

In some demonstrative aspects, the adaptive filter 854, denoted H, may be configured to mitigate a disturbance from the desired response of the acoustic feedback.

In some demonstrative aspects, a response, e.g., a desired response, for the adaptive H, may be determined, e.g., as follows:

$$rmic1''[n]=d[n]+y_f[n]+\hat{v}_f[n]-\hat{y}_f[n] \tag{9}$$

wherein $\hat{y}_f$ denotes an estimate of the feedback due, for example, to the anti-noise signal y, obtained through the filter $\hat{F}[n]$. For example, $\hat{y}_f$ may be determined as follows:

$$\hat{y}_f[n]=\hat{F}[n]^T y_{L_f}[n] \tag{10}$$

wherein $y_{L_f}[n]=[y[n-1], y[n-2], \ldots, y[n-L_f]]^T$ denotes an $L_f$-sample speaker output, which is the input signal vector to the filter $\hat{F}$ (input signal 861).

In some demonstrative aspects, a residual error signal, denoted $e_H[n]$, may be determined, e.g., as follows:

$$e_H[n]=d[n]+y_f[n]+\hat{v}_f[n]-\hat{y}_f[n]-u[n] \tag{11}$$

wherein u[n] denotes an output of the filter H (signal 881).

For example, the signal 881 may be determined, e.g., as follows:

$$u[n]=H[n]^T y_{L_h}[n] \tag{12}$$

wherein $H[n]=[H_0[n], H_1[n], \ldots, H_{L_h}[n]]^T$ denotes the impulse response of H[n], $L_h$ denotes the length of H, and $y_{L_h}[n]=[y[n-1], y[n-2], \ldots, y[n-L_h]]^T$ denotes an $L_h$-sample speaker output, which is the input signal vector to the filter H (input signal 861).

In some demonstrative aspects, coefficients of the filter H may be updated, for example, using an LMS algorithm and/or an LMS algorithm variant, e.g., NLMS, Leaky LMS, and/or any other LMS-variant, e.g., as described below. In other aspects, any other suitable algorithm may be used.

In some demonstrative aspects, coefficients of the filter H may be updated, for example, using the LMS algorithm, e.g., as follows:

$$H[n+1]=H[n]+\mu_h e_H[n] y_{L_h}[n] \tag{13}$$

wherein $\mu_h$ denotes step size parameter for the filter H.

In some demonstrative aspects, the adaptive filter $\hat{F}$ may be excited by the predefined signal 899, denoted v[n], e.g., random (white) noise or any other predefined signal, to generate the filtered predefined signal 897, denoted $\hat{v}_f[n]$.

In some demonstrative aspects, as shown in FIG. 8, the error signal of the adaptive filter H, e.g., the difference between the signal 883 and the signal 881, may be used as a desired response for the adaptive filter $\hat{F}$.

For example, coefficients of the adaptive filter $\hat{F}$ may be updated according to an LMS algorithm, e.g., as follows:

$$\hat{F}[n+1]=\hat{F}[n]+\mu_f(d[n]+y_f[n]+\hat{v}_f[n]-\hat{y}_f[n]-u[n]-\hat{v}_f[n])v_{L_f}[n]=\hat{F}[n]+\mu_f(d[n]+y_f[n]-y_f[n]-u[n])v_{L_f}[n] \quad (14)$$

wherein $\mu_f$ denotes a step size parameter for the adaptive filter $\hat{F}$.

In other aspects, the coefficients of the adaptive filter $\hat{F}$ may be updated according to any other algorithm.

In some demonstrative aspects, after updating the coefficients of the adaptive filter $\hat{F}$, the updated coefficients of the adaptive filter $\hat{F}$ may be copied to the fixed filter $\hat{F}$, for example, taking $y_{L_f}[n]$ as its input.

In some demonstrative aspects, the signal 873, denoted x, at the PF input 875 of PF 876 may be determined, e.g., as follows:

$$x[n]=d[n]+y_f[n]+\hat{v}_f[n]-\hat{y}_f[n]-\hat{v}_f[n]=d[n]+y_f[n]-\hat{y}_f[n] \quad (15)$$

In some demonstrative aspects, when the adaptive filter H converges, then, for example, $u[n]\rightarrow d[n]+y_f[n]-\hat{y}_f[n] \Rightarrow e_H[n]\approx\hat{v}_f[n]$.

Accordingly, the adaptive filter $\hat{F}$ may receive a desired response substantially free of any disturbance.

In some demonstrative aspects, when the adaptive filter $\hat{F}$ converges, e.g., when $\hat{F}\approx F$, then, e.g., ideally, $\hat{y}_f[n]\approx y_f[n]$. Accordingly, $x[n]\approx d[n]$ may be substantially free of any acoustic feedback component of the canceling signal.

Referring back to FIG. 2, in some demonstrative aspects, AFB mitigator 250 may be configured to implement the first filter 252 including a fixed filter, while utilizing the internally generated virtual signal to adapt another filter (not shown in FIG. 2) of AFC mitigator 250, e.g., as described below.

In some demonstrative aspects, AFB mitigator 250 may be configured to implement two adaptive filters, e.g., in addition to the fixed filter 252. For example, the two adaptive filters, e.g., including adaptive filter 254 and another adaptive filter (not shown in FIG. 2) may be utilized to adapt to changes in acoustical feedback path, e.g., due to changes in a configuration of the AAC system 200 and/or in an environment if the AAC system 200.

Figure 9:
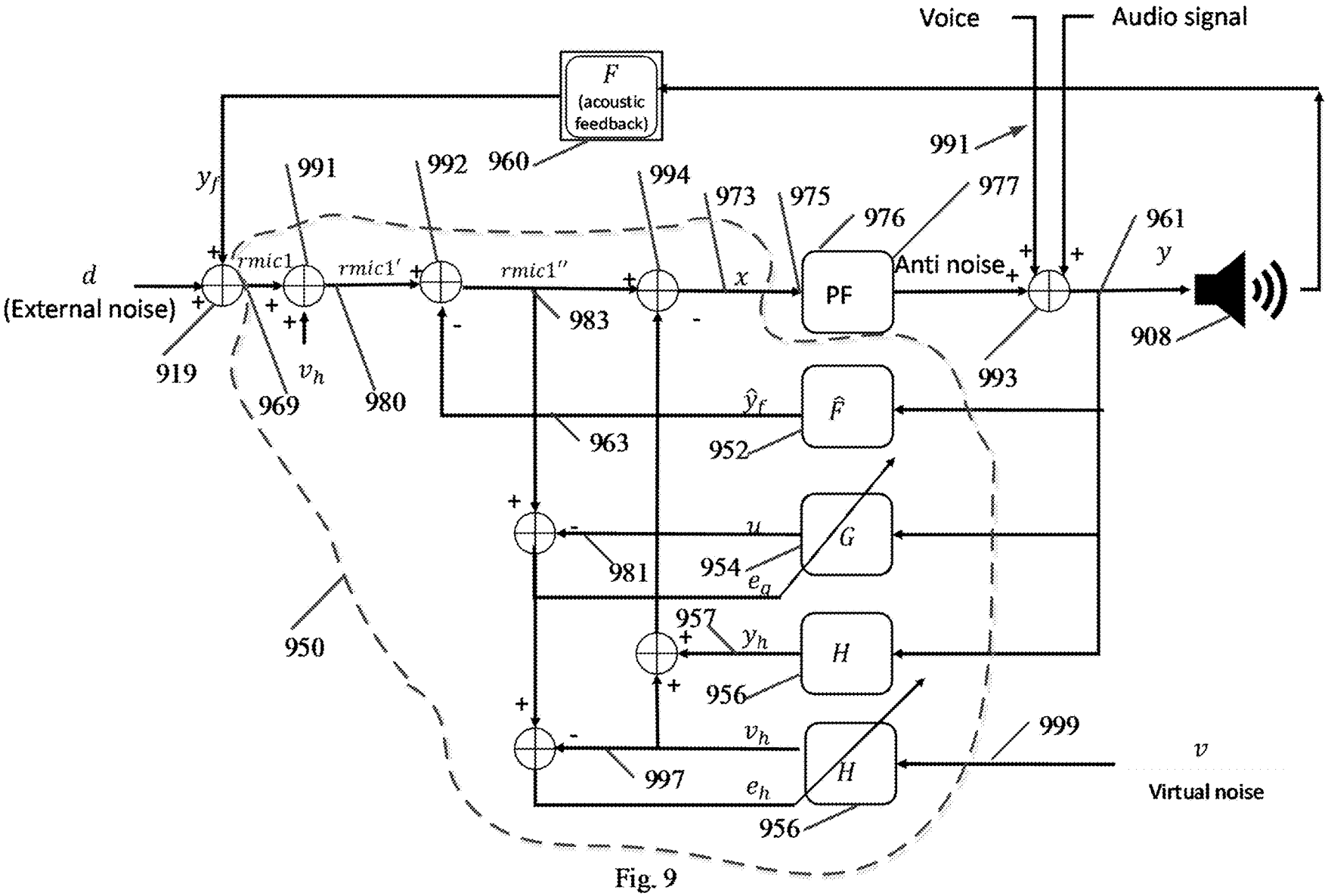
FIG. 9 is a schematic block diagram illustration of an adaptive AFB mitigator implemented in an AAC system, in accordance with some demonstrative aspects.

Reference is made to FIG. 9, which schematically illustrates an adaptive AFB mitigator 950 implemented in an AAC system, in accordance with some demonstrative aspects. For example, AFB mitigator 250 (FIG. 1) may include one or more elements of, and/or perform one or more functionalities of, adaptive AFB mitigator 950.

In some demonstrative aspects, AFB mitigator 950 may be configured to mitigate acoustic feedback 960 between an acoustic transducer 908 and an acoustic sensor 919 in the AAC system, e.g., as described below.

In some demonstrative aspects, AFB mitigator 950 may include a first filter 952 configured to generate a first filtered signal 963 by filtering a first input signal 961 according to a first filter function, e.g., as described below.

In some demonstrative aspects, the first input signal 961 may be based on a sound control pattern to be output by the acoustic transducer 908.

In some demonstrative aspects, the AAC system may include a PF 976, which may be configured to generate a PF output 977 based on a PF input 975, and an acoustic configuration between the acoustic transducer 908 and an acoustic control zone of the AAC system, e.g., acoustic control zone 130 (FIG. 1).

In some demonstrative aspects, the sound control pattern to be output by the acoustic transducer 908 may be based on the PF output 977.

In some demonstrative aspects, the first input signal 961 may be based on the PF output 977.

In some demonstrative aspects, as shown in FIG. 9, the first input signal 961 may be based on the PF output 977 and one or more audio and/or voice signals 991, e.g., as described below.

For example, the AAC system may include a combiner 993 to combine, e.g., a summation unit to sum, a signal based on the PF output 977 with one or more audio and/or voice signals 991.

For example, the one or more audio and/or voice signals 991 may include audio and/or voice signals to be heard in the sound control zone 130 (FIG. 1).

In one example, the one or more audio and/or voice signals 991 may include, or may be based on, the audio and/or voice signals 233 (FIG. 2).

In other aspects, the first input signal 961 may be based on the PF output 977, e.g., while the with one or more audio and/or voice signals 991 may be excluded.

In some demonstrative aspects, AFB mitigator 950 may include a second filter 954 configured to generate a second filtered signal 981, for example, by filtering the first input signal 961, for example, according to a second filter function, e.g., as described below.

In some demonstrative aspects, the second filter 954 may include an adaptive filter, e.g., as described below.

In some demonstrative aspects, the second filter 954 may be adapted, for example, based on a difference between an AFB-mitigated signal 983 and the second filtered signal 981, e.g., as described below.

In some demonstrative aspects, the AFB-mitigated signal 983 may be based on a difference between a second input signal 969 and the first filtered signal 963, e.g., as described below.

In some demonstrative aspects, the second input signal 969 may be based on acoustic noise sensed by the acoustic sensor 919, e.g., as described below.

In some demonstrative aspects, the first filter 952 may be configured to generate the first filtered signal 963 including a first estimation of the AFB 960, e.g., between acoustic transducer 908 and reference noise sensor 919, e.g., as described below.

In some demonstrative aspects, the second filter 954 may be configured to generate the second filtered signal 981 including a second estimation of the AFB 960, e.g., between acoustic transducer 908 and reference noise sensor 919, e.g., as described below.

In some demonstrative aspects, the second filter 954 may be configured to generate the second filtered signal 981 based on a change in the AFB 960, e.g., between acoustic transducer 908 and reference noise sensor 919, e.g., as described below.

In some demonstrative aspects, the first filter 952 may include a fixed filter having a fixed filter function, e.g., as described below.

In some demonstrative aspects, the first filter 952 may include a fixed IIR filter, e.g., as described below.

In other aspects, the first filter 952 may include a fixed FIR filter, or any other type of fixed filter.

In some demonstrative aspects, the fixed filter function of filter 952 may be based, for example, on a predefined acoustic configuration of an AAC system, e.g., AAC system 200 (FIG. 2), including the acoustic transducer 908 and the acoustic sensor 919.

In some demonstrative aspects, the fixed filter function of filter 952 may be based, for example, on a predefined acoustic configuration between the acoustic transducer 908 and the acoustic sensor 919.

In some demonstrative aspects, the second filter 954 may be implemented by a short adaptive FIR filter, e.g., as described below.

In other aspects, the second filter 954 may include any other adaptive FIR filter, an adaptive IIR filter, adaptive cascaded biquad filters, and/or any other adaptive filter.

In some demonstrative aspects, AFB mitigator 950 may include a third filter 956 configured to generate a third filtered signal 957, for example, by filtering the first input signal 961, for example, according to a third filter function, e.g., as described below.

In some demonstrative aspects, the third filter 956 may include an adaptive filter, e.g., as described below.

In some demonstrative aspects, the third filter 956 may be adapted based on a predefined (virtual) signal 999, e.g., as described below.

In some demonstrative aspects, the predefined signal 999 may include a virtual signal, which may be internally generated, e.g., by the AFB mitigator 950 and/or by any other element of the AAC system utilizing the AFB mitigator 950.

In some demonstrative aspects, the predefined signal 999 may include a virtual noise signal.

In some demonstrative aspects, the predefined signal 999 may include a virtual white noise signal.

In some demonstrative aspects, the predefined signal 999 may include a virtual pink noise signal.

In some demonstrative aspects, a frequency spectrum of the predefined signal 999 may be different from a frequency spectrum of the first input signal 961.

In other aspects, the predefined signal 999 may include any other type of predefined signal.

In some demonstrative aspects, the third filter 956 may be adapted, for example, based on a subtraction of a filtered predefined signal 997 from the difference between the AFB-mitigated signal 983 and the second filtered signal 981, e.g., as described below. For example, as shown in FIG. 9, the filtered predefined signal 997 may include the predefined signal 999 filtered by the third filter 956.

In some demonstrative aspects, as shown in FIG. 9, AFB mitigator 950 may be configured according to a multi-filter AFB mitigation architecture utilizing a fixed predefined filter, e.g., the filter 952; an adaptation block based on the speaker/s signals, e.g., filter 954; and an adaptation block based on a virtual internal generated signal, e.g., the filter 956.

For example, the second filter 954, denoted G, may be utilized to remove disturbance from the desired response of the acoustic feedback; and/or the third filter, denoted H, may be utilized to adapt to changes of the AFB.

In some demonstrative aspects, the filter H, may use an input from the virtual internal generated signal 999, for example, to adapt coefficients of the filter H. The adapted coefficients of the filter H may be applied to the input 961, e.g., representing the speaker signals, for example, to estimate signals 957, denoted Yh, to be reduced from the ANC microphone/s path.

In some demonstrative aspects, AFB mitigator 950 may include an adder 991 to generate a modified sensor signal 980, for example, by adding the filtered predefined signal 997 to the second input signal 969.

In some demonstrative aspects, AFB mitigator 950 may include a first subtractor 992 to generate a first AFB-mitigated signal, e.g., signal 983, for example, by subtracting the first filtered signal 963 from the modified sensor signal 980.

In some demonstrative aspects, AFB mitigator may include a second subtractor 994 to generate a second AFB-mitigated signal 973, for example, by subtracting from the first AFB-mitigated signal 983 a sum of filtered signals. For example, as shown in FIG. 9, the sum of filtered signals may include a sum of the third filtered signal 957 and the filtered predefined signal 997.

In some demonstrative aspects, the PF input 975 may be based on the second AFB-mitigated signal 973.

In some demonstrative aspects, a reference signal ("microphone data signal") picked up by the reference microphone 919, denoted rmic1, may be determined by Equations 2 and 3, for example, using y to denote the output by the acoustic transducer 918, e.g., including the combination of the sound control pattern ("anti-noise signal" or "cancelling signal") together with the voice/audio signals 991.

In some demonstrative aspects, the signal 980, denoted rmic1'[n] may be determined, for example, by adding the signal $v_h[n]$ to the signal rmic1[n], wherein $v_h[n]=H[n]^T v_{L_h}[n]$, wherein $H[n]=[H_0[n], H_1[n], \ldots, H_{L_h}[n]]^T$ denotes an impulse response of the filter H[n], $L_h$ denotes a length of the filter H, and $v_{L_h}[n]=[v[n-1], v[n-2], \ldots, v[n-L_h]]^T$ denotes an $L_h$-sample predefined signal, e.g., a white noise signal vector (signal 999). For example, the signal $v_{L_h}[n]$ may be used as the input signal vector to the filter H in the adaptation process.

In some demonstrative aspects, a response, e.g., a desired response, for the adaptive filter G may be determined, e.g., as follows:

$$rmic1''[n]=d[n]+y_f[n]+v_h[n]-\hat{y}_f[n], \text{ where } \hat{y}_f[n]=\hat{F}[n]^T y_{L_f}[n] \tag{16}$$

wherein $\hat{F}=[\hat{F}_0, \hat{F}_1, \ldots, \hat{F}_{L_f}]^T$ denotes an impulse response of the filter $\hat{F}$, $L_f$ denotes a length of $\hat{F}$, and $y_{L_f}[n]=[y[n-1], y[n-2], \ldots, y[n-L_f]]^T$ denotes an $L_f$-sample speaker output, which is the input signal vector to the filter $\hat{F}$ (input signal 961)

In some demonstrative aspects, a residual error signal, denoted $e_g[n]$, may be determined, e.g., as follows:

$$e_g[n]=d[n]+y_f[n]+v_h[n]-\hat{y}_f[n]-u[n] \tag{17}$$

wherein u[n] denotes an output of the filter G, give as $u[n]=G[n]^T y_{L_g}[n]$ (signal 981), wherein $G[n]=[G_0[n], G_1[n], \ldots, G_{L_g}[n]]^T$ denotes an impulse response of the filter G[n], $L_g$ denotes a length of the filter G, and $y_{L_g}[n]=[y[n-1], y[n-2], \ldots, y[n-L_g]]^T$ denotes an $L_9$-sample speaker output, which is the input signal vector to the filter G (signal 961).

In some demonstrative aspects, coefficients of the filter G may be updated, for example, according to an LMS algorithm and/or an LMS algorithm variant, e.g., NLMS, Leaky LMS, and/or any other LMS-variant, e.g., as described below. In other aspects, any other suitable algorithm may be used.

In some demonstrative aspects, coefficients of the filter G may be updated according to an LMS algorithm, e.g., as follows:

$$G[n+1]=G[n]+\mu_g e_g[n] y_{L_g}[n] \tag{18}$$

wherein $\mu_g$ denotes a step size parameter for the filter G.

In some demonstrative aspects, the adaptive filter H may be excited by the predefined signal v[n], e.g., a random (white) noise.

In some demonstrative aspects, an error signal of the filter G may be used as a desired response for the adaptive filter H.

In some demonstrative aspects, coefficients of the filter H may be updated, for example, according to an LMS algorithm and/or an LMS algorithm variant, e.g., NLMS, Leaky LMS, and/or any other LMS-variant. In other aspects, any other suitable algorithm may be used.

In some demonstrative aspects, coefficients of the filter H may be updated according to an LMS algorithm, e.g., as follows:

$$H[n+1] = H[n] + \mu_h(d[n] + y_f[n] + v_h[n] - \hat{y}_f[n] - u[n] - v_h[n])v_{L_h}[n] = H[n] + \mu_H(d[n] + y_f[n] - \hat{y}_f[n] - u[n])v_{L_h}[n] \quad (19)$$

wherein $\mu_h$ denotes a step size parameter for the filter H.

In some demonstrative aspects, after updating the coefficients of the adaptive filter H, the updated coefficients of the adaptive filter H may be copied to the fixed filter H, for example, taking y[n] as its input.

In some demonstrative aspects, the signal 973, denoted x, at the PF input 975 of PF 976 may be determined, e.g., as follows:

$$x[n] = d[n] + y_f[n] + v_h - \hat{y}_f[n] - v_h[n] - y_h[n] = d[n] + y_f[n] - \hat{y}_f[n] - y_h[n] \quad (20)$$

wherein $y_h[n]=H[n]^T y_{L_h}[n]$, and $y_{L_h}[n]=[y[n-1], y[n-2], \ldots, y[n-L_h]]^T$ denotes an $L_h$-sample speaker output, which is the input signal vector to the filter H (signal 961).

In some demonstrative aspects, when the adaptive filter G converges, then, for example, $u[n] \rightarrow d[n]+y_f[n]-\hat{y}_f[n] \Rightarrow e_g[n] \approx v_h[n]$.

Accordingly, adaptive filter H may receive a desired response substantially free of any disturbance.

In some demonstrative aspects, when the adaptive filter H converges, then, e.g., ideally, $\hat{y}_f[n]+y_h[n] \approx y_f[n]$. Accordingly, $x[n] \approx d[n]$ may be substantially free of any acoustic feedback component of the canceling signal.

Referring back to FIG. 2, in some demonstrative aspects, AAC controller 202 may be configured according to a hybrid scheme, e.g., as described below.

In some demonstrative aspects, AAC controller 202 may be configured according to a non-hybrid scheme, e.g., as described below.

In some demonstrative aspects, the hybrid scheme may be configured to apply at least one noise prediction filter and at least one residual-noise prediction filter, e.g., as described below.

In some demonstrative aspects, the noise prediction filter may be configured to be applied to a prediction filter input, which may be based on the noise input 206, e.g., as described below.

In some demonstrative aspects, the residual-noise prediction filter may be configured to be applied to a prediction filter input, which may be based on the residual-noise input 204, e.g., as described below.

In some demonstrative aspects, the hybrid scheme may include an adaptive hybrid scheme, e.g., as described below.

In some demonstrative aspects, the adaptive hybrid scheme may be configured to adaptively update at least one of the noise prediction filter and/or the residual-noise prediction filter, e.g., as described below.

For example, controller 293 may be configured to update one or more prediction parameters of at least one of the noise prediction filter and/or the residual-noise prediction filter, for example, based on the mounting-based parameter, e.g., corresponding to the mounting configuration of open acoustic headphone 110.

In some demonstrative aspects, controller 293 may be configured to update one or more prediction parameters of at least one of the noise prediction filter and/or the residual-noise prediction filter, for example, by updating weights, coefficients, functions, and/or any other additional or alternative parameter to be utilized for determining the sound control pattern 209, e.g., as described below.

Figure 10:
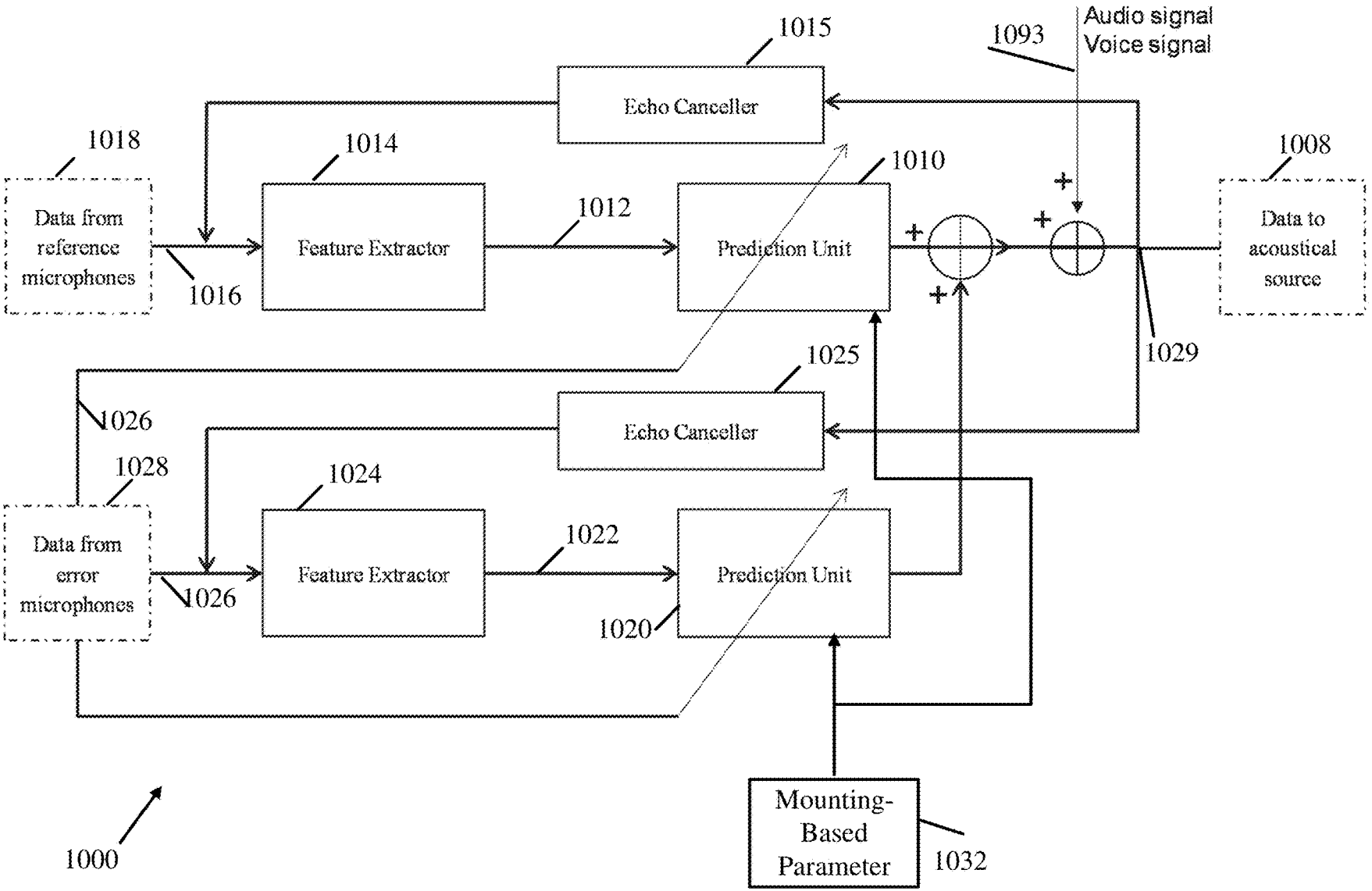
FIG. 10 is a schematic block diagram illustration of a controller, in accordance with some demonstrative aspects.

Reference is now made to FIG. 10, which schematically illustrates a controller 1000, in accordance with some demonstrative aspects. In some aspects, AAC controller 202 (FIG. 2) and/or controller 293 (FIG. 2) may perform, for example, one or more functionalities and/or operations of controller 1000.

In some demonstrative aspects, controller 1000 may be configured according to a hybrid scheme.

In some demonstrative aspects, the hybrid scheme may be configured to apply at least one noise prediction filter and at least one residual-noise prediction filter, e.g., as described below.

In some demonstrative aspects, the noise prediction filter may be configured to be applied to a prediction filter input, which may be based on a noise input, e.g., as described below.

In some demonstrative aspects, the residual-noise prediction filter may be configured to be applied to a prediction filter input, which may be based on a residual-noise input, e.g., as described below.

In some demonstrative aspects, as shown in FIG. 10, controller 1000 may include a prediction filter 1010 and a prediction filter 1020, e.g., as described below.

In some demonstrative aspects, prediction filter 1010 and/or prediction filter 1020 may be implemented by a Finite Impulse Response (FIR) filter.

In other aspects, prediction filter 1010 and/or prediction filter 1020 may be implemented by an Infinite Impulse Response (IIR) filter. In one example, prediction filter 1010 and/or prediction filter 1020 may be implemented by a multi-cascaded in serial second order digital IIR biquad filters.

In other aspects, any other prediction filter may be used.

In some demonstrative aspects, as shown in FIG. 10, the prediction filter 1010 may include a noise prediction filter to be applied to a prediction filter input 1012, which may be based on a noise input 1016, for example, from one or more noise sensors 1018 ("reference microphones"). For example, the prediction filter input 1012 may be based on noise input 206 (FIG. 2).

In some demonstrative aspects, the prediction filter 1020 may include a residual-noise prediction filter to be applied to a prediction filter input 1022, which may be based on a residual-noise input 1026, for example, from one or more residual-noise sensors 1028 ("error microphones"). For example, prediction filter input 1022 may be based on residual-noise input 204 (FIG. 2).

In some demonstrative aspects, input 1026 may include at least one virtual microphone input corresponding to a residual noise ("noise error") sensed by at least one virtual error sensor at virtual sensing location 117 (FIG. 1). For example, controller 1000 may evaluate the noise error at virtual sensing location 117 (FIG. 1) based on input 1026 and the predicted noise signal 1029, e.g., as described below.

In some demonstrative aspects, as shown in FIG. 10, controller 1000 may generate a sound control signal 1029 based on an output of the prediction unit 1010 and an output of the prediction unit 1020, and may output the sound control signal 1029 to an acoustic transducer 1008.

In some demonstrative aspects, controller 1000 may generate sound control signal 1029 configured to reduce and/or eliminate the noise energy and/or wave amplitude of one or more sound patterns within a sound control zone, while the noise energy and/or wave amplitude of one or more other sound patterns may not be affected within the sound control zone, e.g., as described below.

In some demonstrative aspects, controller 1000 may be configured to generate the sound control signal 1029 based on the output of the prediction unit 1010, the output of the prediction unit 1020 and one or more audio and/or voice signals 1093.

For example, as shown in FIG. 10, controller 1000 may be configured to generate the sound control signal 1029 based on a summation of the output of the prediction unit 1010, the output of the prediction unit 1020, and the one or more audio and/or voice signals 1093.

For example, controller 293 (FIG. 2) may be configured to generate the sound control signal 209 based on a combination, e.g., a summation or any other combination, of the output of the prediction unit 1010, the output of the prediction unit 1020, and the one or more audio and/or voice signals 1093, e.g., signals 233 (FIG. 2).

In some demonstrative aspects, e.g., as shown in FIG. 10, controller 1000 may include an extractor 1014 to extract a plurality of disjoint reference acoustic patterns from input 1016. According to these aspects, prediction filter input 1012 may include the plurality of disjoint reference acoustic patterns. In other aspects, extractor 1014 may be excluded, and prediction filter input 1012 may be generated directly or indirectly based on input 1016, e.g., according to any other algorithm and/or calculation.

In some demonstrative aspects, e.g., as shown in FIG. 10, controller 1000 may include an extractor 1024 to extract a plurality of disjoint residual-noise acoustic patterns from input 1026. According to these aspects, prediction filter input 1022 may include the plurality of disjoint residual-noise acoustic patterns. In other aspects, extractor 1024 may be excluded, and prediction filter input 1022 may be generated directly or indirectly based on input 1026, e.g., according to any other algorithm and/or calculation.

In some demonstrative aspects, as shown in FIG. 10, controller 1000 may include an AFB mitigator ("Echo Canceller") 1015 configured to reduce, remove, and/or cancel, partially or entirely, a portion of the signal generated by the speaker 1008 from an output signal of the reference microphone 1018.

For example, AFB mitigator 250 (FIG. 2) may include AFB mitigator 1015 and/or may perform one or more functionalities of AFB mitigator 1015.

In some demonstrative aspects, AFB mitigator 1015 may include one or more elements of, and/or perform one or more functionalities of, adaptive AFB mitigator 750 (FIG. 7).

In some demonstrative aspects, AFB mitigator 1015 may include one or more elements of, and/or perform one or more functionalities of, adaptive AFB mitigator 850 (FIG. 8).

In some demonstrative aspects, AFB mitigator 1015 may include one or more elements of, and/or perform one or more functionalities of, adaptive AFB mitigator 950 (FIG. 9).

In some demonstrative aspects, as shown in FIG. 10, controller 1000 may include an AFB mitigator ("Echo Canceller") 1025 configured to reduce, remove, and/or cancel, partially or entirely, a portion of the signal generated by the speaker 1008 from an output signal of the residual-noise microphone 1028.

For example, AFB mitigator 250 (FIG. 2) may include AFB mitigator 1025 and/or may perform one or more functionalities of AFB mitigator 1025.

In some demonstrative aspects, AFB mitigator 1025 may include one or more elements of, and/or perform one or more functionalities of, adaptive AFB mitigator 750 (FIG. 7).

In some demonstrative aspects, AFB mitigator 1025 may include one or more elements of, and/or perform one or more functionalities of, adaptive AFB mitigator 850 (FIG. 8).

In some demonstrative aspects, AFB mitigator 1025 may include one or more elements of, and/or perform one or more functionalities of, adaptive AFB mitigator 950 (FIG. 9).

In some demonstrative aspects, controller 1000 may be configured according to an adaptive hybrid scheme, e.g., as described below.

In some demonstrative aspects, as shown in FIG. 10, controller 1000 may be configured to update one or more parameters of the prediction filter 1010 and/or prediction filter 1020, for example, based on the residual noise input 1026.

In some demonstrative aspects, as shown in FIG. 10, controller 1000 may identify a mounting-based parameter 1032, e.g., corresponding to the mounting configuration of open acoustic headphone 110 (FIG. 1).

In some demonstrative aspects, controller 1000 may be configured to update one or more parameters of the prediction filter 1010, for example, based on the mounting-based parameter 1032, e.g., corresponding to the mounting configuration of open acoustic headphone 110 (FIG. 1).

In some demonstrative aspects, controller 1000 may be configured to update one or more parameters of the prediction filter 1020, for example, based on the mounting-based parameter 1032, e.g., corresponding to the mounting configuration of open acoustic headphone 110 (FIG. 1).

In some demonstrative aspects, controller 1000 may apply any suitable linear and/or non-linear function to prediction filter input 1012 and/or prediction filter input 1022. For example, prediction filter 1020 and/or prediction filter 1020 may be configured according to a liner estimation function, or non-linear estimation function, e.g., a radial basis function.

Referring back to FIG. 2, in some demonstrative aspects, controller 293 may be configured according to a non-hybrid scheme, e.g., as describe below.

In some demonstrative aspects, the non-hybrid scheme may include a noise prediction filter, which may be applied to a prediction filter input, which is based on an input from noise sensor 119, e.g., as described below.

Figure 11:
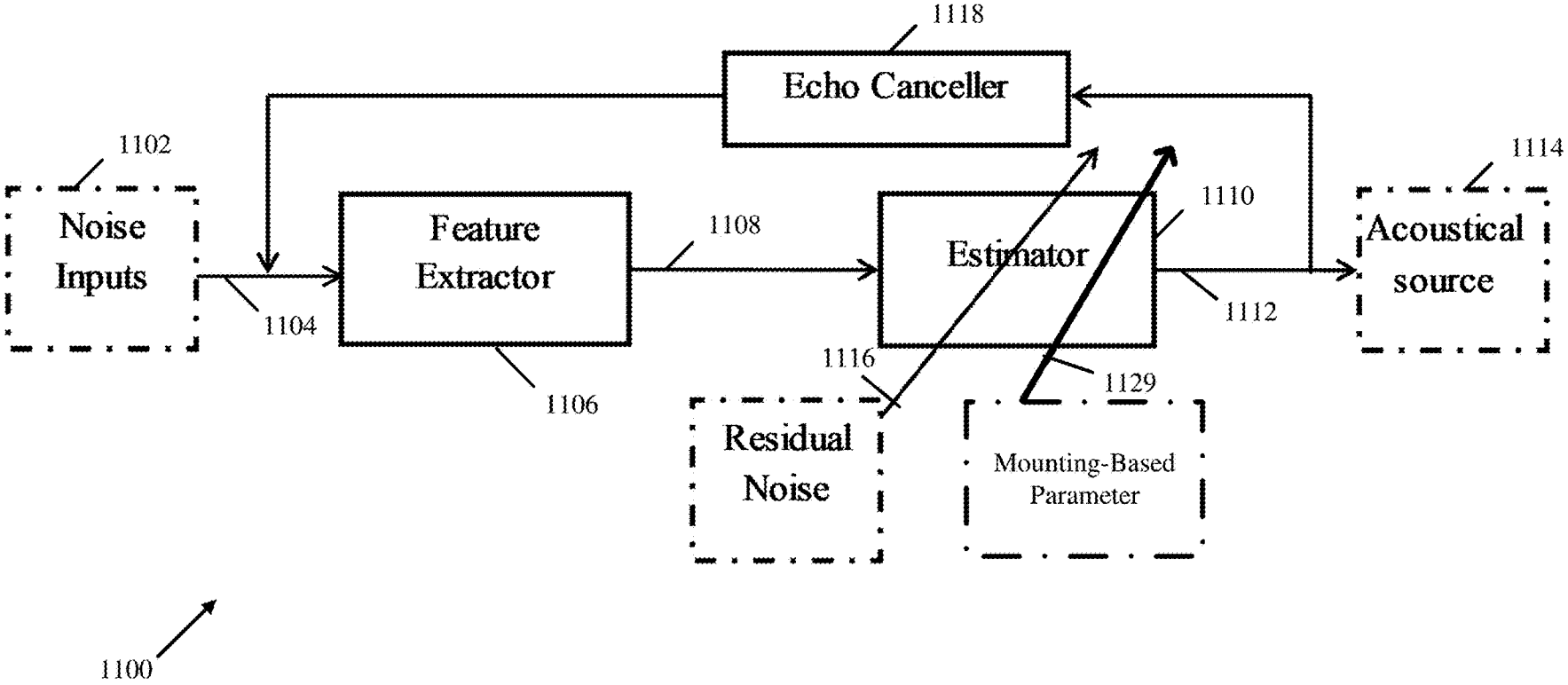
FIG. 11 is a schematic block diagram illustration of a controller, in accordance with some demonstrative aspects.

Reference is now made to FIG. 11, which schematically illustrates a controller 1100, in accordance with some demonstrative aspects. For example, AAC controller 202 (FIG. 2) and/or controller 293 (FIG. 2) may include one or more elements of controller 1100, and/or may perform one or more operations of, and/or one or more functionalities of controller 1100.

In some demonstrative aspects, controller 1100 may be configured according to a non-hybrid scheme, e.g., as described below.

In some demonstrative aspects, the non-hybrid scheme may include a noise prediction filter, which may be applied to a prediction filter input, which is based on a noise input, e.g., noise input 204 (FIG. 2), as described below.

In some demonstrative aspects, controller 1100 may receive one or more inputs 1104, e.g., including input 206 (FIG. 2), representing acoustic noise at one or more predefined noise sensing locations.

In some demonstrative aspects, controller 1100 may generate a sound control signal 1112 to control at least one acoustic transducer 1114, e.g., acoustic transducer 108 (FIG. 2).

In some demonstrative aspects, controller 1100 may include an estimator ("prediction unit") 1110 to estimate signal 1112 by applying an estimation function to an input 1108 corresponding to inputs 1104. For example, PF 256 (FIG. 2) may include estimator 1110 and/or may perform one or more functionalities of estimator 1110.

In some demonstrative aspects, estimator 1110 may be implemented by a FIR filter.

In other aspects, estimator 1110 may be implemented by implemented by an IIR filter. In one example, estimator 1110 may be implemented by a multi-cascaded in serial second order digital IIR biquad filter.

In other aspects, and other prediction mechanism may be used.

In some demonstrative aspects, controller 1100 may generate sound control signal 1112 configured to reduce and/or eliminate the noise energy and/or wave amplitude of one or more unwanted sound patterns within the sound control zone, while the noise energy and/or wave amplitude of one or more other sound patterns may not be affected within the sound control zone.

In some demonstrative aspects, sound control signal 1112 may be configured to reduce and/or eliminate the unwanted sound patterns.

In some demonstrative aspects, controller 1100 may include an adaptive AFB mitigator 1118, which may be configured to mitigate AFB between acoustic transducer 1114 and reference noise acoustic sensors 1102.

For example, AFB mitigator 250 (FIG. 2) may include adaptive AFB mitigator 1118 and/or may perform one or more functionalities of adaptive AFB mitigator 1118.

In some demonstrative aspects, adaptive AFB mitigator 1118 may include one or more elements of, and/or perform one or more functionalities of, adaptive AFB mitigator 750 (FIG. 7).

In some demonstrative aspects, adaptive AFB mitigator 1118 may include one or more elements of, and/or perform one or more functionalities of, adaptive AFB mitigator 850 (FIG. 8).

In some demonstrative aspects, adaptive AFB mitigator 1118 may include one or more elements of, and/or perform one or more functionalities of, adaptive AFB mitigator 950 (FIG. 9).

In some demonstrative aspects, e.g., as shown in FIG. 11, controller 1100 may include an extractor 1106 to extract a plurality of disjoint reference acoustic patterns from inputs 1104. According to these aspects, input 1108 may include the plurality of disjoint reference acoustic patterns.

In other aspects, controller 1100 may not include extractor 1106. Accordingly, input 1108 may include inputs 1104 and/or any other input based on inputs 1104.

In some demonstrative aspects, estimator 1110 may apply any suitable linear estimation function and/or non-linear estimation function to input 1108. For example, the estimation function may include a non-linear estimation function, e.g., a radial basis function.

In some demonstrative aspects, estimator 1110 may be able to adapt one or more parameters of the estimation function based on a plurality of residual-noise inputs 1116 representing acoustic residual-noise at a plurality of predefined residual-noise sensing locations, which are located within the noise-control zone. For example, inputs 1116 may include input 204 (FIG. 2) representing acoustic residual-noise at residual-noise sensing location 117 (FIG. 1), which is located within the ear 152 (FIG. 1).

In some demonstrative aspects, one or more of inputs 1116 may include at least one virtual microphone input corresponding to a residual noise ("noise error") sensed by at least one virtual error sensor at least one particular residual-noise sensor location 117 (FIG. 1). For example, controller 1100 may evaluate the noise error at the particular residual-noise sensor location based on inputs 1108 and the predicted noise signal 1112, e.g., as described below.

In some demonstrative aspects, estimator 1110 may include a multi-input-multi-output (MIMO) prediction unit configured, for example, to generate a plurality of sound control patterns corresponding to the n-th sample, e.g., including M control patterns, denoted $y_1(n) \ldots y_M(n)$, to drive a plurality of M respective acoustic transducers, e.g., based on the inputs 1108.

In some demonstrative aspects, controller 1100 may identify the mounting-based parameter 1129, e.g., corresponding to the mounting configuration of an open acoustic headphone, e.g., open acoustic headphone 110 (FIG. 1), for example, as described above.

In some demonstrative aspects, controller 1100 may configure estimator 1110 to estimate signal 1112, for example, based on the identified mounting-based parameter 1129, e.g., as described below.

Figure 12:
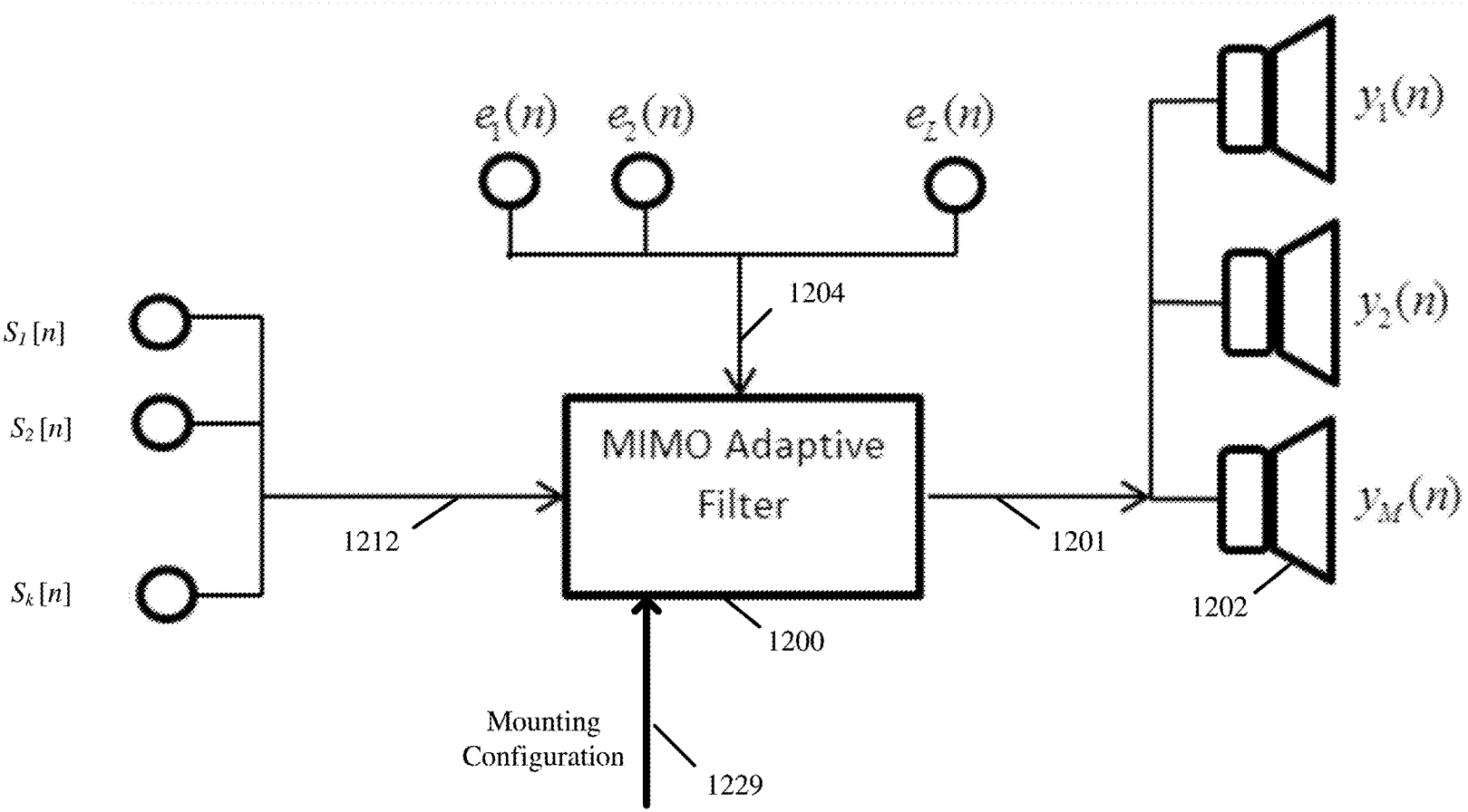
FIG. 12 is a schematic block diagram illustration of a Multiple-Input-Multiple-Output (MIMO) prediction unit, in accordance with some demonstrative aspects.

Reference is now made to FIG. 12, which schematically illustrates a MIMO prediction unit 1200, in accordance with some demonstrative aspects. In some demonstrative aspects, estimator 1110 (FIG. 11) may include MIMO prediction unit 1200, and/or perform one or more functionalities of, and/or operations of, MIMO prediction unit 1200.

As shown in FIG. 12, prediction unit 1200 may be configured according to a mounting configuration 1229 of an open acoustic headphone, e.g., open acoustic headphone 110 (FIG. 1), e.g., a s described below.

As shown in FIG. 12, prediction unit 1200 may be configured to receive an input 1212 including the vector $\hat{S}[n]$, e.g., as output from extractor 1106 (FIG. 11), and to drive a loudspeaker array 1202 including M acoustic transducers, e.g., acoustic transducers 108 (FIG. 2). For example, prediction unit 1200 may generate a controller output 1201 including the M sound control patterns $y_1(n) \ldots y_M(n)$, to drive a plurality of M respective acoustic transducers, e.g., acoustic transducers 108 (FIG. 2), for example, based on the inputs 1108 (FIG. 11).

In some demonstrative aspects, interference (cross-talk) between two or more of the M acoustic transducers of array 1202 may occur, for example, when two or more, e.g., all of, the M acoustic transducers generate the control noise pattern, e.g., simultaneously.

In some demonstrative aspects, prediction unit 1200 may generate output 1201 configured to control array 1202 to generate a substantially optimal sound control pattern, e.g., while simultaneously optimizing the input signals to each speaker in array 1202. For example, prediction unit 1200 may control the multi-channel speakers of array 1202, e.g., while cancelling the interface between the speakers.

In some demonstrative aspects, prediction unit 1200 may be implemented by a FIR filter.

In other aspects, prediction unit 1200 may be implemented by implemented by an IIR filter. In one example, prediction unit 1200 may be implemented by a multi-cascaded in serial second order digital IIR biquad filter.

In other aspects, and other prediction mechanism may be used.

In one example, prediction unit 1200 may utilize a linear function with memory. For example, prediction unit 1200 may determine a sound control pattern, denoted $y_m[n]$, corresponding to an m-th speaker of array 1202 with respect to the n-th sample of the primary pattern, e.g., as follows:

$$y_m[n] = \sum_{k=1}^{K}\sum_{i=1}^{I-1} w_{km}[i]s_k[n-i] \tag{21}$$

wherein $s_k[n]$ denotes the k-th disjoint reference acoustic pattern, e.g., received from extractor 1106 (FIG. 11), and $w_{km}[i]$ denotes a prediction filter coefficient configured to drive the m-th speaker based on the k-th disjoint reference acoustic pattern, e.g., as described below.

In another example, prediction unit 1200 may implement any other suitable prediction algorithm, e.g., linear, or non-linear, having or not having memory, and the like, to determine the output 1201.

In some demonstrative aspects, prediction unit 1200 may optimize the prediction filter coefficients $w_{km}[i]$, for example, based on a plurality of residual-noise inputs 1204, e.g., including the noise inputs $e_1$, $e_2[n]$, . . . , $e_L[n]$. For example, prediction unit 1200 may optimize the prediction filter coefficients $w_{km}[i]$, for example, to achieve maximal destructive interference at residual-error sensing locations. For example, the residual-error sensing locations may include L locations, and inputs 1204 may include L residual noise components, denoted $e_1[n]$, $e_2[n]$, . . . , $e_L[n]$.

In some demonstrative aspects, prediction unit 1200 may optimize one or more) of, e.g., some or all of, the prediction filter coefficients $w_{km}[i]$ based, for example, on a minimum mean square error (MMSE) criterion, or any other suitable criteria. For example, a cost function, denoted J, for optimization of one or more, of, e.g., some or all of, the prediction filter coefficients $w_{km}[i]$ may be defined, for example, as a total energy of the residual noise components $e_1$, $e_2[n]$, . . . , $e_L[n]$ at the residual-error sensing locations, e.g., as follows:

$$J = E\left\{\sum_{l=1}^{L} e_l^2[n]\right\} \tag{22}$$

In some demonstrative aspects, a residual noise pattern, denoted $e_1[n]$, at an 1-th location may be expressed, for example, as follows:

$$e_l[n] = d_l[n] - \sum_{m=1}^{M}\sum_{j=0}^{J-1} stf_{lm}[j]\cdot y_m[n-j] = d_l[n] - \sum_{m=1}^{M}\sum_{j=0}^{J-1} stf_{lmj}[j]\cdot \sum_{k=1}^{K}\sum_{i=1}^{I-1} w_{km}[i]s_k[n-i] \tag{23}$$

wherein $stf_{lm}[j]$ denotes a path transfer function having J coefficients from the m-th speaker of the array 1202 at a l-th location; and $w_{km}[n]$ denotes an adaptive weight vector of the prediction filter with I coefficients representing the relationship between the k-th reference acoustic pattern $s_k[n]$ and the control signal of the m-th speaker.

In some demonstrative aspects, prediction unit 1200 may optimize one or more elements of, e.g., some or all elements of, the adaptive weights vector $w_{km}[n]$, e.g., to reach an optimal point, e.g., a maximal noise reduction, e.g., for AAC at open acoustic headphone 110 (FIG. 1). For example, prediction unit 1200 may implement a gradient based adaption method, when at each step the weight vector $w_{km}[n]$ is updated in a negative direction of a gradient of the cost function J, e.g., as follows:

$$w_{km}[n+1] = w_{km}[n] - \frac{\mu_{km}}{2}\cdot\nabla J_{km} \tag{24}$$

$$\nabla J_{km} = -2\sum_{l=1}^{L} e_l[n]\sum_{i=1}^{I-1} stf_{km}[n]x_k[n-i]$$

$$w_{km}[n+1] = w_{km}[n] + \mu_{km}\cdot\sum_{l=1}^{L} e_l[n]\sum_{i=1}^{I-1} stf_{km}[n]x_k[n-i]$$

Referring back to FIG. 2, in some demonstrative aspects, controller 293 may be configured to update one or more parameters of Equations 22, 23 and/or 24, for example, based on the mounting-based parameter, e.g., corresponding to the mounting configuration of open acoustic headphone 110, e.g., as described below.

In other aspects, controller 293 (FIG. 1) may be configured to update one or more other additional or alternative parameters for prediction unit 900 (FIG. 9) and/or estimator 810 (FIG. 8).

In some demonstrative aspects, controller 293 may be configured to update the one or more parameters of Equations 22, 23 and/or 24, for example, based on the mounting-based parameter, e.g., corresponding to the mounting configuration of open acoustic headphone 110 (FIG. 1), for example, to generate controller output 901 (FIG. 9) for AAC at open acoustic headphone 110 (FIG. 1).

In some demonstrative aspects, controller 293 may update one or more path transfer function $stf_{lm}[j]$ in Equations 23 and/or 24, for example, based on the mounting-based parameter, e.g., corresponding to the mounting configuration of open acoustic headphone 110 (FIG. 1).

In some demonstrative aspects, controller 293 may update one or more of the update rate parameters $\mu_{km}$ in Equation 24, for example, based on the mounting-based parameter, e.g., corresponding to the mounting configuration of open acoustic headphone 110 (FIG. 1).

In one example, controller 293 may be configured to use one or more update rate parameters $\mu_{km}$, for example, some or all of, the update rate parameters $\mu_{km}$. For example, a set of update rate parameters $\mu_{km}$ may be determined or pre-configured based on the mounting-based parameter, e.g., corresponding to the mounting configuration of open acoustic headphone 110 (FIG. 1), e.g., as described above.

Figure 13:
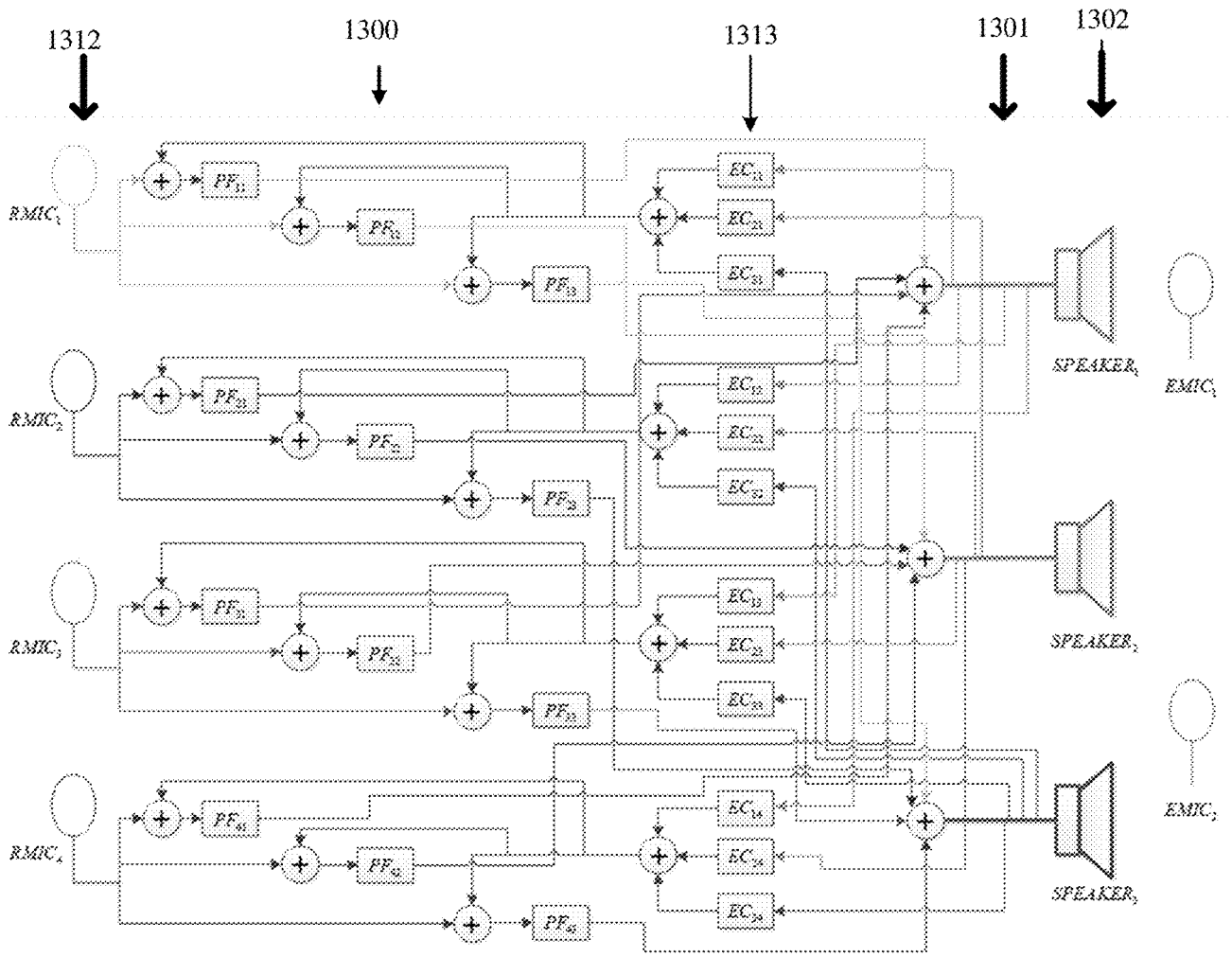
FIG. 13 is a schematic illustration of an implementation of components of a controller of an AAC system, in accordance with some demonstrative aspects.

Reference is made to FIG. 13, which schematically illustrates an implementation of components of a controller 1300 in an AAC system, in accordance with some demonstrative aspects. For example, controller 293 (FIG. 2), controller 1000 (FIG. 10), controller 1100 (FIG. 11), and/or prediction unit 1200 (FIG. 12) may include one or more elements of controller 1300 and/or may perform one or more operations and/or functionalities of controller 1300.

In some demonstrative aspects, controller 1300 may be configured to receive inputs 1312 including residual noise from a plurality of Microphones (RMIC), and to generate output signals 1301 to drive a speaker array 1302 including M acoustic transducers, e.g., three speakers or any other number of speakers. For example, the inputs 1312 may include input 204 (FIG. 2), inputs 1016 (FIG. 10), inputs 1116 (FIG. 11), and/or inputs 1204 (FIG. 12).

In some demonstrative aspects, controller 1300 may be configured to configure, determine, update and/or set one or parameters of Prediction Filters, denoted PF, for example, based on the mounting-based parameter, e.g., corresponding to the mounting configuration of open acoustic headphone 100 (FIG. 1), e.g., as described above.

In some demonstrative aspects, the prediction filters PF may be implemented by a FIR filter.

In other aspects, the prediction filters PF may be implemented by implemented by an IIR filter. In one example, the prediction filters PF may be implemented by a multi-cascaded in serial second order digital IIR biquad filter.

In other aspects, and other prediction mechanism may be used.

In some demonstrative aspects, 1300 controller 1300 may be configured to utilize a plurality of AFB mitigators (Echo Cancellers (EC)) 1313. For example, as shown in FIG. 13, the AFB mitigators 1313 may be configured to mitigate configured to mitigate AFB between acoustic transducers 1302 and reference noise acoustic sensors 1312.

In some demonstrative aspects, one or more, e.g., some or all, of AFB mitigators 1313 may include an adaptive AFB mitigator. For example, one or more, e.g., some or all, of AFB mitigators 1313 may include AFB mitigator 750 (FIG. 7), AFB mitigator 850 (FIG. 8), or AFB mitigator 950 (FIG. 9).

Referring back to FIG. 2, in some demonstrative aspects, controller 293 may determine the mounting-based parameter, e.g., corresponding to the mounting configuration of open acoustic headphone 110 (FIG. 1), for example, based on the residual-noise information 204, e.g., as described below.

In some demonstrative aspects, the residual noise information may be based on, and/or may represent, a transfer function, for example, between acoustic transducer 108 a residual-noise sensing location, e.g., a location of residual-noise sensor 121, or the virtual residual noise sensing location 117.

In some demonstrative aspects, controller 293 may be configured to determine an acoustic transfer function in a plurality of frequency sub-bands, for example, based on the residual-noise information 204.

In some demonstrative aspects, the plurality of frequency sub-bands may include ⅓ octave sub-bands, e.g., as described below. In other aspects, plurality of frequency sub-bands may include any other sub-bands of any other octave order.

In some demonstrative aspects, the plurality of frequency sub-bands may include 18 ⅓ octave sub-bands, e.g., as described below.

In other aspects, the plurality of frequency sub-bands may include any other number of ⅓ octave sub-bands, e.g., less than 18 ⅓ octave sub-bands or more than ⅓ octave sub-bands.

In some demonstrative aspects, the plurality of frequency sub-bands may include 18 or more frequency sub-bands having one or more, e.g., some or all, of the following set of central frequencies, respectively: [19.68, 24.80, 31.25, 39.37, 49.6, 62.5, 78.74, 99.21, 125, 157.49, 198.42, 250, 314.98, 396.85, 500, 629.96, 793.7, 1000, . . . , Fs/2] Hertz (Hz), wherein Fs denotes a sampling frequency.

In other aspects, the plurality of frequency sub-bands may include any other frequency sub-bands having any other additional or alternative central frequencies.

In other aspects, the plurality of frequency sub-bands may include any other number of frequency sub-bands according to any other sub-band allocation or scheme.

In some demonstrative aspects, controller 293 may be configured to apply a plurality of bandpass filters to the residual-noise information 204 to convert the residual-noise information 204 into the acoustic transfer function in the plurality of frequency sub-bands, e.g., as described below.

In one example, the plurality of bandpass filters may include 18 band pass filters having 18 respective central frequencies corresponding to the central frequencies of the 18 ⅓ octave sub-bands, e.g., as described below.

Figure 14:
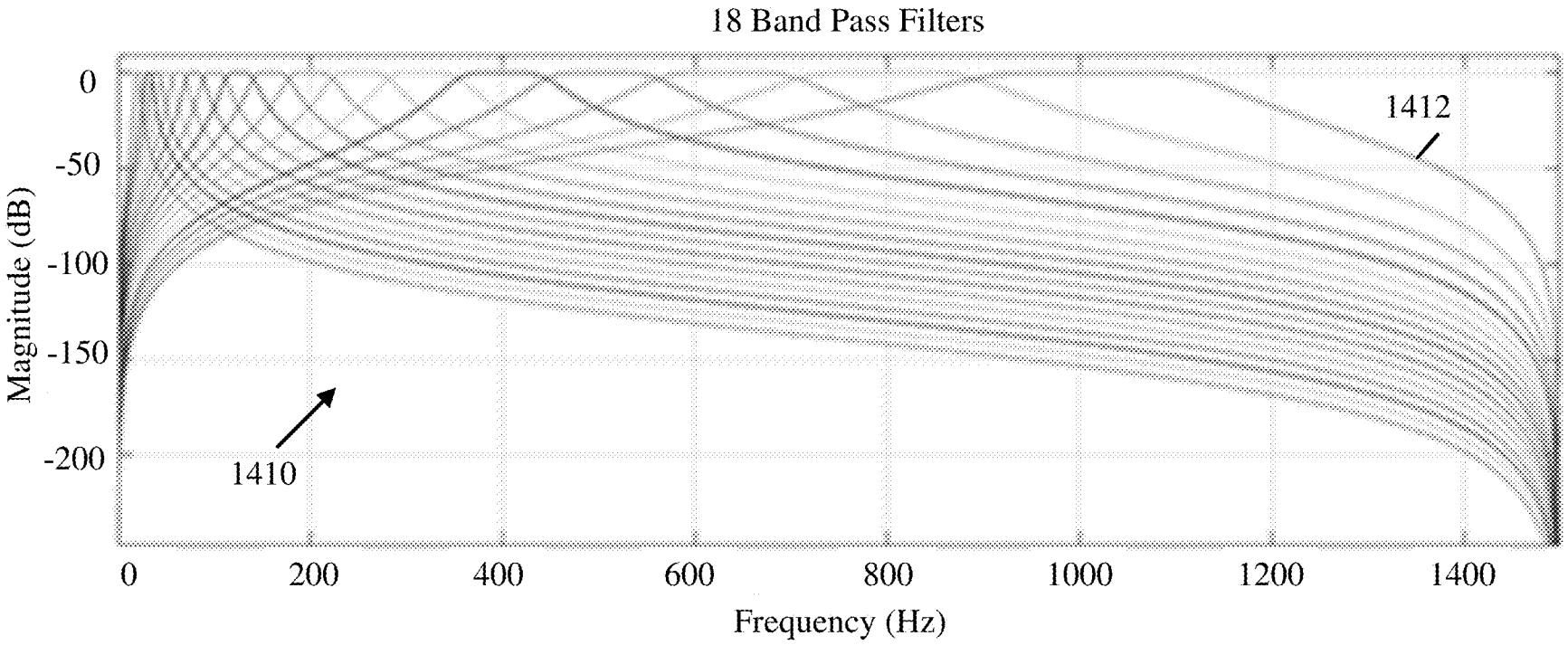
FIG. 14 is a schematic illustration of a graph depicting a plurality of bandpass filter curves, in accordance with some demonstrative aspects.

Reference is made to FIG. 14, which schematically illustrate a graph 1400 depicting a plurality of bandpass filter curves 1410, in accordance with some demonstrative aspects.

In one example, as shown in FIG. 14, the plurality of bandpass filter curves 1410 may represent 18 bandpass filters having 18 respective central frequencies 1412 corresponding, for example, to the central frequencies of the 18 ⅓ octave sub-bands, e.g., as described above.

In some demonstrative aspects, a second order band pass filter may be configured around a central frequency 1412. For example, controller 293 (FIG. 2) may be configured to utilize bandpass filters according to some or all of the bandpass filter curves 1410.

In some demonstrative aspects, controller 293 (FIG. 2) may be configured to generate an acoustic transfer function corresponding to the residual-noise information, for example, based on the bandpass filter curves 1410, e.g., as described below.

In some demonstrative aspects, controller 293 (FIG. 2) may be configured to convert the residual-noise information into acoustic information in a plurality of frequency sub-bands, for example, by applying to the residual-noise information 204 (FIG. 2) each of the Band-Pass Filters defined by curves 1410, for example, according to the following method:

$$sos = \begin{bmatrix} b_{01} & b_{11} & b_{21} & 1 & a_{11} & a_{21} \\ b_{02} & b_{12} & b_{22} & 1 & a_{12} & a_{22} \\ \vdots & \vdots & \vdots & \vdots & \vdots & \vdots \\ b_{0L} & b_{1L} & b_{2L} & 1 & a_{1L} & a_{2L} \end{bmatrix} \tag{25}$$

represents the second-order section digital filter $$H(z) = \prod_{k=1}^{L} H_k(z) = \prod_{k=1}^{L} \frac{b_{0k} + b_{1k}z^{-1} + b_{2k}z^{-2}}{1 + a_{1k}z^{-1} + a_{2k}z^{-2}}.$$

In other aspects, the acoustic information in the plurality of frequency sub-bands may be determined according to any other technique.

In some demonstrative aspects, controller 293 (FIG. 2) may be configured to generate the acoustic transfer function corresponding to the residual-noise information 204 (FIG. 2), for example, by determining a plurality of energy values corresponding to the plurality of frequency sub-bands, e.g., as described below.

In some demonstrative aspects, controller 293 (FIG. 2) may be configured to generate the acoustic transfer function corresponding to the residual-noise information 204 (FIG. 2), for example, by generating a vector ("acoustic transfer function vector") including the plurality of energy values corresponding to the plurality of frequency sub-bands, e.g., as described below.

Figure 15:
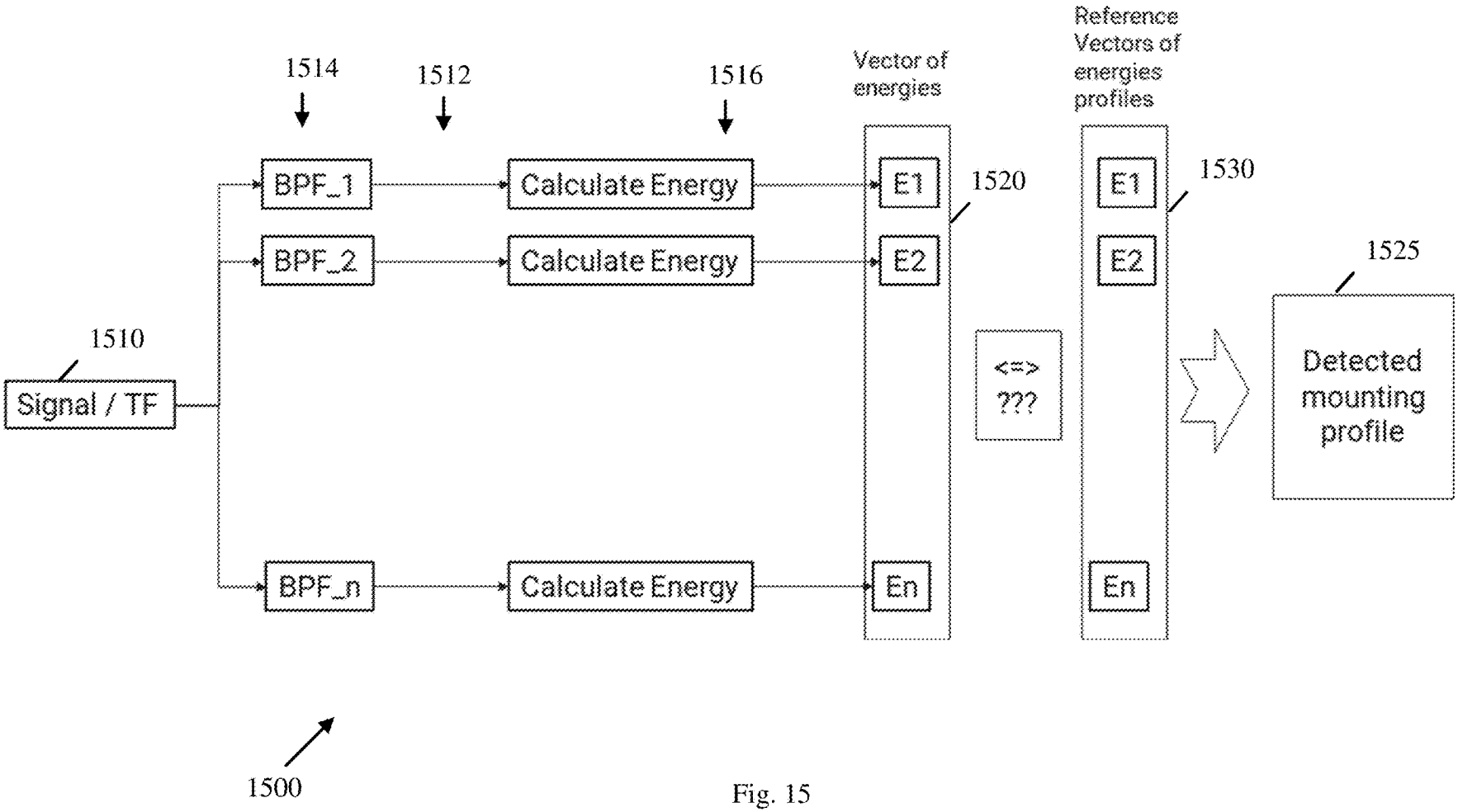
FIG. 15 is a schematic illustration of a detection scheme to detect a mounting profile of an open acoustic headphone, in accordance with some demonstrative aspects.

Reference is made to FIG. 15, which schematically illustrates a detection scheme 1200 to detect a mounting profile 1525 of an open acoustic headphone, in accordance with some demonstrative aspects. For example, a controller, e.g., controller 293 (FIG. 2), may be configured to detect the mounting profile 1525 of open acoustic headphone 110 (FIG. 1), e.g., as described below.

In some demonstrative aspects, controller 293 (FIG. 2) may be configured to convert residual-noise information 1510 into an acoustic transfer function 1520 over a plurality of frequency sub-bands.

In some demonstrative aspects, the residual-noise information 1510 may include samples of an output signal of an acoustic sensor device, e.g., residual-noise information 204 (FIG. 2) from residual-noise sensor 121 (FIG. 2).

In some demonstrative aspects, as shown in FIG. 15, the residual-noise information 1510 may be converted into a plurality of frequency sub-bands, e.g., ⅓ octave sub-bands 1512, for example, by applying to the residual-noise information 1510 a plurality of band pass filters 1514 defined according to plurality of ⅓ octave sub-bands 1512. For example, the plurality of band pass filters 1514 may be defined according to the plurality of band pass filter curves 14110 (FIG. 14).

In some demonstrative aspects, as shown in FIG. 15, a plurality of energy values 1516 may be determined corresponding to the plurality of ⅓ octave sub-bands 1512, respectively. For example, an energy value 1516 corresponding to a ⅓ octave sub-band 1512 may be determined based on a sum of acoustic energy values in the ⅓ octave sub-band 1512.

In some demonstrative aspects, an energy vector 1520 may be determined to include a vector including the plurality of energies 1516 corresponding to the plurality of frequency sub-bands 1512, for example, after the filtering by the band pass filters 1514.

In some demonstrative aspects, controller 293 (FIG. 2) may be configured to compare the energy vector 1520 with a plurality of reference energy vectors 1530. For example, the plurality of reference energy vectors 1530 may correspond to the plurality of AAC profiles 299 (FIG. 2).

In some demonstrative aspects, controller 293 (FIG. 2) may be configured to determine the mounting profile 1525, for example, based on a match, and/or a correlation, between the energy vector 1520 and a reference energy vector of the plurality of reference energy vectors 1530.

In some demonstrative aspects, one or more of the plurality of reference energy vectors 1530 may correspond to one or more of the plurality of speaker transfer functions 510 (FIG. 5), respectively. According to these aspects, controller 293 (FIG. 2) may compare the energy vector 1520 with one or more energy vectors corresponding to one or more of the plurality of speaker transfer functions 510 (FIG. 5), and may identify a selected speaker transfer functions 510 (FIG. 5), for example, which may have a best match and/or correlation with the energy vector 1520. According to these aspects, controller 293 (FIG. 2) may determine the mounting profile 1525 to include a mounting configuration, which corresponds to the selected speaker transfer function.

Figure 16:
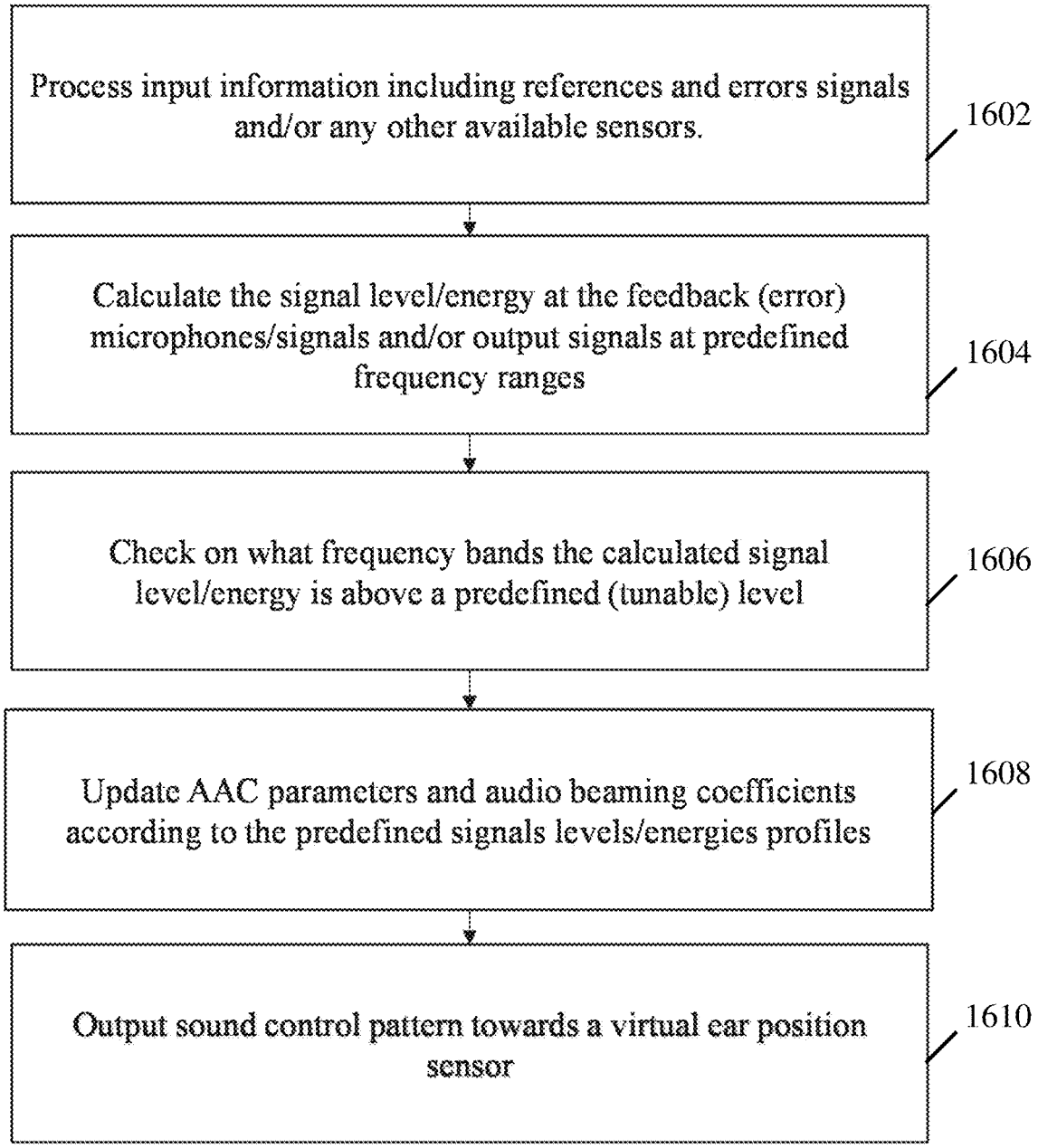
FIG. 16 is a schematic flow-chart illustration of a method of determining a sound control pattern, in accordance with some demonstrative aspects.

Reference is made to FIG. 16, which schematically illustrates a method of determining a sound control pattern, in accordance with some demonstrative aspects. For example, one or more of the operations of FIG. 16 may be performed by one or more components of open acoustic headphone device 100 (FIG. 1), controller 202 (FIG. 2), controller 293 (FIG. 2), controller 1000 (FIG. 10), controller 1100 (FIG. 11), prediction unit 1200 (FIG. 12), and/or controller 1300 (FIG. 13).

In some demonstrative aspects, as indicated at block 1602, the method may include processing input information including noise reference signals and noise error signals, and/or inputs from any other additional or alternative sensors For example, controller 293 (FIG. 2) may process residual-noise input 204 (FIG. 2) and/or noise input 206 (FIG. 2), e.g., as described above.

In some demonstrative aspects, controller 293 (FIG. 2) may be configured to probe a signal level and/or energy at a feedback microphone, e.g., residual-noise sensor 121 (FIG. 2), and/or an output signal of an acoustic transducer, e.g., of acoustic transducer 108 (FIG. 2). For example, controller 293 (FIG. 2) may be configured to modify the setting of the one or more AAC control parameters and/or audio filters coefficients, e.g., above a tunable level/energy.

In one example, for poor fitting, e.g., when open acoustic headphone 110 (FIG. 1) is far from the user head, a loudspeaker sensitivity at low frequencies (LF) may decrease in the feedback microphone, for example, as there may be no more low frequencies standing waves. However, an overall output signal level may increase, e.g., especially at the lower frequencies, for example, as there may be no passive attenuation. According to this example, controller 293 (FIG. 2) may detect the mounting-based parameter, e.g., corresponding to the mounting configuration of open acoustic headphone 110 (FIG. 1), for example, based on residual noise information 121 (FIG. 2), and the output signal 209 (FIG. 2) to generate the output from acoustic transducer.

In some demonstrative aspects, as indicated at block 1604, the method may include determining a signal level/energy at the feedback (error) microphones/signals and/or output signals of one or more acoustic transducers, e.g., at one or more predefined frequency ranges. For example, controller 293 (FIG. 2) may calculate the plurality of energies 1516 (FIG. 15) corresponding to the plurality of frequency sub-bands 1512 (FIG. 15), e.g., as described above.

In some demonstrative aspects, as indicated at block 1606, the method may include checking on what frequency bands the calculated signal level/energy is above a predefined (tunable) level. For example, controller 293 (FIG. 2) may check in the plurality of energies 1516 (FIG. 15), in which frequency sub-bands 1512 (FIG. 15) the energy is above the predefined (tunable) level, e.g., as described above.

In some demonstrative aspects, as indicated at block 1608, the method may include updating AAC parameters and/or audio beaming coefficients, for example, according to one or more predefined signals levels/energies profiles. For example, controller 293 (FIG. 2) may update the setting of one or more sound control parameters for AAC at open acoustic headphone 110 (FIG. 1), for example, based on the vector of energies 1530 (FIG. 15), e.g., as described above.

In some demonstrative aspects, as indicated at block 1610, the method may include outputting a sound control pattern towards a virtual ear position sensor. For example, controller 293 (FIG. 2) may output sound control pattern 209 (FIG. 2) via acoustic transducer 108 (FIG. 1) towards the virtual sensing location 117 (FIG. 1) in the ear 152 (FIG. 1), e.g., as described above.

Figure 17:
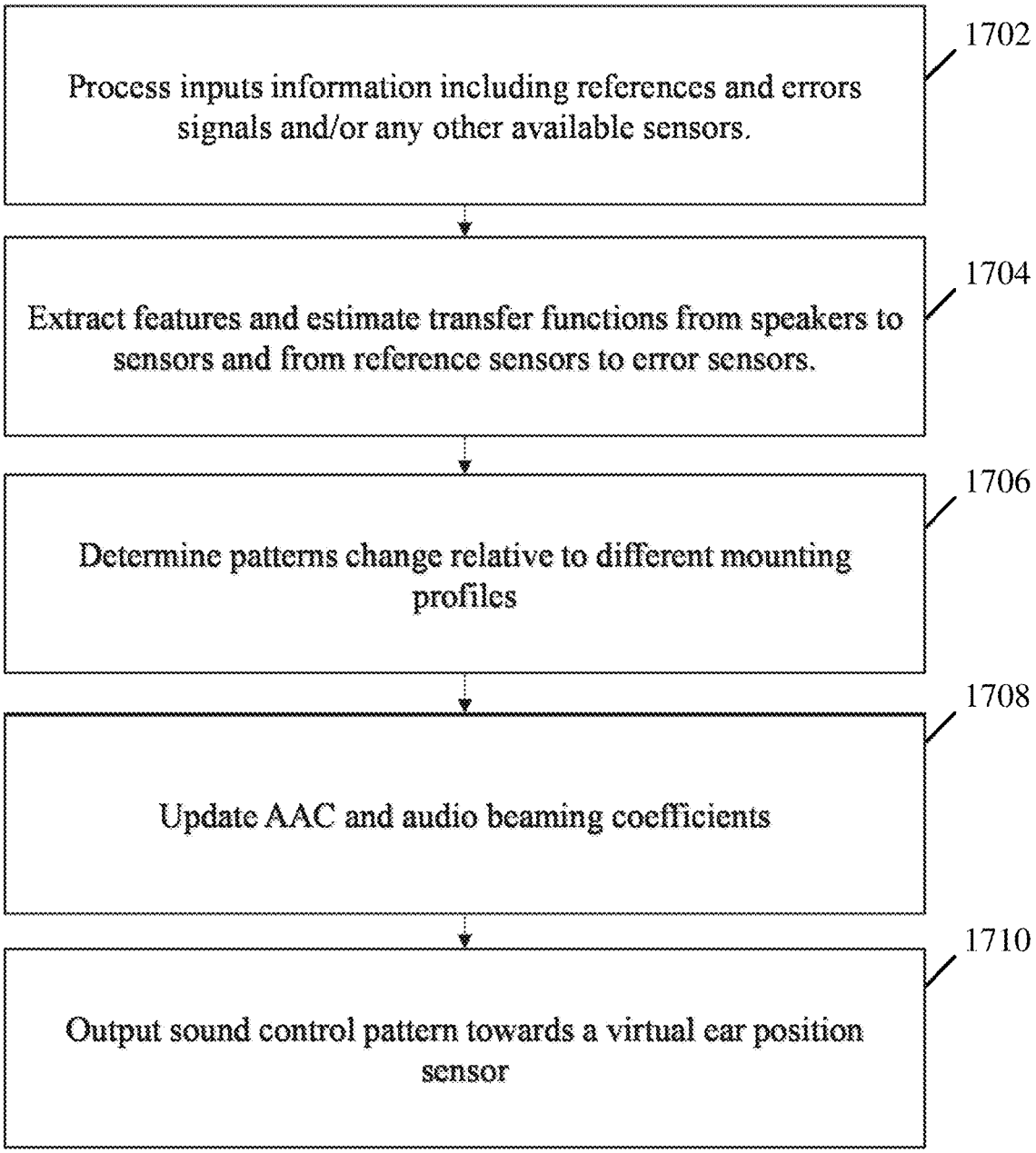
FIG. 17 is a schematic flow-chart illustration of a method of determining a sound control pattern, in accordance with some demonstrative aspects.

Reference is made to FIG. 17, which schematically illustrates a method of determining a sound control pattern, in accordance with some demonstrative aspects. For example, one or more of the operations of FIG. 17 may be performed by one or more components of open acoustic headphone device 100 (FIG. 1), controller 202 (FIG. 2), controller 293 (FIG. 2), controller 1000 (FIG. 1000), controller 1100 (FIG. 11), prediction unit 1200 (FIG. 12), and/or controller 1300 (FIG. 13).

In some demonstrative aspects, as indicated at block 1702, the method may include processing input information including noise reference signals and noise error signals, and/or inputs from any other additional or alternative sensors. For example, controller 293 (FIG. 2) may process residual-noise input 204 (FIG. 2) and/or noise input 206 (FIG. 2), e.g., as described above.

In some demonstrative aspects, as indicated at block 1704, the method may include extracting features and estimating transfer functions from speakers to sensors and/or from reference sensors to error sensors. For example, controller 293 (FIG. 2) may estimate Speaker TFs corresponding to acoustic transducer 108 (FIG. 1) and/or Microphone TFs corresponding to residual-noise sensor 121 (FIG. 1), e.g., as described above.

In some demonstrative aspects, as indicated at block 1706, the method may include determining pattern changes relative to different mounting profiles. For example, controller 293 (FIG. 2) may determine the mounting-based parameter, e.g., corresponding to the mounting configuration of open acoustic headphone 110 (FIG. 1), for example, based on the residual-noise information, e.g., as described above.

In some demonstrative aspects, as indicated at block 1708, the method may include updating AAC parameters and/or audio beaming coefficients. For example, controller 293 (FIG. 2) may update the setting of one or more sound control parameters for AAC at open acoustic headphone 110 (FIG. 1), for example, based on the mounting-based parameter, e.g., as described above.

In some demonstrative aspects, as indicated at block 1710, the method may include outputting a sound control pattern towards a virtual ear position sensor. For example, controller 293 (FIG. 2) may output sound control pattern 209 (FIG. 2) via acoustic transducer 108 (FIG. 1) towards the virtual sensing location 117 (FIG. 1) in the ear 152 (FIG. 1), e.g., as described above.

Figure 18:
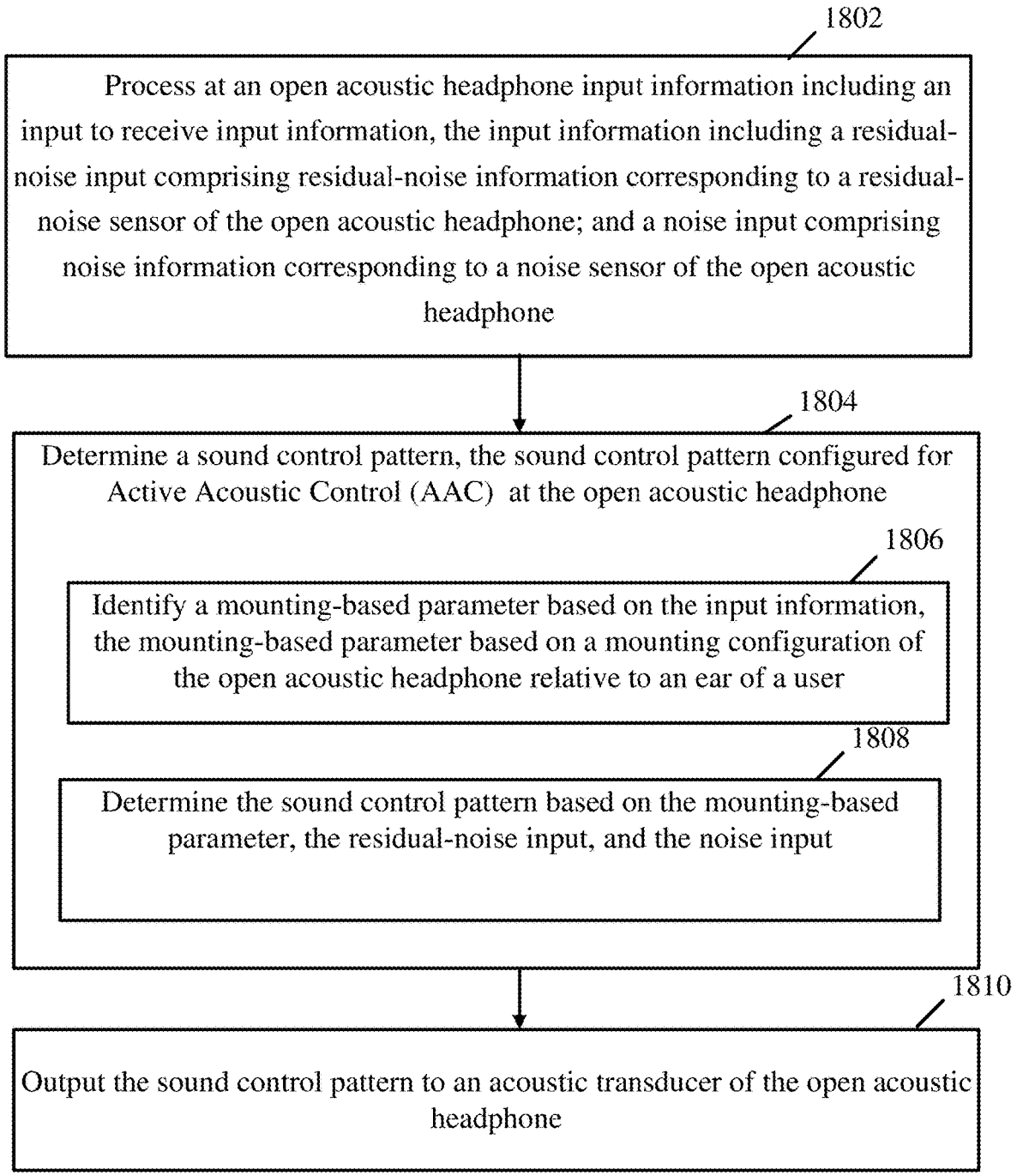
FIG. 18 is a schematic flow-chart illustration of a method of AAC at an open acoustic headphone, in accordance with some demonstrative aspects.

Reference is made to FIG. 18, which schematically illustrates a method for AAC at an open acoustic headphone, in accordance with some demonstrative aspects. For example, one or more of the operations of FIG. 18 may be performed by one or more components of open acoustic headphone device 100 (FIG. 1), controller 202 (FIG. 2), controller 293 (FIG. 2), controller 1000 (FIG. 10), controller 1100 (FIG. 11), prediction unit 1200 (FIG. 12), and/or controller 1300 (FIG. 13).

In some demonstrative aspects, as indicated at block 1802, the method may include processing input information including a residual-noise input including residual-noise information corresponding to a residual-noise sensor of the open acoustic headphone; and a noise input including noise information corresponding to a noise sensor of the open acoustic headphone. For example, controller 293 (FIG. 2) may process the input information from input 292 (FIG. 2), e.g., including the residual-noise input 204 (FIG. 2) and noise input 206 (FIG. 2), e.g., as described above.

In some demonstrative aspects, as indicated at block 1804, the method may include determining a sound control pattern, the sound control pattern configured for AAC at the open acoustic headphone. For example, controller 293 (FIG. 2) may determine the sound control pattern 293 (FIG. 2), which may be configured for AAC at the open acoustic headphone 110 (FIG. 1), e.g., as described above.

In some demonstrative aspects, as indicated at block 1806, determining the sound control pattern may include identifying a mounting-based parameter of the open acoustic headphone based on the input information. For example, the mounting-based parameter may be based on a mounting configuration of the open acoustic headphone relative to an ear of a user. For example, controller 293 (FIG. 2) may identify the mounting-based parameter, e.g., corresponding to the mounting configuration of the open acoustic headphone 110 (FIG. 1), for example, based on the input information 295 (FIG. 2), e.g., as described above.

In some demonstrative aspects, as indicated at block 1808, determining the sound control pattern may include determining the sound control pattern based on the mounting-based parameter of the open acoustic headphone, the residual-noise input, and the noise input. For example, controller 293 (FIG. 2) may determine the sound control pattern 293 (FIG. 2) based on the mounting-based parameter, the residual-noise input 204 (FIG. 2), and the noise input 206 (FIG. 2), e.g., as described above.

In some demonstrative aspects, as indicated at block 1810, the method may include outputting the sound control pattern to an acoustic transducer of the open acoustic headphone. For example, controller 293 (FIG. 1) may output the sound control pattern 209 (FIG. 2) to acoustic transducer 108 (FIG. 1), e.g., as described above.

Figure 19:
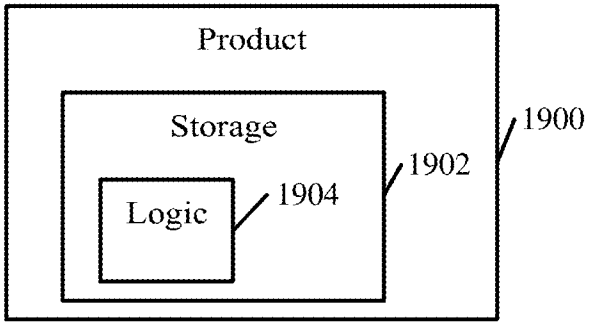
FIG. 19 is a schematic block diagram illustration of a product of manufacture, in accordance with some demonstrative aspects.

Reference is made to FIG. 19, which schematically illustrates a product of manufacture 1900, in accordance with some demonstrative aspects. Product 1900 may include one or more tangible computer-readable ("machine readable") non-transitory storage media 1902, which may include computer-executable instructions, e.g., implemented by logic 1904, operable to, when executed by at least one processor, e.g., computer processor, enable the at least one processor to implement one or more operations of open acoustic headphone device 100 (FIG. 1), controller 202 (FIG. 2), controller 293 (FIG. 2), controller 1000 (FIG. 10), controller 1100 (FIG. 11), prediction unit 1200 (FIG. 12), and/or controller 1300 (FIG. 13), to perform one or more operations, and/or to perform, trigger and/or implement one or more operations, and/or functionalities described above with reference to FIGS. 1, 2, 3, 4, 5, 6, 7, 8, 9, 10, 11, 12, 13, 14, 15, 16, 17, and/or 18, and/or one or more operations described herein. The phrases "non-transitory machine-readable media (medium)" and "computer-readable non-transitory storage media (medium)" are directed to include all computer-readable media, with the sole exception being a transitory propagating signal.

In some demonstrative aspects, product 1900 and/or storage media 1902 may include one or more types of computer-readable storage media capable of storing data, including volatile memory, non-volatile memory, removable or non-removable memory, erasable or non-erasable memory, writeable or re-writeable memory, and the like. For example, storage media 1602 may include, RAM, DRAM, Double-Data-Rate DRAM (DDR-DRAM), SDRAM, static RAM (SRAM), ROM, programmable ROM (PROM), erasable programmable ROM (EPROM), electrically erasable programmable ROM (EEPROM), flash memory (e.g., NOR or NAND flash memory), content addressable memory (CAM), polymer memory, phase-change memory, ferroelectric memory, silicon-oxide-nitride-oxide-silicon (SONOS) memory, a disk, a hard drive, and the like. The computer-readable storage media may include any suitable media involved with downloading or transferring a computer program from a remote computer to a requesting computer carried by data signals embodied in a carrier wave or other propagation medium through a communication link, e.g., a modem, radio or network connection.

In some demonstrative aspects, logic 1904 may include instructions, data, and/or code, which, if executed by a machine, may cause the machine to perform a method, process and/or operations as described herein. The machine may include, for example, any suitable processing platform, computing platform, computing device, processing device, computing system, processing system, computer, processor, or the like, and may be implemented using any suitable combination of hardware, software, firmware, and the like.

In some demonstrative aspects, logic 1904 may include, or may be implemented as, software, a software module, an application, a program, a subroutine, instructions, an instruction set, computing code, words, values, symbols, and the like. The instructions may include any suitable type of code, such as source code, compiled code, interpreted code, executable code, static code, dynamic code, and the like. The instructions may be implemented according to a predefined computer language, manner or syntax, for instructing a processor to perform a certain function. The instructions may be implemented using any suitable high-level, low-level, object-oriented, visual, compiled and/or interpreted programming language, and the like.

EXAMPLES

The following examples pertain to further aspects.

Example 1 includes an apparatus for Active Acoustic Control (AAC) at an open acoustic headphone, the apparatus comprising an input to receive input information, the input information comprising a residual-noise input comprising residual-noise information corresponding to a residual-noise sensor of the open acoustic headphone; and a noise input comprising noise information corresponding to a noise sensor of the open acoustic headphone; a controller configured to determine a sound control pattern, the sound control pattern configured for AAC at the open acoustic headphone, the controller configured to identify a mounting-based parameter based on the input information, the mounting-based parameter is based on a mounting configuration of the open acoustic headphone relative to an ear of a user, wherein the controller is configured to determine the sound control pattern based on the mounting-based parameter, the residual-noise information, and the noise information; and an output to output the sound control pattern to an acoustic transducer of the open acoustic headphone.

Example 2 includes the subject matter of Example 1, and optionally, wherein the controller is configured to determine the mounting-based parameter based on the residual-noise information.

Example 3 includes the subject matter of Example 2, and optionally, wherein the controller is configured to cause the acoustic transducer to generate a calibration acoustic signal, to identify calibration information in the residual-noise information, the calibration information based on the calibration acoustic signal as sensed by the residual-noise sensor, and to determine the mounting-based parameter based on the calibration information.

Example 4 includes the subject matter of Example 2, and optionally, wherein the controller is configured to determine an acoustic transfer function between the acoustic transducer and a residual-noise sensing location based on the residual-noise information, and to determine the mounting-based parameter based on the acoustic transfer function between the acoustic transducer and the residual-noise sensing location.

Example 5 includes the subject matter of any one of Examples 1-4, and optionally, wherein the controller is configured to determine the mounting-based parameter based on the noise information.

Example 6 includes the subject matter of any one of Examples 1-5, and optionally, wherein the input information comprises sensor information from a positioning sensor, the controller configured to determine the mounting-based parameter based on the sensor information.

Example 7 includes the subject matter of Example 6, and optionally, wherein the sensor information comprises positioning information corresponding to a positioning of the open acoustic headphone relative to the ear of the user.

Example 8 includes the subject matter of any one of Examples 1-7, and optionally, wherein the controller is configured to determine an acoustic transfer function between the acoustic transducer and the residual-noise sensor based on the mounting-based parameter, and to determine the sound control pattern based on the acoustic transfer function between the acoustic transducer and the residual-noise sensor.

Example 9 includes the subject matter of any one of Examples 1-8, and optionally, wherein the controller is configured to determine an acoustic transfer function between the acoustic transducer and a residual-noise sensing location in the ear of the user based on the mounting-based parameter, and to determine the sound control pattern based on the acoustic transfer function between the acoustic transducer and the residual-noise sensing location in the ear of the user.

Example 10 includes the subject matter of any one of Examples 1-9, and optionally, wherein the controller is to determine virtual residual-noise information based on the residual-noise input and the mounting-based parameter, the virtual residual-noise information corresponding to a virtual residual-noise sensing location in the ear of the user, and to determine the sound control pattern based on the virtual residual-noise information.

Example 11 includes the subject matter of any one of Examples 1-10, and optionally, wherein the controller is configured to determine a configuration of an acoustic field of the acoustic transducer based on the mounting-based parameter, and to determine the sound control pattern based on the configuration of the acoustic field of the acoustic transducer.

Example 12 includes the subject matter of any one of Examples 1-11, and optionally, wherein the mounting-based parameter is based on a position of the open acoustic headphone relative to the ear of the user.

Example 13 includes the subject matter of any one of Examples 1-12, and optionally, wherein the mounting-based parameter is based on a distance between the ear of the user and the acoustic transducer.

Example 14 includes the subject matter of any one of Examples 1-13, and optionally, wherein the mounting-based parameter is based on an orientation of the open acoustic headphone relative to the ear of the user.

Example 15 includes the subject matter of any one of Examples 1-14, and optionally, wherein the mounting-based parameter is based on an acoustic environment between the open acoustic headphone and the ear of the user.

Example 16 includes the subject matter of any one of Examples 1-15, and optionally, wherein the controller is configured to determine an AAC profile based on the mounting-based parameter, and to determine the sound control pattern based on the AAC profile.

Example 17 includes the subject matter of Example 16, and optionally, wherein the AAC profile comprises a setting of one or more sound control parameters, the controller configured to determine the sound control pattern based on the setting of the one or more sound control parameters.

Example 18 includes the subject matter of any one of Examples 1-17, comprising a memory to store a plurality of AAC profiles corresponding to a plurality of predefined mounting configurations, respectively, an AAC profile comprising a setting of one or more sound control parameters corresponding to a predefined mounting configuration of the plurality of predefined mounting configurations, wherein the controller is configured to select from the plurality of AAC profiles a selected AAC profile based on the mounting-based parameter of the open acoustic headphone, and to determine the sound control pattern based on the selected AAC profile.

Example 19 includes the subject matter of any one of Examples 1-18, and optionally, wherein the controller is configured to determine a setting of one or more sound control parameters based on the mounting-based parameter, and to determine the sound control pattern based on the setting of the one or more sound control parameters.

Example 20 includes the subject matter of Example 19, and optionally, wherein the setting of the one or more sound control parameters comprises a setting of one or more parameters of a prediction filter to be applied for determining the sound control pattern.

Example 21 includes the subject matter of Example 20, and optionally, wherein the one or more parameters of the prediction filter comprise a prediction filter weight vector of the prediction filter.

Example 22 includes the subject matter of Example 20 or 21, and optionally, wherein the one or more parameters of the prediction filter comprise an update rate parameter for updating a prediction filter weight vector of the prediction filter.

Example 23 includes the subject matter of any one of Examples 20-22, and optionally, wherein the prediction filter comprises a noise prediction filter to be applied to a prediction filter input, which is based on the noise input.

Example 24 includes the subject matter of any one of Examples 20-22, and optionally, wherein the prediction filter comprises a residual-noise prediction filter to be applied to a prediction filter input, which is based on the residual-noise input.

Example 25 includes the subject matter of any one of Examples 19-24, and optionally, wherein the setting of the one or more sound control parameters comprises a setting of one or more path transfer functions to be applied for determining the sound control pattern.

Example 26 includes the subject matter of Example 25, and optionally, wherein the one or more path transfer functions comprise a speaker transfer function corresponding to the acoustic transducer.

Example 27 includes the subject matter of any one of Examples 1-26, and optionally, comprising an Acoustic Feedback (AFB) mitigator configured to mitigate AFB between the acoustic transducer and the noise sensor, the AFB mitigator comprising a first filter configured to generate a first filtered signal by filtering a first input signal according to a first filter function, the first input signal based on the sound control pattern; and a second filter configured to generate a second filtered signal by filtering the first input signal according to a second filter function, wherein the second filter comprises an adaptive filter, which is adapted based on a difference between an AFB-mitigated signal and the second filtered signal, wherein the AFB-mitigated signal is based on a difference between a second input signal and the first filtered signal, the second input signal based on acoustic noise sensed by the noise sensor.

Example 28 includes the subject matter of Example 27, and optionally, wherein the first filter comprises a fixed filter having a fixed filter function.

Example 29 includes the subject matter of Example 28, and optionally, wherein the fixed filter function is based on a predefined acoustic configuration of the open acoustic headphone.

Example 30 includes the subject matter of Example 28 or 29, and optionally, wherein the fixed filter function is based on a predefined acoustic configuration between the acoustic transducer and the noise sensor.

Example 31 includes the subject matter of any one of Examples 28-30, and optionally, comprising a first subtractor to generate a first AFB-mitigated signal by subtracting the first filtered signal from the second input signal, and a second subtractor to generate a second AFB-mitigated signal by subtracting the second filtered signal from the first AFB-mitigated signal, wherein the second filter is adapted based on a difference between the first AFB-mitigated signal and the second filtered signal.

Example 32 includes the subject matter of Example 31, and optionally, wherein the sound control pattern is based on an output of a prediction filter, wherein an input to of the prediction filter is based on the second AFB-mitigated signal.

Example 33 includes the subject matter of Example 28, and optionally, comprising a third filter configured to generate a third filtered signal by filtering the first input signal according to a third filter function, wherein the third filter comprises an adaptive filter, which is adapted based on subtraction of a filtered predefined signal from the difference between the AFB-mitigated signal and the second filtered signal, wherein the filtered predefined signal comprises a predefined signal filtered by the third filter.

Example 34 includes the subject matter of Example 33, and optionally, wherein the predefined signal comprises a noise signal.

Example 35 includes the subject matter of Example 33 or 34, and optionally, wherein a frequency spectrum of the predefined signal is different from a frequency spectrum of the first input signal.

Example 36 includes the subject matter of any one of Examples 33-35, and optionally, comprising an adder to generate a modified sensor signal by adding the filtered predefined signal to the second input signal; a first subtractor to generate a first AFB-mitigated signal by subtracting the first filtered signal from the modified sensor signal; and a second subtractor to generate a second AFB-mitigated signal by subtracting from the first AFB-mitigated signal a sum of filtered signals, the sum of filtered signals comprising a sum of the third filtered signal and the filtered predefined signal.

Example 37 includes the subject matter of Example 36, and optionally, wherein the sound control pattern is based on an output of a prediction filter, wherein an input to of the prediction filter is based on the second AFB-mitigated signal.

Example 38 includes the subject matter of Example 27, and optionally, wherein the first filter comprises an adaptive filter, which is adapted based on a subtraction of a filtered predefined signal from the difference between the AFB-mitigated signal and the second filtered signal, wherein the filtered predefined signal comprises a predefined signal filtered by the first filter.

Example 39 includes the subject matter of Example 38, and optionally, wherein the predefined signal comprises a noise signal.

Example 40 includes the subject matter of Example 38 or 39, and optionally, wherein a frequency spectrum of the predefined signal is different from a frequency spectrum of the first input signal.

Example 41 includes the subject matter of any one of Examples 38-40, and optionally, comprising an adder to generate a modified sensor signal by adding the filtered predefined signal to the second input signal; a first subtractor to generate a first AFB-mitigated signal by subtracting the first filtered signal from the modified sensor signal; and a second subtractor to generate a second AFB-mitigated signal by subtracting the filtered predefined signal from the first AFB-mitigated signal.

Example 42 includes the subject matter of Example 41, and optionally, wherein the sound control pattern is based on an output of a prediction filter, wherein an input to of the prediction filter is based on the second AFB-mitigated signal.

Example 43 includes the subject matter of any one of Examples 27-42, and optionally, wherein the first filter is configured to generate the first filtered signal comprising a first estimation of the AFB, and wherein the second filter is configured to generate the second filtered signal comprising a second estimation of the AFB.

Example 44 includes the subject matter of any one of Examples 27-43, and optionally, wherein the second filter is configured to generate the second filtered signal based on a change in the AFB.

Example 45 includes the subject matter of any one of Examples 27-44, and optionally, comprising a Prediction Filter (PF) configured to generate a PF output based on a PF input and an acoustic configuration between the acoustic transducer and a sound control zone, wherein the first input signal is based on the PF output, wherein the PF input is based on the AFB-mitigated signal.

Example 46 includes the subject matter of Example 45, and optionally, wherein the sound control pattern is based on a combination of the PF output and at least one of an audio signal or a voice signal.

Example 47 includes the subject matter of any one of Examples 27-46, and optionally, wherein the second filter is adapted based on an Least Mean Squares (LMS) algorithm, or an LMS algorithm variant.

Example 48 includes the subject matter of any one of Examples 27-47, and optionally, wherein at least one of the first filter or the second filter is a Finite Impulse Response (FIR) filter.

Example 49 includes the subject matter of any one of Examples 27-48, and optionally, wherein at least one of the first filter or the second filter is an Infinite Impulse Response (IIR) filter.

Example 50 includes the subject matter of any one of Examples 1-49, and optionally, comprising the residual-noise sensor, the noise sensor, and the acoustic transducer.

Example 51 includes an open acoustic headphone device comprising the apparatus of any one of Examples 1-50, the open acoustic headphone device comprising at least one open acoustic headphone comprising a noise sensor; a residual-noise sensor; and an acoustic transducer; and a controller configured to process input information comprising a residual-noise input comprising residual-noise information corresponding to the residual-noise sensor of the open acoustic headphone, and a noise input comprising noise information corresponding to the noise sensor of the open acoustic headphone, wherein the controller is configured to determine a sound control pattern for Active Acoustic Control (AAC) at the open acoustic headphone, the controller configured to identify a mounting-based parameter of the open acoustic headphone based on the input information, the mounting-based parameter is based on a mounting configuration of the open acoustic headphone relative to an ear of a user, wherein the controller is configured to determine the sound control pattern based on the mounting-based parameter, the residual-noise information, and the noise information, the controller to provide the sound control pattern to the acoustic transducer.

Example 52 includes an apparatus comprising means for executing any of the described operations of any one or more of Examples 1-51.

Example 53 includes a machine-readable medium that stores instructions for execution by a processor to perform any of the described operations of any one or more of Examples 1-51.

Example 54 includes a product comprising one or more tangible computer-readable non-transitory storage media comprising computer-executable instructions operable to, when executed by at least one processor, enable the at least one processor to cause a computing device to perform any of the described operations of any one of Examples 1-51.

Example 55 includes an apparatus comprising a memory; and processing circuitry configured to perform any of the described operations of any one or more of Examples 1-51.

Example 56 includes a method including any of the described operations of any one or more of Examples 1-51.

Functions, operations, components and/or features described herein with reference to one or more aspects, may be combined with, or may be utilized in combination with, one or more other functions, operations, components and/or features described herein with reference to one or more other aspects, or vice versa.

While certain features have been illustrated and described herein, many modifications, substitutions, changes, and equivalents may occur to those skilled in the art. It is, therefore, to be understood that the appended claims are intended to cover all such modifications and changes as fall within the true spirit of the disclosure.

What is claimed is:

1. An apparatus for Active Acoustic Control (AAC) at an open acoustic headphone, the apparatus comprising:

an input to receive input information, the input information comprising:

a residual-noise input comprising residual-noise information corresponding to a residual-noise sensor of the open acoustic headphone; and a noise input comprising noise information corresponding to a noise sensor of the open acoustic headphone;

a controller configured to determine a sound control pattern, the sound control pattern configured for AAC at the open acoustic headphone, the controller configured to identify a mounting-based parameter based on the input information, the mounting-based parameter is based on a mounting configuration of the open acoustic headphone relative to an ear of a user, wherein the controller is configured to determine the sound control pattern based on the mounting-based parameter, the residual-noise information, and the noise information, wherein the controller is configured to determine a setting of one or more parameters of a prediction filter based on the mounting-based parameter, and to determine the sound control pattern based on the setting of the one or more parameters of the prediction filter; and an output to output the sound control pattern to an acoustic transducer of the open acoustic headphone.

2. The apparatus of claim 1, wherein the controller is configured to determine the mounting-based parameter based on the residual-noise information.

3. The apparatus of claim 2, wherein the controller is configured to cause the acoustic transducer to generate a calibration acoustic signal, to identify calibration information in the residual-noise information, the calibration information based on the calibration acoustic signal as sensed by the residual-noise sensor, and to determine the mounting-based parameter based on the calibration information.

4. The apparatus of claim 2, wherein the controller is configured to determine an acoustic transfer function between the acoustic transducer and a residual-noise sensing location based on the residual-noise information, and to determine the mounting-based parameter based on the acoustic transfer function between the acoustic transducer and the residual-noise sensing location.

5. The apparatus of claim 1, wherein the controller is configured to determine the mounting-based parameter based on the noise information.

6. The apparatus of claim 1, wherein the input information comprises sensor information from a positioning sensor, the controller configured to determine the mounting-based parameter based on the sensor information.

7. The apparatus of claim 1, wherein the controller is configured to determine an acoustic transfer function between the acoustic transducer and the residual-noise sensor based on the mounting-based parameter, and to determine the sound control pattern based on the acoustic transfer function between the acoustic transducer and the residual-noise sensor.

8. The apparatus of claim 1, wherein the controller is configured to determine an acoustic transfer function between the acoustic transducer and a residual-noise sensing location in the ear of the user based on the mounting-based parameter, and to determine the sound control pattern based on the acoustic transfer function between the acoustic transducer and the residual-noise sensing location in the ear of the user.

9. The apparatus of claim 1, wherein the controller is to determine virtual residual-noise information based on the residual-noise input and the mounting-based parameter, the virtual residual-noise information corresponding to a virtual residual-noise sensing location in the ear of the user, and to determine the sound control pattern based on the virtual residual-noise information.

10. The apparatus of claim 1, wherein the controller is configured to determine a configuration of an acoustic field of the acoustic transducer based on the mounting-based parameter, and to determine the sound control pattern based on the configuration of the acoustic field of the acoustic transducer.

11. The apparatus of claim 1, wherein the mounting-based parameter is based on at least one of a position of the open acoustic headphone relative to the ear of the user, a distance between the ear of the user and the acoustic transducer, or an orientation of the open acoustic headphone relative to the ear of the user.

12. The apparatus of claim 1, wherein the mounting-based parameter is based on an acoustic environment between the open acoustic headphone and the ear of the user.

13. The apparatus of claim 1, comprising a memory to store a plurality of AAC profiles corresponding to a plurality of predefined mounting configurations, respectively, an AAC profile comprising a setting of one or more sound control parameters corresponding to a predefined mounting configuration of the plurality of predefined mounting configurations, wherein the controller is configured to select from the plurality of AAC profiles a selected AAC profile based on the mounting-based parameter of the open acoustic headphone, and to determine the sound control pattern based on the selected AAC profile.

14. The apparatus of claim 1, wherein the controller is configured to determine a setting of one or more sound control parameters based on the mounting-based parameter, and to determine the sound control pattern based on the setting of the one or more sound control parameters.

15. The apparatus of claim 14, wherein the setting of the one or more sound control parameters comprises a setting of one or more path transfer functions to be applied for determining the sound control pattern.

16. The apparatus of claim 1 comprising an Acoustic Feedback (AFB) mitigator configured to mitigate AFB between the acoustic transducer and the noise sensor, the AFB mitigator comprising:

a first filter configured to generate a first filtered signal by filtering a first input signal according to a first filter function, the first input signal based on the sound control pattern; and a second filter configured to generate a second filtered signal by filtering the first input signal according to a second filter function, wherein the second filter comprises an adaptive filter, which is adapted based on a difference between an AFB-mitigated signal and the second filtered signal, wherein the AFB-mitigated signal is based on a difference between a second input signal and the first filtered signal, the second input signal based on acoustic noise sensed by the noise sensor.

17. The apparatus of claim 16, wherein the first filter comprises a fixed filter having a fixed filter function.

18. The apparatus of claim 17 comprising a third filter configured to generate a third filtered signal by filtering the first input signal according to a third filter function, wherein the third filter comprises an adaptive filter, which is adapted based on subtraction of a filtered predefined signal from the difference between the AFB-mitigated signal and the second filtered signal, wherein the filtered predefined signal comprises a predefined signal filtered by the third filter.

19. The apparatus of claim 16, wherein the first filter comprises an adaptive filter, which is adapted based on a subtraction of a filtered predefined signal from the difference between the AFB-mitigated signal and the second filtered signal, wherein the filtered predefined signal comprises a predefined signal filtered by the first filter.

20. The apparatus of claim 16 comprising a Prediction Filter (PF) configured to generate a PF output based on a PF input and an acoustic configuration between the acoustic transducer and a sound control zone, wherein the first input signal is based on the PF output, wherein the PF input is based on the AFB-mitigated signal.

21. An open acoustic headphone device comprising:

at least one open acoustic headphone comprising:

a noise sensor;

a residual-noise sensor; and an acoustic transducer; and a controller configured to process input information comprising a residual-noise input comprising residual-noise information corresponding to the residual-noise sensor of the open acoustic headphone, and a noise input comprising noise information corresponding to the noise sensor of the open acoustic headphone, wherein the controller is configured to determine a sound control pattern for Active Acoustic Control (AAC) at the open acoustic headphone, the controller configured to identify a mounting-based parameter of the open acoustic headphone based on the input information, the mounting-based parameter is based on a mounting configuration of the open acoustic headphone relative to an ear of a user, wherein the controller is configured to determine the sound control pattern based on the mounting-based parameter, the residual-noise input, and the noise input, wherein the controller is configured to determine a setting of one or more parameters of a prediction filter based on the mounting-based parameter, and to determine the sound control pattern based on the setting of the one or more parameters of the prediction filter, the controller to provide the sound control pattern to the acoustic transducer.

22. The open acoustic headphone device of claim 21, wherein the controller is configured to determine an acoustic transfer function based on the mounting-based parameter, and to determine the sound control pattern based on the acoustic transfer function.

23. A product comprising one or more tangible computer-readable non-transitory storage media comprising computer-executable instructions operable to, when executed by at least one processor, enable the at least one processor to cause a controller of an Active Acoustic Control (AAC) system at an open acoustic headphone to:

process input information comprising:

a residual-noise input comprising residual-noise information corresponding to a residual-noise sensor of the open acoustic headphone; and a noise input comprising noise information corresponding to a noise sensor of the open acoustic headphone;

identify a mounting-based parameter of the open acoustic headphone based on the input information, the mounting-based parameter is based on a mounting configuration of the open acoustic headphone relative to an ear of a user;

determine a sound control pattern for AAC at the open acoustic headphone based on the mounting-based parameter, the residual-noise information, and the noise information, wherein the instructions, when executed, cause the controller to determine a setting of one or more parameters of a prediction filter based on the mounting-based parameter, and to determine the sound control pattern based on the setting of the one or more parameters of the prediction filter; and provide the sound control pattern to an acoustic transducer of the open acoustic headphone.

24. The product of claim 23, wherein the instructions, when executed, cause the controller to determine the mounting-based parameter based on at least one of the residual-noise information, or the noise information.

* * * * *